US008337280B2

(12) United States Patent
Duescher

(10) Patent No.: US 8,337,280 B2
(45) Date of Patent: Dec. 25, 2012

(54) HIGH SPEED PLATEN ABRADING WIRE-DRIVEN ROTARY WORKHOLDER

(76) Inventor: Wayne O. Duescher, Roseville, MN (US)

( * ) Notice: Subject to any disclaimer, the term of this patent is extended or adjusted under 35 U.S.C. 154(b) by 331 days.

(21) Appl. No.: 12/807,794

(22) Filed: Sep. 14, 2010

(65) Prior Publication Data

US 2012/0064802 A1 Mar. 15, 2012

(51) Int. Cl.
*B24B 7/00* (2006.01)
*B24B 49/00* (2006.01)

(52) U.S. Cl. ..... 451/267; 451/269; 451/287; 451/288; 451/290; 451/398

(58) Field of Classification Search ..... 451/41, 451/261, 262, 267, 268, 269, 285, 287, 288, 451/290, 398
See application file for complete search history.

(56) References Cited

U.S. PATENT DOCUMENTS 4,593,495 A 6/1986 Kawakami et al.
4,918,870 A 4/1990 Torbert et al.
5,014,468 A 5/1991 Ravipati et al.
5,205,082 A 4/1993 Shendon et al.
5,314,513 A 5/1994 Miller et al.
5,364,655 A 11/1994 Nakamura et al.
5,569,062 A 10/1996 Karlsrud
5,643,067 A 7/1997 Katsuoka et al.
5,769,697 A 6/1998 Nishio
5,800,254 A 9/1998 Motley et al.
5,863,306 A 1/1999 Wei et al.
5,910,041 A 6/1999 Duescher
5,916,009 A 6/1999 Izumi et al.
5,964,651 A 10/1999 Hose
5,967,882 A 10/1999 Duescher
5,975,997 A 11/1999 Minami
5,989,104 A 11/1999 Kim et al.
5,993,298 A 11/1999 Duescher
6,048,254 A 4/2000 Duescher
6,089,959 A 7/2000 Nagahashi
6,102,777 A 8/2000 Duescher et al.
6,120,352 A 9/2000 Duescher
6,149,506 A 11/2000 Duescher
6,165,056 A 12/2000 Hayashi et al.
6,168,506 B1 1/2001 McJunken
6,217,433 B1 4/2001 Herrman et al.
6,296,546 B1 * 10/2001 Allen et al. ..... 451/5
6,371,838 B1 4/2002 Holzapfel
6,398,906 B1 6/2002 Kobayashi et al.
6,439,965 B1 8/2002 Ichino et al.
6,506,105 B1 1/2003 Kajiwara et al.
6,607,157 B1 8/2003 Duescher
(Continued)

*Primary Examiner* — Eileen P. Morgan
(74) *Attorney, Agent, or Firm* — Mark A. Litman & Associates, P.A.

(57) ABSTRACT

A method and apparatus for using continuous-loop wires to drive circular flat-surfaced disk-type workholders which are positioned between two opposed upper and lower abrasive-surfaced rotatable platens. Flat-surfaced workpieces are mounted in receptacle openings in the workholders where both surfaces of the workpieces are simultaneously abraded by the two opposed platen that have annular bands of abrasive coatings. The drive wires allow the workholders to be driven at high speeds because of the smooth-action interface between the wires and the circular workholder disks that have circular wire grooves around the peripheries of the workholders. Each workholder assembly consists of a workholder disk, a drive wire, wire idlers, workholder idlers, a wire-tension device, a workholder disk support device and a wire drive motor. The workholder assemblies can be moved away from the platen surface to change platen abrasive disks. Three workholders provide stable three-point support of a floating upper platen.

20 Claims, 20 Drawing Sheets

U.S. PATENT DOCUMENTS 6,752,700 B2 6/2004 Duescher
6,769,969 B1 8/2004 Duescher
6,786,810 B2 9/2004 Muilenburg et al.
6,893,332 B2 5/2005 Castor
6,896,584 B2 5/2005 Perlov et al.
6,899,603 B2 5/2005 Homma et al.
6,935,013 B1 8/2005 Markevitch et al.
7,001,251 B2 2/2006 Doan et al.
7,008,303 B2 3/2006 White et al.
7,014,535 B2 3/2006 Custer et al.
7,029,380 B2 4/2006 Horiguchi et al.
7,033,251 B2 4/2006 Elledge
7,044,838 B2 5/2006 Maloney et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,357,699 B2 4/2008 Togawa et al.
7,367,867 B2 5/2008 Boller
7,393,790 B2 7/2008 Britt et al.
7,422,634 B2 9/2008 Powell et al.
7,446,018 B2 11/2008 Brogan et al.
7,456,106 B2 11/2008 Koyata et al.
7,470,169 B2 * 12/2008 Taniguchi et al. ..... 451/36
7,491,342 B2 2/2009 Kamiyama et al.
7,507,148 B2 3/2009 Kitahashi et al.
7,520,800 B2 4/2009 Duescher
7,527,722 B2 5/2009 Sharan
7,582,221 B2 9/2009 Netsu et al.
7,614,939 B2 11/2009 Tolles et al.
7,632,434 B2 12/2009 Duescher
2005/0118939 A1 6/2005 Duescher
2008/0299875 A1 12/2008 Duescher
2010/0003904 A1 1/2010 Duescher

* cited by examiner

HIGH SPEED PLATEN ABRADING WIRE-DRIVEN ROTARY WORKHOLDER

BACKGROUND OF THE INVENTION

Field of the Invention

The present invention relates to the field of abrasive treatment of surfaces such as grinding, polishing and lapping. In particular, the present invention relates to a high speed wire-driven planetary workholder system for both single-sided and double-sided abrading machines. The system provides increased abrading speed capabilities as compared to conventional pin-gear planetary workholders that are used in existing double-sided abrading systems. For single-sided abrading, flat-surfaced workpieces are inserted into receptacle-holes in a workholder disk where the bottom flat surfaces of the workpieces are in flat-surfaced abrading contact with the flat abrading surface of a flat-surfaced lower abrading platen. For double-sided abrading, the workholder disk is positioned between two opposed rotary abrading platens where both workpiece surfaces are in abrading contact with both abrading surfaces of the two abrading platens.

Wire-Driven Planetary Workpiece Holders

Use of continuous loops of wire to drive disk-type workholders that are sandwiched between two opposed abrasive-coated rotary platens allows these workholders to be driven at much greater rotational speeds than the conventional pin-gear driven workholders. This speed increase allows the platen abrading speeds to be increased substantially with a corresponding increase of the productivity of these abrading systems.

Presently, floating abrasive platens are used in double-sided lapping and double-sided micro-grinding (flat-honing) but the abrading speeds of both of these systems are very low. The upper floating platens used with these systems are positioned in conformal contact with multiple equal-thickness workpieces that are in flat contact with the flat abrading surface of a lower platen. Both the upper and lower abrasive coated platens are typically concentric with each other and they are rotated independent of each other. Often the platens are rotated in opposite directions to minimize the net abrading forces that are applied to the workpieces that are sandwiched between the flat surfaces of the two platens.

In order to compensate for the different abrading speeds that exist at the inner and outer radii of the annular band of abrasive that is on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece and unfavorable for the other platen. Here, the speed differential of the rotated workpiece acts against the other platen that is rotated in a direction that is reversed from the workpiece rotation.

Rotation of the workpieces is done with thin gear driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net abrasive force is applied to the fragile disk-type workholders. It is not practical to abrade very thin workpieces with double-sided platen abrasive systems because the required planetary workholder disks are so fragile.

Multiple workpieces are often slurry lapped using flat-surfaced double-sided platens that are coated with a layer of loose abrasive particles that are in a liquid mixture. Slurry lapping is very slow, and also, very messy.

The platen abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving abrasive surface to re-establish the planar flatness of the platen annular band of abrasive.

This abrading system can also be used to recondition the surface of the abrasive that is on the platen. This platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness. Platens are typically reconditioned with the use of conditioning-wheels having annular abrasive surfaces.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles.

During abrading action, both the workpieces and the abrasive platens are rotated simultaneously. Once an upper floating platen "assumes" a position as it rests conformably upon and is supported by the equal-thickness flat workpieces that are supported by the lower abrading platen as both the upper and lower abrading platens are rotated.

Use of a platen vacuum disk attachment system allows quick set-up changes where different sizes of abrasive particles and different types of abrasive material can be quickly attached to the flat platen surfaces. Also, the use of messy loose-abrasive slurries is avoided by using the fixed-abrasive disks.

Double-Sided Floating Platen Systems

Double-sided slurry or micro-grinding (flat-honing) systems also use the approach where the upper floating platens contact equal-thickness workpieces. Rather, both the floating double-sided upper platen and the rigid-supported lower abrasive platen are independently rotated with equal-thickness workpieces sandwiched between the two platens. Multiple flat-surfaced workpieces are spaced around the annular circumference of the lower platen and they are held in abrading contact with the lower platen abrading by the upper abrasive platen. Both opposed surfaces of the workpieces are simultaneously abraded by the concentric rotation of both the upper and lower platens. Workpieces are rotated during the abrading action to provide uniform wear on the workpiece surfaces even though the abrading speeds, and the corresponding workpiece material removal rates, are different at the inner and outer radii of the platen annular abrasive bands.

Double-Sided Abrading Pressures

Double-sided slurry lapping typically has low abrading pressures but double-sided micro-grinding (flat honing) utilizes very high abrading pressures. The workpiece abrading pressures are applied by the upper platen. Because the workpiece abrading pressures of the double-sided micro-grinding (flat honing) system utilizes very high abrading pressures, the upper and lower platens must be strong enough to resists these pressures without distorting the platen planar abrading surfaces. As a result, these platens are typically very heavy in order to provide the required structurally stiff platen abrasive surfaces. Use of very heavy upper platens results in difficulty in accurately controlling the low workpiece abrading pressures desired for high speed flat-lapping.

Pin-Gear Driven Planetary Workholders

Both the upper and lower platen abrasive surfaces are continuously worn into non-planar conditions by abrading contact with the abraded workpieces sandwiched between them. In double-sided floating-platen abrading, the workpieces are held by gear-driven planetary workholder carrier disks that rotate the workpieces during the abrading action. These carrier disks must be thinner than the workpiece to avoid abrading contact of the carriers with the abrasive on both platens. Abrading forces are applied to these thin carriers by the rotating platen abrasive surfaces and portions of these abrading forces are also applied to the planetary carrier drive gears. These thin and fragile workpiece carriers, that are also sandwiched between the platens, can not be driven at high speeds by the carrier disk drive gears. Because of limitations of the workpiece carrier system, both double-sided slurry lapping and micro-grinding (flat-honing) systems operate at low abrading speeds.

BACKGROUND OF THE INVENTION

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800 and commonly assigned U.S. patent application published numbers 20100003904, 20080299875 and 20050118939 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. Nos. 5,364,655 (Nakamura et al). 5,569,062 (Karlsrud), 5,643,067 (Katsuoka et al), 5,769,697 (Nisho), 5,800,254 (Motley et al), 5,916,009 (Izumi et al), 5,964,651 (hose), 5,975,997 (Minami, 5,989,104 (Kim et al), 6,089,959 (Nagahashi, 6,165,056 (Hayashi et al), 6,168,506 (McJunken), 6,217,433 (Herrman et al), 6,439,965 (Ichino), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,250,368 (Kida et al), 7,367,867 (Boller), 7,393,790 (Britt et al), 7,422,634 (Powell et al), 7,446,018 (Brogan et al), 7,456,106 (Koyata et al), 7,470,169 (Taniguchi et al), 7,491,342 (Kamiyama et al), 7,507,148 (Kitahashi et al), 7,527,722 (Sharan) and 7,582,221 (Netsu et al).

I. Double-Sided Abrading

To produce parallel-surfaced workpieces, a different machine technology is used. Here, a large-diameter rigid precision-flat rotating platen is provided. Multiple equal-thickness workpieces are positioned around the circumference of the platen. Then, another large diameter flat-surfaced abrading platen is placed in contact with the top surfaces of the multiple workpieces. Here, the upper platen is allowed to float spherically so its flat surface assumes parallelism with the surface of the bottom platen. Both the upper and bottom platens have equal-diameter abrading surfaces. With this technology, no attempt is made to rigidly position the surface of the upper moving abrasive platen surface precisely perpendicular to the surface of the bottom platen. This co-planar alignment of the two double-sided abrading platens is achieved with ease and simplicity by using the uniform-thickness workpieces as spacers between the two [platens.

II. Raised-Island High Speed Flat Lapping

All of the present precision-flat abrading processes have very slow abrading speeds of about 5 mph. The high speed flat lapping system can operate at speeds of approximately 100 mph. Increasing abrading speeds increase the material removal rates. This results in high workpiece production and large cost savings. In addition, those abrading processes that use liquid abrasive slurries are very messy. The fixed-abrasive used in high speed flat lapping eliminates the slurry mess. Another advantage is the quick-change features of the high speed lapper system where abrasive disks can be quickly changed with use of the disk vacuum attachment system. Changing the sized of the abrasive particles on all of the other abrading systems is slow and troublesome.

III. Quick-Change Abrasive Disks

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks can be stored or shipped flat in layers. Large and very large disks can be rolled and stored or shipped in polymer protective tubes. The abrasive disk quick change capability is especially desirable for laboratory lapping machines but they are also great for prototype lapping and full-scale production lapping machines. This abrasive disk quick-change capability also provides a large advantage over micro-grinding where it is necessary to change-out a worn heavy rigid platen or to replace it with one having different sized particles.

IV. Hydroplaning of Workpieces

Hydroplaning of workpieces occurs when smooth surfaces (continuous thin-coated abrasive) are in fast-moving contact with a flat surface in the presence of surface water. However, it does not occur when interrupted-surfaces (raised islands) contact a flat wetted workpiece surface. An analogy is the tread lugs on auto tires which are used on rain slicked roads. Tires with lugs grip the road at high speeds while bald smooth-surfaced tires hydroplane.

V. Maintaining Abrasive Disk Flat Surface

Care is taken during the lapping procedures to maintain the precision flatness of the abrasive surface. This is done by selecting abrasive disks where the full surface of the abrasive is contacted by the workpiece surface. This results in uniform wear-down of the abrasive. Other techniques can also be used to accomplish this. First, a workpiece that is smaller than the radial width of the annular band of abrasive islands can be oscillated radially during the abrading procedure to overlap both the inner and outer edges of the annular abrasive band. This prevents the formation of tangential raised ribs of abrasive inboard and outboard of the wear-track of the workpiece.

Also, stationary-position conditioning rings can be used in flat contact with the moving abrasive. These rings have diameters that are larger than the radial width of the abrasive island annular band. They preferentially remove the undesirable raised abrasive high spot areas or even raised rib-walls of abrasive that extend around the circumference of the annular band of abrasive. The conditioning rings are similar to those used in slurry lapping to continually maintain the flatness of the rotating slurry platen.

Many of the different techniques used here to maintain the flatness of annular band of fixed-abrasive coated raised islands during the abrading life of an abrasive disk are highly developed and in common use in slurry lapping. In slurry lapping, a liquid mixture that contains loose abrasive particles continuously wears recessed circumferential tracks in the rigid metal platen surface. However, unlike slurry lapping, there is no abrasive wear of the high speed flat lapper platens because only the flexible disk backing contacts the platen surface. Here, the precision flatness of the high speed flat lapper system is re-established by simply changing the abrasive disk.

Because the upper platen uses a spherical bearing that allows the platen to float, the platen holding mechanism can be a simple pivot arm device. The platen spherical-action bearing provides radial support for the platen during rotation so the platen retains its balance even when it is operated at great speeds. Conformal flat contact of the two platens prevents wobble of the upper platen as it is rotated. It is not necessary that the pivot arm position the upper platen in a precision concentric alignment with the lower platen during a double-sided lapping operation.

VI. Raised Island Disks

The reason that this lapping system can be operated at such high speeds is due to the use of precision-thickness abrasive coated raised island disks. Moving abrasive disks are surface cooled with water to prevent overheating of both the workpiece and the abrasive particles. Raised islands prevent hydroplaning of the stationary workpieces that are in flat conformal contact with water wetted abrasive that moves at very high speeds. Abrading speeds are often in excess of 100 mph. Hydroplaning occurs with conventional non-island continuous-coated lapping film disks where a high pressure water film is developed in the gap between the flat workpiece and the flat abrasive surfaces.

During hydroplaning, the workpiece is pushed up away from the abrasive by the high pressure water and also, the workpiece is tilted. These cause undesirable non-flat workpiece surfaces. The non-flat workpieces are typically polished smooth because of the small size of the abrasive particles. However, flat-lapped workpieces require surfaces that are both precision-flat and smoothly polished.

The islands have an analogy in the tread lugs on auto tires which are used on rain slicked roads. Tires with lugs grip the road at high speeds while bald tires hydroplane. Conventional continuous-coated lapping film disks are analogous to the bald tires.

Raised islands also reduce "stiction" forces that tend to bond a flat surfaced workpiece to a water wetted flat-surfaced abrasive surface. High stiction forces require that large forces are applied to a workpiece when the contacting abrasive moves at great speeds relative to the stationary workpiece. These stiction forces tend to tilt the workpiece, resulting in non-flat workpiece surfaces. A direct analogy is the large attachment forces that exist between two water-wetted flat plates that are in conformal contact with each other. It is difficult to slide one plate relative to the other. Also, it is difficult to "pry" one plate away from the other. Raised island have recessed channel passageways between the island structures. The continuous film of coolant water that is attached to the workpiece is broken up by these island passageways. Breaking up the continuous water film substantially reduces the stiction.

VII. Precision Thickness Disks

Another reason that this lapping system can be operated at such high speeds is due to the use of precision-thickness abrasive coated raised island disks. These disks have an array of raised islands arranged in an annular band on a disk backing. The top flat surfaces of the islands are coated with a very thin coating of abrasive. The abrasive coating consists of a monolayer of 0.002 inch beads that typically contain very small 3 micron (0.0001 inch) or sub-micron diamond abrasive particles. Raised island abrasive disks are attached with vacuum to ultra-flat platens that rotate at very high abrading surface speeds, often in excess of 100 mph.

The abrasive disks have to be of a uniform thickness over the full abrading surface of the disk for three primary reasons. The first reason is to present all of the disk abrasive in flat abrading contact with the flat workpiece surface. This is necessary to provide uniform abrading action over the full surface of the workpiece. If only localized "high spots" abrasive surfaces contact a workpiece, undesirable tracks or gouges will be abraded into the workpiece surface. The second reason is to allow all of the expensive diamond abrasive particles contained in the beads to be fully utilized. Again if only localized "high spots" abrasive surfaces contact a workpiece, those abrasive particles located in "low spots" will not contact the workpiece surface. Those abrasive beads that do not have abrading contact with a workpiece will not be utilized.

Because the typical flatness of a lapped workpiece are measured in millionths of an inch, the allowable thickness variation of an raised island abrasive disk to provide uniform abrasive contact must also have extra-ordinary accuracy.

The third reason is to prevent fast moving uneven "high spot" abrasive surfaces from providing vibration excitation of the workpiece that "bump" the workpiece up and away from contact with the flat abrasive surface. Because the abrasive disks rotate at such high speeds and the workpieces are lightweight, these moving bumps tend to repetitively drive the workpiece up after which it falls down again with only occasional contact with the moving abrasive. The result is uneven wear of the workpiece surface.

All three of these reasons are unique to high speed flat lapping. The abrading problems, and solutions described here were progressively originated while developing this total lapping system. They were not known or addressed by others who had developed raised island abrasive disks. Because of that, their disks can not be used for high speed flat lapping.

VIII. Configurations of Workholder Machines

The wire-driven workholder abrading machines can have a variety of configurations. Wire-driven workholders can be used for single-sided abrading or for double-sided abrading. For single-sided abrading, the rotary workholders are positioned where the workpieces that are contained by the workholders are held in flat-surfaced contact with an abrasive coated flat-surfaced rotating platen. For double-sided abrading, the rotary workholders are positioned where the workpieces that are contained by the workholders are positioned between an upper abrasive coated rotary platen and a lower abrasive coated rotary platen. Here, the upper abrading rotary platen can be a floating platen or the upper abrading rotary platen can be rigidly mounted.

Single wire-driven workholders can be used or multiple wire-driven workholders can be used for single-sided abrading and for double-sided abrading. When floating upper platens are used, at least three workholders that evenly-spaced from each other are used to provide stable three-point support of the floating upper platen that is abrading contact with the workpieces that are supported by the lower platen.

The workholder flexible drive-wires can be formed from a long length of a flexible wire that can be used to rotate the workholder disks. Or, continuous-loops of wire can be used to drive one or more of the workholder disks. Continuous-loops of wire can be used for each individual workholder disk or continuous-loop wires can be used to drive multiple workholder disks. Flexible drive wires are guided in grooves in the outer periphery of the workholder disks and also, in the peripheries of other wire-guiding devices. The flexible drive-wires are driven by drive motors and wire-tensioning devices provide wire tension on the flexible drive-wires. The flexible drive wires can be fabricated from a wide variety of metal, polymer or organic materials and they can be end-joined together to form woven, fused, welded, or adhesively-bonded butt-joints for fabrication of continuous-loop drive-wires.

The workholders can be translated or rotated away from the lower platens to provide access for changing the abrasive coating on the lower platen and also, on the upper platens.

In addition, special workholder disk support devices can be used to support the workholder disks where the workholder disks do not contact the abrasive surface of the lower abrading platen or the workholder disks do not contact the abrasive surface of the upper abrading platen. Here, a rotatable workholder support disk can be attached to the rotatable lower platen with a rotatable bearing. It is in rolling contact with the workholder disk or disks and the rotatable workholder support disk can engage the workholder disks and restrain the workholder disks in a direction that is perpendicular to the surfaces of the workholder disks. Use of the rotatable workholder support disk along with workholder disk support idlers can provide support of the workholder disks where there is a controlled gap between the workholder disk flat surfaces and the lower and upper rotary platens flat abrasive surfaces. The rotatable workholder support disk can also engage the workholder disks and restrain the workholder disks in a radial direction relative to workholder disks' diameters.

IX. Types of Abrading with Wire-Driven Workholders

A wide variety of types of lapping, polishing or abrading flat-surfaced workpieces can be accomplished using the wire-driven workholder abrading machines. Wire-driven workholders can be used for single-sided abrading where only one surface of a workpieces is abraded or they can be used double-sided abrading where both opposed surfaces of a workpieces are simultaneously abraded. In one machine configuration, either/or both the upper rotatable platen and the lower rotatable abrading platen approximately horizontal flat annular abrading-surface can have a variety of abrasive coatings. These abrading platens can also have vertical or angled flat annular abrading-surfaces.

Abrasive coatings on the platens surfaces that can be provided can be selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization (CMP) resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings.

SUMMARY OF THE INVENTION

This high speed wire-driven planetary workholder system can be used to provide a substantial increase in abrading speeds for single-sided or double-sided abrading systems. For single-sided abrading, workholder disks containing equal-thickness flat-surfaced workpieces are held in abrading contact with the abrading surface of a rotary abrading platen. For double-sided abrading, the workholders are sandwiched between two opposed abrasive-surfaced rotary platens and both surfaces of the workpieces are simultaneously abraded by the two abrading platens. The workholder disk devices are rotated at controlled abrading speeds by a rotary motor that moves a flexible wire that contacts the outer periphery of the workholder disk. The workpieces can be contained in open disk workholder through-holes where the workpieces are attached to the workholder disks or the workpieces can be allowed to float freely within the open disk workholder through-holes.

The workholder disk is held in position relative to the annular abrading surface of the platen by disk-position idlers that have rolling-contact with the outer circumference of the workholder disk. Workholder disk drive-wires are routed between the drive motor and the workholder disk by use of drive-wire idlers. A drive-wire tensioning device is used to provide force tension on the drive wire. The workholder disk, the disk-position idlers, the drive-wire idlers, drive-wire tension device and the drive-wire motor are all mounted on a workholder device frame. The frame can be translated or rotated to move the workholder disk away from the annular abrading surface of the rotary abrading platen to allow the abrasive disks or other abrasive components or abrasive materials that are on the platen abrading surface to be changed or modified.

Wire groves that are located on the circumference of the workholder disk restrain and guide the drive-wire where it is routed around a portion of the workholder disk and also on the drive-wire rotary idlers. The wire groves in the drive-wire idlers' rotary circumference and wire grooves in the workholder disks' circumference can have a wide variety of geometric groove-shapes that provide substantial and controlled traction-friction interaction between the workholder disk and the drive-wire and also between the drive-wire idlers and the drive-wire. The workholder disk-position idlers can have a variety of circumferential surface shapes that engage and contact the circumferential surface of the workholder disk to restrain the workholder disk in a disk-radial direction. The workholder disk-position idlers can also have a variety of circumferential surface shapes that engage and contact the circumferential surface of the workholder disk where the workholder disk is allowed free-motion movement in a disk-perpendicular direction, or where the workholder disk position-idlers restrains or controls the movement of the disk or the position of the rotatable disk in a disk-perpendicular direction.

Because the workholder disks are rotationally driven by a continuous loop of a flexible drive wire having a uniform cross-sectional diameter along the full length of the drive-wire continuous loop, the rotational-action of the workholder disk is extremely smooth compared to the periodic speed changes that are introduced in planetary workholders that are induced by interactions between the drive-pins and the pin-gear teeth on the planetary workholder. The undesirable abrading patterns caused by these planetary pin-gear speed-perturbations are eliminated by use of the smooth-action continuous-loop drive-wires and the cylindrical-shaped wire-grooved workholder disks.

The lower rotating abrasive platen is supported by a rotary bearing that is mounted on the stationary abrading machine frame. The upper abrasive platen floats in a spherical-angle mode while the platen is rotationally driven. Because the upper floating platen is supported by the flat-surfaced workpieces that are attached to the flat abrading surface of the lower platen, the flat abrading surface of the upper platen is co-planar with the flat abrading surface of the fixed-position lower platen.

The wire-driven workholders are driven from the outer periphery of the platens where the workpieces are rotated while being held at a stationary position relative to the circumference of the platens. The inner-radius pin-drive mechanism that is required for a pin-gear planetary workholder is eliminated which simplifies the construction and operation of the double-sided abrading system.

Use of raised-island abrasive disks allows this abrading system having the wire-driven workholders to be operated at substantially higher abrading speeds than the double-sided platen abrading systems that use conventional pin-gear driven planetary workholders. Also, the speed limitations of the pin-gears driving the fragile, pin-gear planetary workholder disks is no longer an abrading speed-controlling issue.

When flexible abrasive disks are attached to the abrading surface of the platen there is no wear of the platen surface because the abrasive media is not in abrading contact with the platen. Each time a uniform-thickness abrasive disk is attached to a platen, the non-worn platen provides the same precision-flat planar reference surface for the new or changed disk.

Vacuum attachment of the flexible abrasive disks allows workpiece set-up changes to be made very rapidly. Also, different-sized abrasive particles can be changed by simply doing a fast-change of the abrasive disks.

DETAILED DESCRIPTION OF THE INVENTION

Figure 1:
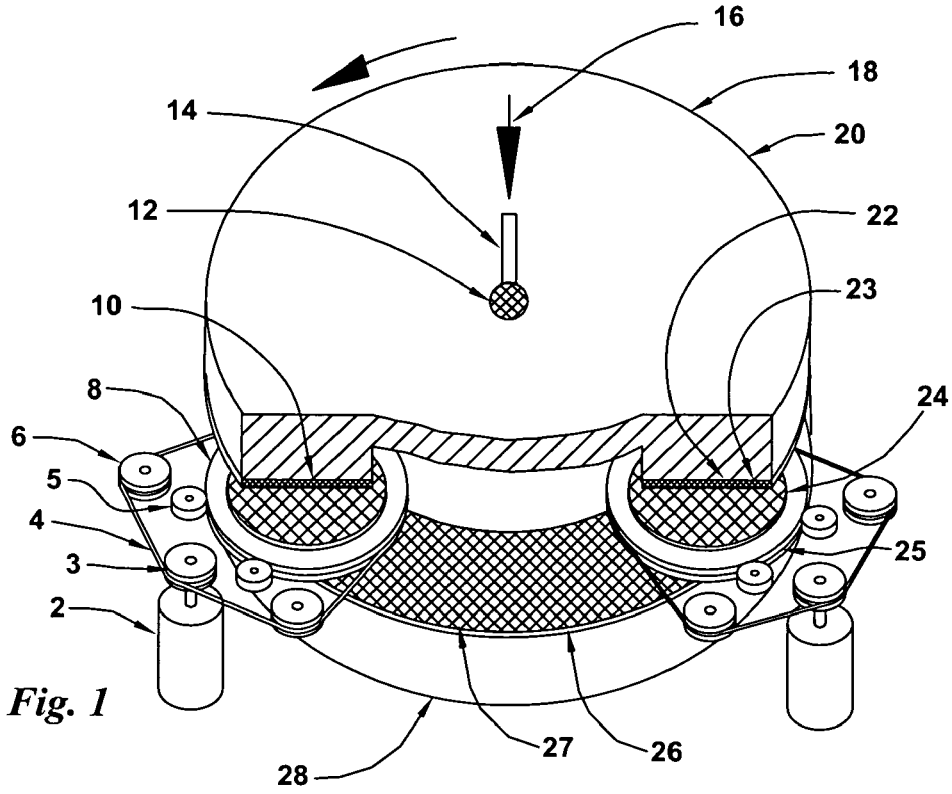
FIG. 1 is an isometric view of wire-driven workholders in a double-sided abrading system.

FIG. 1 is an isometric view of wire-driven workholders in a double-sided abrading system. The abrading system 18 has three-point fixed-position rotating workholders 8 that support a floating rotating abrasive upper platen 20. Flexible abrasive disks 10 having annular bands 23 of abrasive are attached to the platen 20 that has a precision-flat annular surface 22 where the flexible flat abrasive disk 10 conforms to the platen 20 flat annular surface 22. The abrasive disks 10 can have a continuous disk backing (not shown) or the annular abrasive disks 10 can have center hole (not shown). Flat-surfaced workpieces 24 are contained in annular workholders 8 where the workpieces 24 are in abrading contact with both the upper platen 20 abrasive disk 10 and also the lower platen 28 abrasive disk 26 where the abrasive disk 26 is attached to the lower platen 28 annular flat abrading surface 27. There are three workholders 8 that are equally-spaced around the circumference of the lower platen 28 flat annular surface 27. The upper flat surfaces of the three equal-thickness and equal-sized workpieces 24 provide three-point support for the floating upper platen 20 as the workpieces 24 are also in flat contact with the lower platen 28 abrasive disk 26. The workholders 8 centers of rotation (not shown) are located at the circumferential center (not shown) of the lower platen 28 flat annular surface 27. The upper floating platen 20 flat annular surface 22 and the lower rigidly-mounted rotating platen 28 flat annular surface 27 are concentric with each other. Also, both the upper floating platen 20 and the lower rigidly mounted platen 28 are independently rotated in both rotation directions. Both the upper floating platen 20 abrasive disk 10 and the lower rigidly mounted platen 28 abrasive disk 26 simultaneously abrade both opposed flat surfaces of the workpieces 24 where the workpieces 24 abrading pressure is applied by a controlled force 16 that is applied to the upper floating platen 20. The upper floating platen 20 is rotated by a spherical-action device 12 that has a drive shaft 14 where the spherical-action device 12 restrains the upper platen 20 in a platen 20 flat annular surface 22 annular radial direction. The abrading force 16 is evenly distributed to the three workpieces 24 because the three workholders 8 are equally spaced around the circumference of the lower platen 28.

The workholders 8 are rotated by drive-wires 4 that are contained in wire-grooves 25 that surround the outer circumference of the workholders 8. The workholders 8 are restrained in a radial direction of the lower platen 28 flat annular surface 27 by contact of the annular disk type workholders 8 with the disk-idlers 5 where the force-tensioned wire 4 applies forces that urge the workholders 8 radially against spaced-pairs of the disk-idlers 5. Tension in the wire 4 is provided by a wire tensioning device (not shown) and the wire 4 is also driven by a wire-drive motor 2. Because the workholders 8 are sandwiched between the upper platen 20 and the lower platen 28, the workholders 8 are held in a stable horizontal position and not tilted-up from the flat horizontal surface of the lower platen 28 flat annular surface 27. The workholder 8 flexible drive wire 4 is small in diameter which allows the workholder annular disks 8 to have small workholder 8 disk-thicknesses where the wire 4 diameter size can range from less than 0.002 inches to greater than 0.100 inches and the workholder disks 8 can have a workholder disk 8 thickness from 0.005 inches to greater than 1.00 inches. Typically the wire 4 material comprises a metal, a metal alloy, polymers, monofilament or stranded fishlines and natural materials comprising cotton, silk or other fibers, and the wire 4 may be comprised of a single strand or of woven strands that are joined together to form a continuous wire 4 loop. An example of high-strength, small-diameter wires that are capable of high tensions and good fatigue life is a wire 4 category that is referred to as music wire. The diameters of the disk-idlers 5 are sufficiently large to minimize the fatigue life of the wire 4 as it is routed and driven around the disk-idlers 5, wire-idlers 6, a drive motor 2 motor pulley 3 and the workholders 8. These small diameter flexible drive-wires 4 can be easily butt-welded together to form high-strength joints using induction heating and axial compression of the two wire 4 ends (not shown) together. After butt-welding the wire 4, the welded joint (not shown) is abraded to provide a uniform wire 4 diameter across the weld-joint area. The annular workholders 8 can be driven at very high speeds by the drive wire 4 and the workholders 8 can be driven in both clockwise and counterclockwise directions at selected speeds by changing the direction of rotation of the wire 4 drive motor 2 that is operated at various rotational speeds. Though not preferred, the wire 4 may comprise a long length of a wire 4 material that is moved in one direction for a period of time, and then in an opposed direction for another period of time, where this wire 4 direction-reversing process is repeated.

Figure 2:
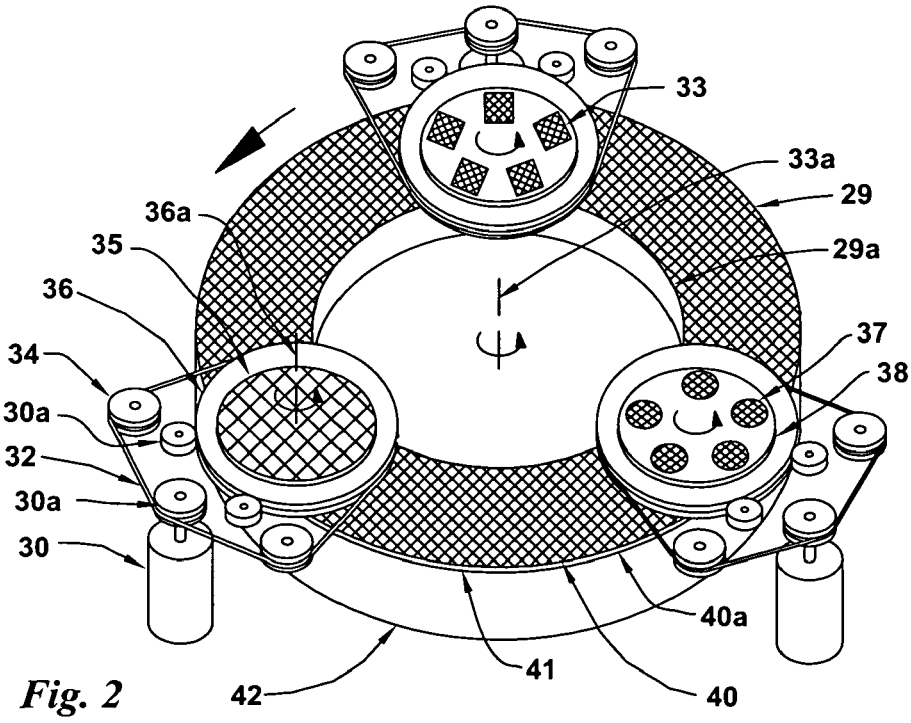
FIG. 2 is an isometric view of wire-driven workholders on a lower abrasive platen.

FIG. 2 is an isometric view of wire-driven workholders on a lower abrasive platen of a single-sided or double-sided abrading system. The abrading system 29 has three-point fixed-position rotating workholders 36 that support a floating rotating abrasive platen (not shown). Flexible abrasive disks 40 having annular bands 41 of abrasive are attached to the bottom platen 42 that each has a precision-flat annular surface 40*a* where the flexible flat abrasive disk 40 conforms to the platen 42 flat annular surface 40*a*. The abrasive disks 40 can have a continuous disk backing (not shown) or the annular abrasive disks 40 can have center hole 29*a*. Flat-surfaced workpieces 35 are contained in annular workholders 36 where the workpieces 35 are in abrading contact with both the upper platen (not shown) abrasive disk (not shown) and also the lower platen 42 abrasive disk 40. There are three workholders 36 that are equally-spaced around the circumference of the lower platen 42 flat annular surface 40*a*. The upper flat surfaces of the three equal-thickness and equal-sized workpieces 35 provide three-point support for the floating upper platen as the workpieces 35 are also in flat contact with the lower platen 42 abrasive disk 40. The workholders 36 centers of rotation 36*a* are located at the circumferential center (not shown) of the lower platen 42 flat annular surface 40*a*. The upper floating platen flat annular surface and the lower rigidly-mounted rotating platen 42 flat annular surface 40*a* are concentric with each other. Also, both the upper floating platen and the lower rigidly mounted platen 42 are independently rotated in both clockwise and counterclockwise rotation directions. The lower platen 42 rotates about an axis 33*a*. Both the rotating upper floating platen abrasive disk and the lower rigidly mounted platen 42 abrasive disk 40 simultaneously abrade both opposed flat surfaces of the workpieces 35 where the workpieces 35 abrading pressure is applied by a controlled force (not shown) that is applied to the upper floating platen. Smaller-sized workpieces 37 are shown here as an option-substitute for the large-sized workpieces 35 at one of the three workholders 36 even though workpieces 35 having equal sizes would typically be abraded at all three workholders 36 in an abrading operation. The upper floating platen is rotated by a spherical-action device (not shown) that has a drive shaft (not shown) where the spherical-action device restrains the upper platen in a upper platen flat annular surface annular radial direction. The abrading force is evenly distributed to the three workpieces 35 because the three workholders 36 are equally spaced around the circumference of the lower platen 42 with the result that the abrading pressure on each of the workpieces 35 is equal for all of the equal-sized (only) workpieces 35.

The workholders 36 are rotated by a drive-wire 32 that is contained in a wire-groove 55 that surrounds the outer circumference of the workholders 36. The workholders 36 are restrained in a radial direction of the lower platen 42 flat annular surface 40*a* by contact of the annular disk type workholders 36 with the wire-idlers 32 where the force-tensioned wire 34 applies forces that urge the workholders 36 radially against spaced-pairs of the disk-idlers 33*a*. Tension in the wire 32 is provided by a wire tensioning device (not shown). When desired, the wire 32 tension can be adjusted by adjusting the wire tensioning device to prevent tilting of the workholders 36 when the workpieces 35 and 37 are loaded into or removed from the workholders 36 when the workpieces 35 and 37 are not contacted by the upper floating platen abrasive surface.

The wire 32 is driven by a wire-drive motor 30 that has a wire drive pulley 30*a* and the drive pulley 30*a* can be constructed to allow the wire 32 to have multiple wraps around the pulley 30*a* to provide increased drive friction between the wire 32 and the pulley 30*a*.

Large diameter workpieces 35 comprising 300 mm (12 inch) diameter semiconductor wafers can be mounted in a workholder 36 or multiple small workpieces 33 or 37 can be mounted in a workholder 36.

Figure 3:
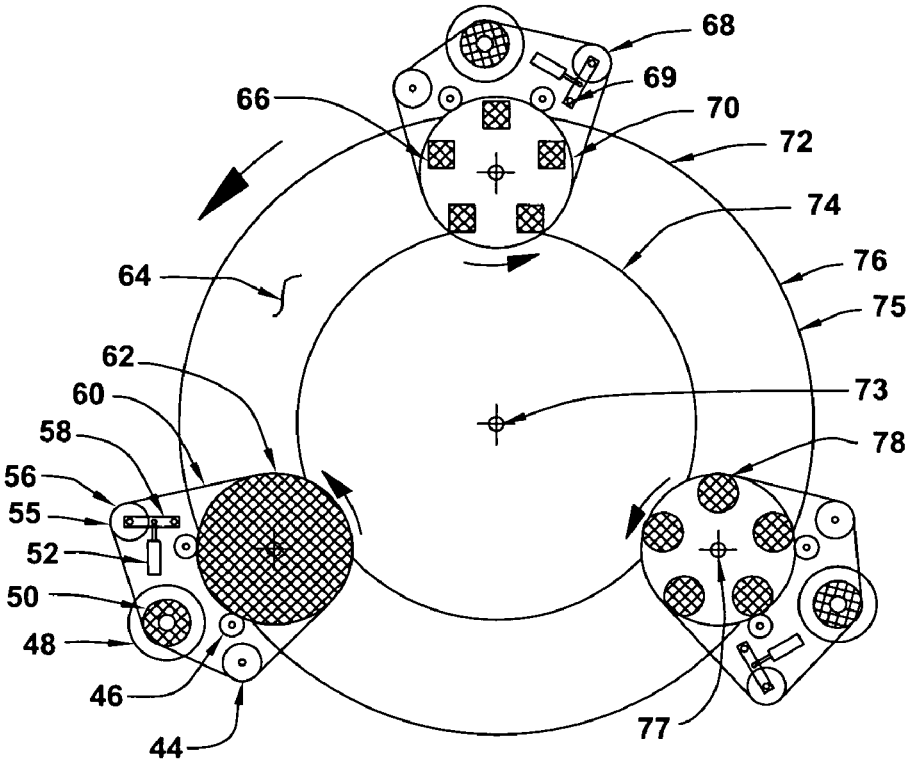
FIG. 3 is a top view of wire-driven workholders with a platen-center workholder disk.

FIG. 3 is a top view of wire-driven workholders on a lower abrasive platen of a double-sided abrading system. The abrading system 72 has three-point fixed-position rotating workholders 70 that support a floating rotating abrasive platen (not shown). Flexible abrasive disks 75 having annular bands of abrasive are attached to the bottom platen 76 that has a precision-flat annular surface 64 where the flexible flat abrasive disk 75 conforms to the platen 76 flat annular surface 64. The abrasive disk 75 has a center hole 74. Flat-surfaced workpieces 62, 66 and 78 are contained in annular workholders 70 where the workpieces 62, 66 and 78 are in abrading contact with both the upper platen (not shown) abrasive disk (not shown) and also the lower platen 76 abrasive disk 75. There are three workholders 70 that are equally-spaced around the circumference of the lower platen 76 flat annular surface 64. The upper flat surfaces of the three equal-thickness and equal-sized workpieces 62, 66 and 78 provide three-point support for the floating upper platen as the workpieces 62, 66 and 78 are also in flat contact with the lower platen 76 abrasive disk 75. The workholders 70 centers of rotation 77 are located at the circumferential center (not shown) of the lower platen 76 flat annular surface 64. The upper floating platen flat annular surface and the lower rigidly-mounted rotating platen 76 flat annular surface 64 are concentric with each other. Also, both the upper floating platen and the lower rigidly mounted platen 76 are independently rotated in both rotation directions. The lower platen 76 rotates about an axis 73. Both the rotating upper floating platen abrasive disk and the lower rigidly mounted platen 76 abrasive disk 75 simultaneously abrade both opposed flat surfaces of the workpieces 62, 66 and 78 where the workpieces 62, 66 and 78 abrading pressure is applied by a controlled force (not shown) that is applied to the upper floating platen. Smaller-sized workpieces 70 and 78 are shown here as an option-substitute for the large-sized workpieces 62 at one of the three workholders 70 even though workpieces 62 having equal sizes would typically be abraded at all three workholders 70 in an abrading operation. The upper floating platen is rotated by a spherical-action device (not shown) that has a drive shaft (not shown) where the spherical-action device restrains the upper platen in a upper platen flat annular surface annular radial direction. The abrading force is evenly distributed to the three workpieces 62, 66 and 78 because the three workholders 70 are equally spaced around the circumference of the lower platen 76 with the result that the abrading pressure on each of the workpieces 62, 66 and 78 is equal for all of the equal-sized (only) workpieces 62 or 66 or 78 that are present at all three of the workholders 70.

The workholders 70 are rotated by a drive-wire 60 that is contained in a wire-groove (not shown) that surrounds the outer circumference of the workholders 70. The workholders 70 are restrained in a radial direction of the lower platen 76 flat annular surface 64 by contact of the annular disk type workholders 70 with the workholder disk-idlers 46 where the force-tensioned wire 60 applies forces that urge the workholders 70 radially against spaced-pairs of the workholder disk-idlers 46. Tension in the wire 60 is provided by a wire tensioning device 55 comprised of an air cylinder 52, a pivot arm 58 and an wire 60 idler 56 where the pivot arm 58 rotates about a pivot axis 69 and the force (not shown) provided by the air cylinder 52 urges the idler 56 against the drive-wire 60. The wire 60 is driven by a wire-drive motor 48 that has a wire drive pulley 50 and the drive pulley 50 can be constructed to allow the wire 60 to have multiple wraps (not shown) around the drive pulley 50 to provide increased drive friction between the wire 60 and the pulley 50. Large diameter workpieces 62 comprising 300 mm (12 inch) diameter semiconductor wafers can be mounted in a workholder 70 or multiple small workpieces 66 and 78 of various shapes can be mounted in a workholder 70.

When desired, the wire 60 tension can be adjusted by changing the air pressure to the air cylinder 52 where the wire 60 tension is set at zero or near-zero to prevent tilting of the workholders 70 when the workpieces 62 or 66 or 78 are loaded into or removed from the workholders and the workpieces 62, 66 and 78 are not contacted by the upper floating platen abrasive surface.

The abrading system 72 that has three-point fixed-position rotating workholders 70 can also be used only with a bottom platen 76 where flexible abrasive disks 75 having annular bands of abrasive are attached to the bottom platen 76 that has a precision-flat annular surface 64 where the flexible flat abrasive disk 75 conforms to the platen 76 flat annular surface 64. Here workpieces 62, 66 and 78 are single-sided abraded by abrading contact with the bottom platen 76 flexible abrasive disks 75.

Figure 4:
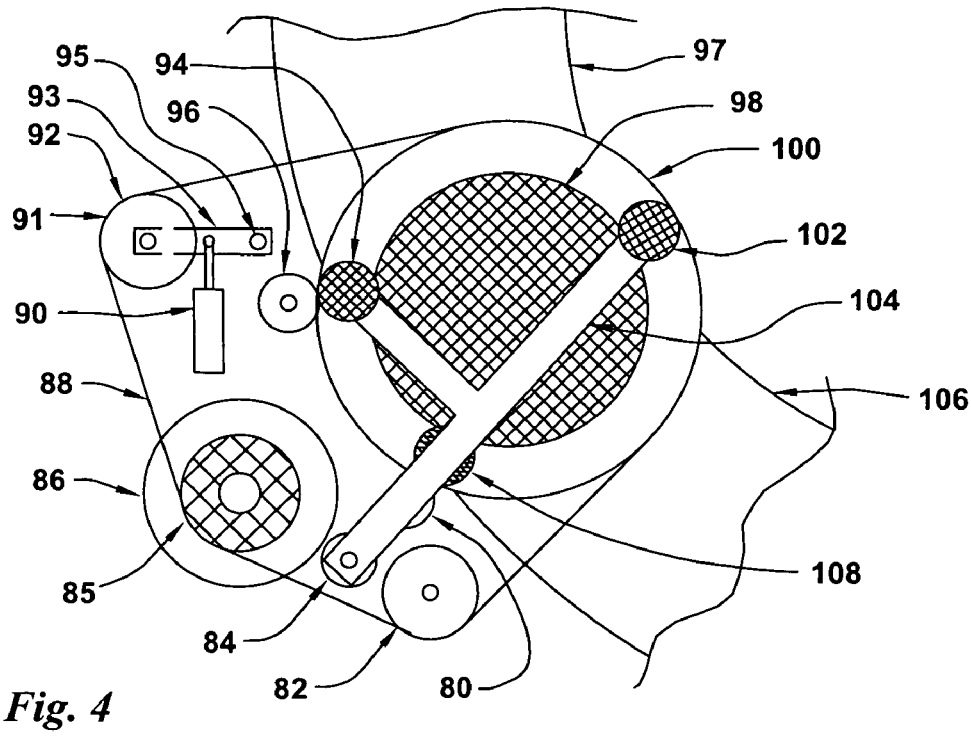
FIG. 4 is a top view of a wire-driven workholder assembly contacting a bottom platen.

FIG. 4 is a top view of a wire-driven workholder assembly contacting a bottom abrading platen. A flexible abrasive disk 97 is attached to the bottom platen 106 and a flat-surfaced workpiece 98 is contained in an annular workholder 100 where the workpiece 98 is in abrading contact with the bottom platen 106 abrasive disk 97. The workholder 100 is rotated by a drive-wire 88 that is contained in a wire-groove (not shown) that surrounds the outer circumference of the workholders 100. The workholders 100 are restrained in a radial direction of the bottom platen 106 by contact of the annular disk type workholders 100 with the workholder disk-idlers 96 and 80 where the force-tensioned wire 88 applies forces that urge the workholder 100 radially against the spaced-pairs of the workholder disk-idlers 96 and 80. Tension in the wire 88 is provided by a wire tensioning device 91 comprised of an air cylinder 90, a pivot arm 93 and wire 88 wire-idlers 82 and 92 where the pivot arm 93 rotates about a pivot axis 95 and the force (not shown) provided by the air cylinder 90 urges the idler 92 against the drive-wire 88. The wire 88 is driven by a wire-drive motor 86 that has a wire drive pulley 85 and the drive pulley 85 can be constructed to allow the wire 88 to have multiple wraps (not shown) around the drive pulley 85 to provide increased drive friction between the wire 88 and the pulley 85. Large diameter workpieces 98 comprising 300 mm (12 inch) diameter semiconductor wafers can be mounted in a workholder 100.

The workholder 100 can be supported by a rotatable workholder pivot-arm 104 that has attached vacuum pads 94, 102 and 108 where the workholder 100 can be attached to the rotatable workholder pivot-arm 104 by applying vacuum to the vacuum pads 94, 102 and 108. The workholder pivot-arm 104 has a pivot device 84.

Figure 5:
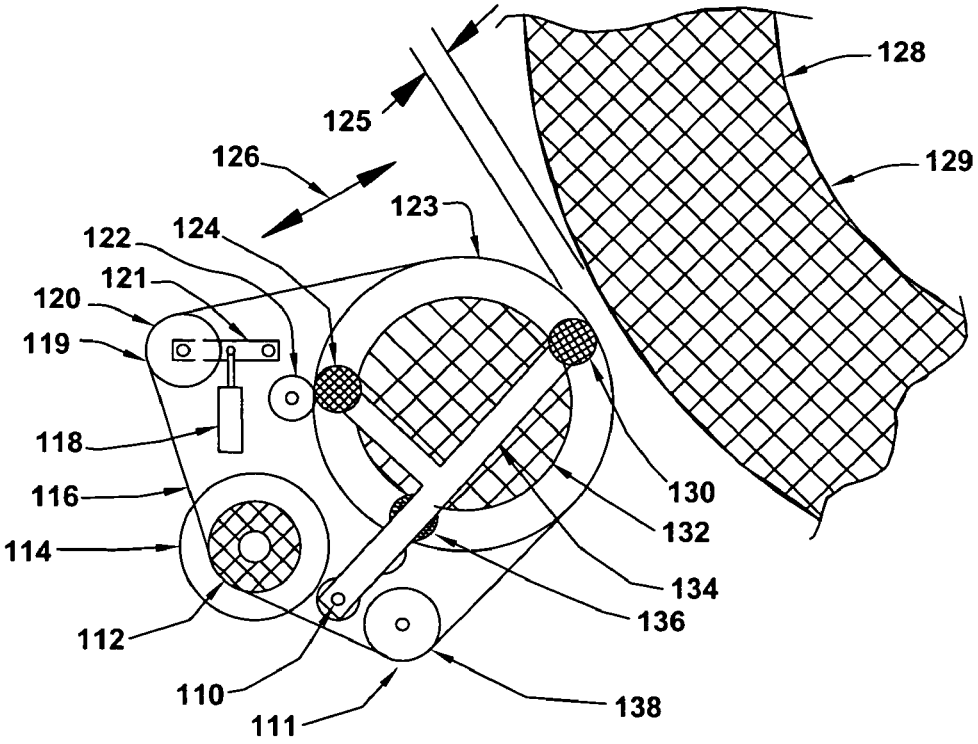
FIG. 5 is a top view of a wire-driven workholder translated from a bottom platen.

FIG. 5 is a top view of a wire-driven workholder translated from a bottom platen. A wire-driven workholder assembly 111 has a flexible abrasive disk 128 that is attached to the bottom platen 129 and a flat-surfaced workpiece 132 is contained in an annular workholder 123 where the workpiece 132 is in abrading contact with the bottom platen 129 abrasive disk 128. The workholder 123 is rotated by a drive-wire 116 that is contained in a wire-groove (not shown) that surrounds the outer circumference of the workholders 123. The workholders 123 are restrained in a radial direction of the bottom platen 129 by contact of the annular disk type workholders 123 with the workholder disk-idlers 122 where the force-tensioned wire 116 applies forces that urge the workholder 123 radially against the spaced-pairs of the workholder disk-idlers 122. Tension in the wire 116 is provided by a wire tensioning device 119 comprised of an air cylinder 118, a pivot arm 121 and wire 116 wire-idlers 120 and 138 where the pivot arm 121 rotates and the force (not shown) provided by the air cylinder 118 urges the idler 120 against the drive-wire 116. The wire 116 is driven by a wire-drive motor 114 that has a wire drive pulley 112 and the drive pulley 112 can be constructed to allow the wire 116 to have multiple wraps (not shown) around the drive pulley 112 to provide increased drive friction between the wire 116 and the pulley 112. Large diameter workpieces 132 comprising 300 mm (12 inch) diameter semiconductor wafers can be mounted in an annular workholder 123.

The annular workholder 123 can be supported by a rotatable workholder pivot-arm 134 that has attached vacuum pads 124, 130 and 136 where the workholder 123 can be attached to the rotatable workholder pivot-arm 134 by applying vacuum to the vacuum pads 124, 130 and 136. The workholder pivot-arm 134 has a pivot device 110. The wire-driven workholder assembly 111 is shown translated radially in a direction 126 away from bottom platen 129 by a gap distance 125 where the flat-surfaced workpiece 132 contained in the annular workholder 123 and the annular workholder 123 are supported by the pivot-arm 134.

Figure 6:
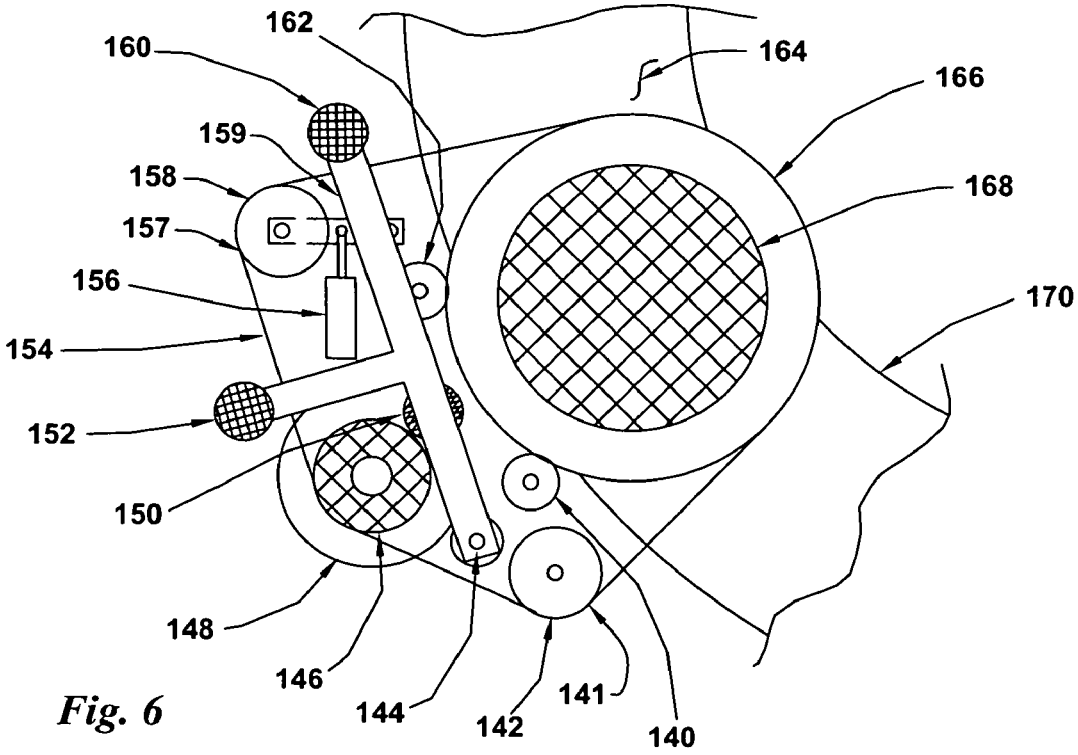
FIG. 6 is a top view of a wire-driven workholder with a rotated workholder pivot-arm.

FIG. 6 is a top view of a wire-driven workholder with a rotated workholder pivot-arm. A wire-driven workholder assembly 141 has a flexible abrasive disk 164 that is attached to the bottom platen 170 and a flat-surfaced workpiece 168 is contained in an annular workholder 166 where the workpiece 168 is in abrading contact with the bottom platen 170 abrasive disk 164. The workholder 166 is rotated by a drive-wire 154 that is contained in a wire-groove (not shown) that surrounds the outer circumference of the workholders 166. The workholders 166 are restrained in a radial direction of the bottom platen 170 by contact of the annular disk type workholders 166 with the workholder disk-idlers 140 and 162 where the force-tensioned wire 154 applies forces that urge the workholder 166 radially against the spaced-pairs of the workholder disk-idlers 140 and 162. Tension in the wire 154 is provided by a wire tensioning device 157 comprised of an air cylinder 156, a pivot arm 159 and wire 154 wire-idlers 158 and 142 where the pivot arm 159 rotates and the force (not shown) provided by the air cylinder 156 urges the idler 158 against the drive-wire 154. The wire 154 is driven by a wire-drive motor 148 that has a wire drive pulley 146 and the drive pulley 146 can be constructed to allow the wire 154 to have multiple wraps (not shown) around the drive pulley 146 to provide increased drive friction between the wire 154 and the pulley 146. Large diameter workpieces 168 comprising 300 mm (12 inch) diameter semiconductor wafers can be mounted in an annular workholder 166.

The annular workholder 166 can be supported by a rotatable workholder pivot-arm 159 that has attached vacuum pads 150, 152 and 160 where the workholder 166 can be attached to the rotatable workholder pivot-arm 159 by applying vacuum to the vacuum pads 150, 152 and 160. The workholder pivot-arm 159 has a pivot device 144 and is shown in a pivot-arm 159 stored position.

Figure 7:
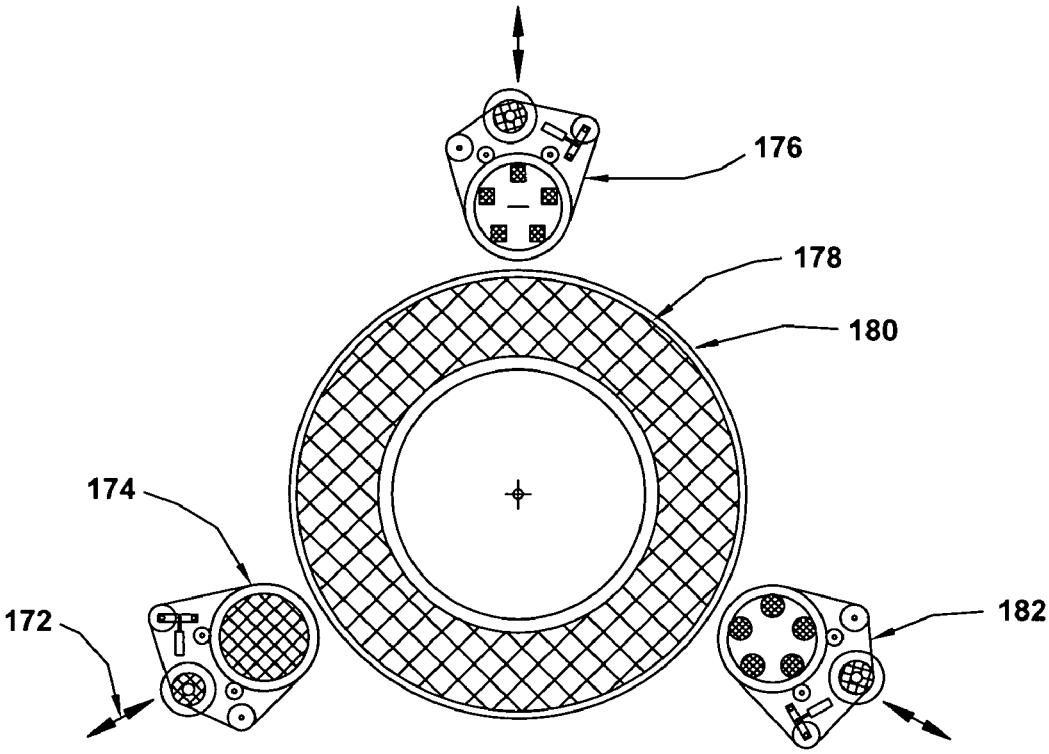
FIG. 7 is a top view of multiple wire-driven workholders translated from a bottom platen.

FIG. 7 is a top view of a multiple wire-driven workholders translated from a bottom platen. Closed-loop flexible wire driven workholders 174, 176 and 182 are shown moved radially in a direction 172 from the circumference of a rotary platen 180 having an attached abrasive disk 178.

Figure 8:
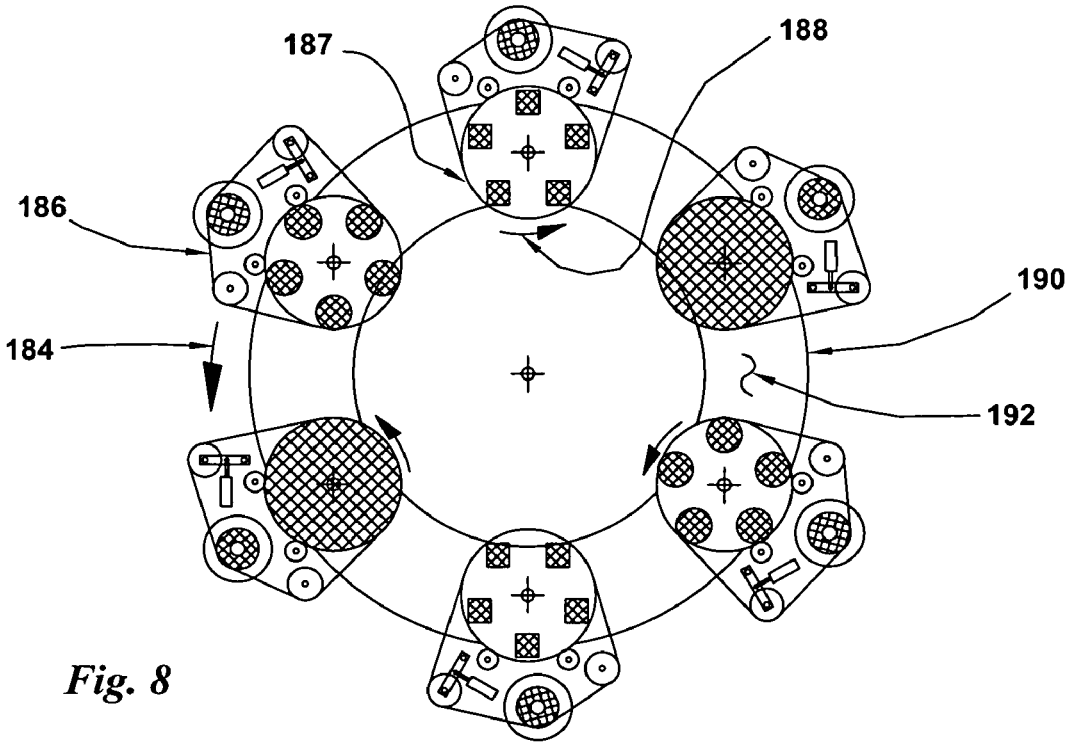
FIG. 8 is a top view of a multiple wire-driven workholders contacting a bottom platen.

FIG. 8 is a top view of a multiple wire-driven workholders contacting a bottom platen. Closed-loop flexible wire 186 driven workholders 187 are shown in abrading contact with a rotary platen 190 having an attached abrasive disk 192 where the platen 190 rotates in a direction 184 when the workholder disk 187 rotates in the direction 188.

Figure 9:
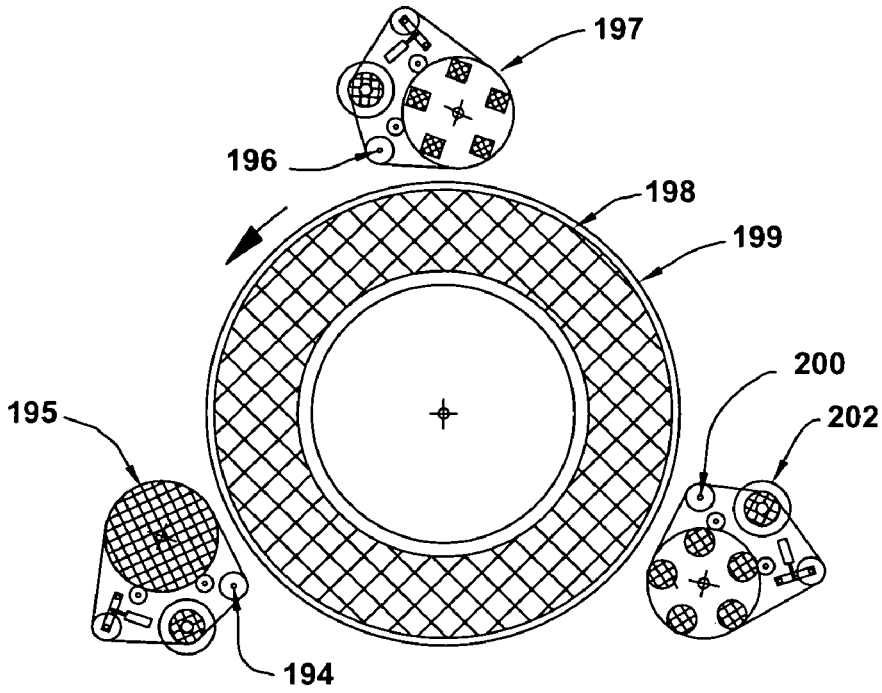
FIG. 9 is a top view of multiple wire-driven workholders rotated from a bottom platen.

FIG. 9 is a top view of multiple wire-driven workholders rotated from a bottom platen. Closed-loop flexible wire driven workholder assemblies 197, 197 and 202 are shown rotated away from abrading contact with a rotary platen 199 having an attached abrasive disk 198. The closed-loop flexible wire driven workholder assembly 195 pivots-about the pivot axis 194. The closed-loop flexible wire driven workholder assembly 197 pivots-about the pivot axis 196. The closed-loop flexible wire driven workholder assembly 202 pivots-about the pivot axis 200.

Figure 10:
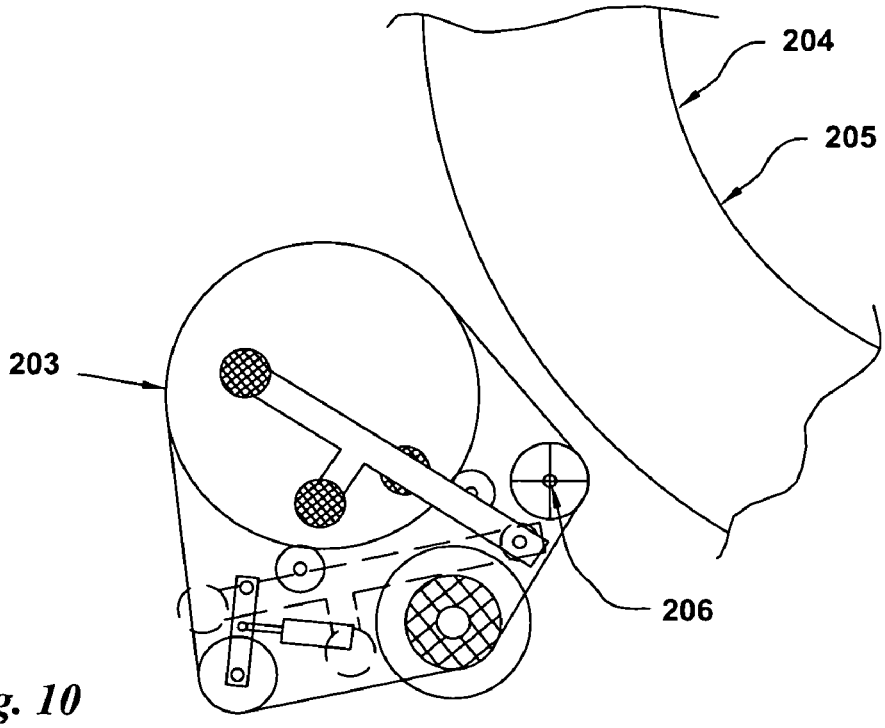
FIG. 10 is a top view of a wire-driven workholders rotated from a bottom platen.

FIG. 10 is a top view of a wire-driven workholders rotated from a bottom platen. The closed-loop flexible wire driven workholder assemblies 203 is shown rotated away from abrading contact with a rotary platen 204 having an attached abrasive disk 205. The closed-loop flexible wire driven workholder assembly 203 pivots-about the pivot axis 206.

Figure 11:
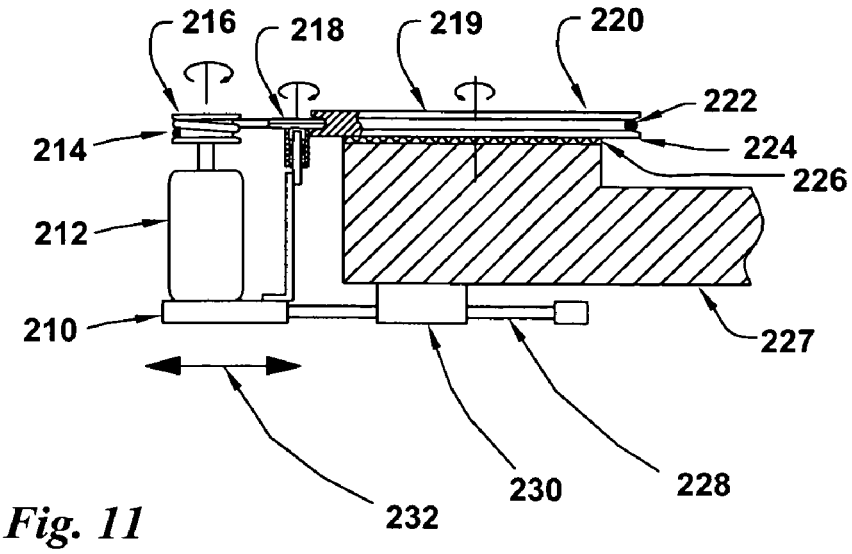
FIG. 11 is a cross section view of a wire-driven workholder contacting a bottom platen.

FIG. 11 is a cross section view of a circular wire-driven workholder disk contacting a bottom platen. A wire-driven circular workholder 220 having flanges 224 that form a groove 219 on the workholder 220 outer periphery allows a flexible drive-wire 222 to be captured in the groove 219 between the flanges 224. The drive wire 222 is routed around a wire drive motor 212 pulley 216 where the drive wire 222 forms a double-layer 214 around the pulley 216. Rotatable workholder disk idlers 218 (one not shown) have curved or straight-edge knife-like circumferences that engage the workholder 220 groove 219 where the motor 212 and the disk idlers 218 are mounted on a slide frame 210 that is supported by a linear slide-bearing block 230 that allows the slide arms 228 and the slide frame 210 to translate in a platen 227-radial translation direction 232. The workholder 220 contacts an abrasive coating 226 that is attached to the rotatable lower platen 227. The assembly consisting of the motor 212, the workholder 220, the disk idlers 218, the motor pulley 216 and the flexible drive wire 222 can be translated away from and back to the lower platen 227.

Figure 12:
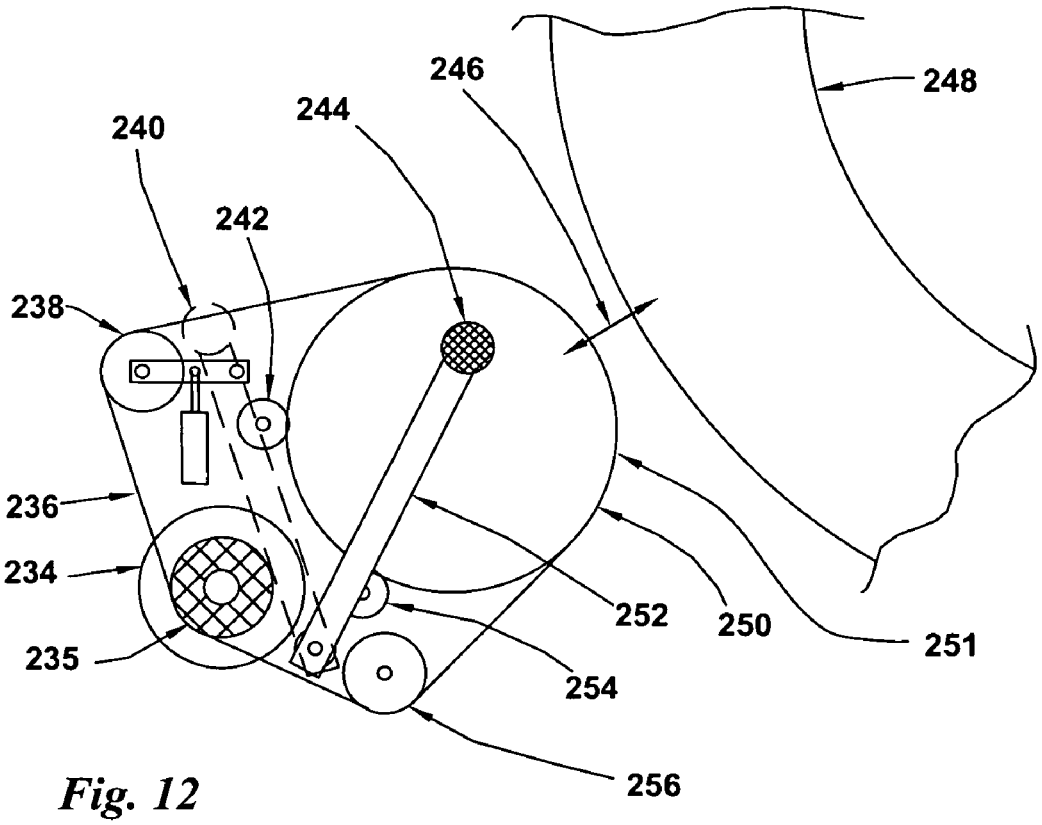
FIG. 12 is a top view of a wire-driven workholder with a rotated workholder pivot-arm.

FIG. 12 is a top view of a wire-driven workholder with a rotated workholder pivot-arm. A circular wire-driven workholder disk assembly 251 is shown translating in a platen 248 radial direction 246 where the workholder disk 250 is supported by a vacuum or other type of workholder-attachment pad 244 that is attached to a rotatable swing-arm 252. The rotatable swing-arm 252 can be swung into a rest-position indicated where the vacuum pad 244 is in the position 240. The workholder 250 is supported and restrained by two or more workholder disk-idlers 242 and 254 where the workholder 250 is urged against the disk-idlers 242 and 254 by the flexible drive-wire 236 that is routed around wire 236 wire-guide idlers 238 and 256 and also, the wire 236 is routed around the wire-drive motor 234 wire pulley 235.

Figure 13:
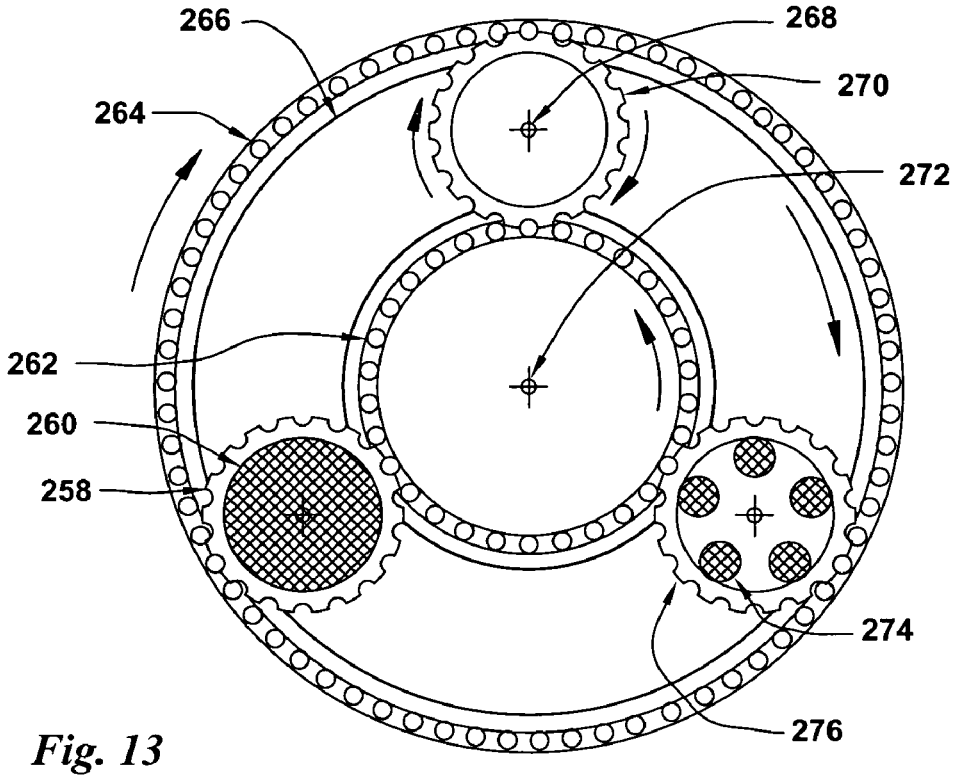
Fig. 13 Prior Art
FIG. 13 is a top view of a prior art pin-gear driven planetary workholders on a lower platen.

FIG. 13 is a top view of prior art pin-gear driven planetary workholders and workpieces on an abrasive platen. A rotating annular abrasive coated platen 266 and three planetary workholder disks, 270, 276 and 258 that are driven by a platen 266 outer periphery pin-gear 264 and a platen 266 inner periphery pin-gear 262 are shown. Typically the outer periphery pin-gear 264 and the inner periphery pin-gear 262 are driven in opposite directions where the three planetary workholder disks 270, 276 and 258 rotate about a workholder rotation axis 268 but maintain a stationary position relative to the platen 266 rotation axis 272 or they slowly rotate about the platen 266 rotation axis 272 as the platen 266 rotates about the platen rotation axis 272. The outer pin-gears 264 and the inner pin-gears 262 rotate independently in either rotation direction and at different rotation speeds to provide different rotation speeds of the workholder disks 270, 276 and 258 about the workholder rotation axes 268 and also to provide different rotation directions and speeds of the workholders disks 270, 276 and 258 about the platen 266 rotation axis 272. A single individual large-diameter flat-surfaced workpiece 260 is positioned inside the rotating workholder 258 and multiple small-diameter flat-surfaced workpieces 274 are positioned inside the rotating workholder 276. The workholder 270 does not contain a workpiece.

Figure 14:
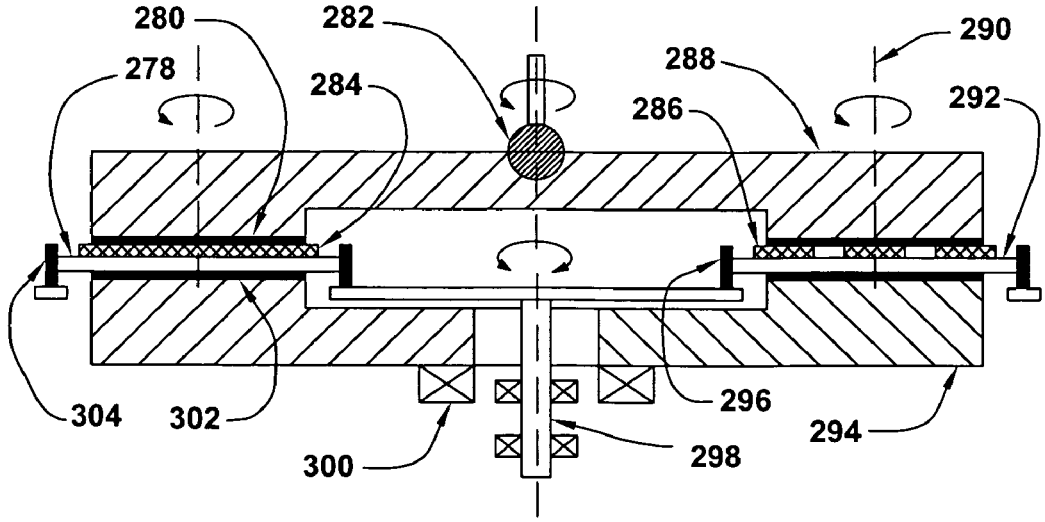
Fig. 14 Prior Art
FIG. 14 is a cross section view of a prior art pin-gear driven planetary workholders on a double-sided abrasive system.

FIG. 14 is a cross section view of prior art planetary workholders, workpieces and a double-sided abrasive platen. The abrading surface 280 of a rotating upper floating platen 288 and the abrading surface 302 of a rotating lower rigid platen 294 are in abrading contact with flat-surfaced workpieces 284 and 286. A planetary workholder 278 contains a single large-sized workpiece 284 and the planetary workholder 292 contains multiple small-sized workpieces 286. The planetary flat-surfaced workholder disks 278 and 292 rotate about workholder axes 290 and the workholder disks 278 and 292 are driven by outer periphery pin-gears 304 and inner periphery pin-gears 296. The inner periphery pin-gears 296 are mounted on a rotary drive spindle that has a spindle shaft 298. The rigid-mounted lower platen 294 is supported by platen bearings 300. The floating upper platen 288 is driven by a spherical rotation device 282 that allows the floating platen 288 to be conformably supported by the equal-thickness workpieces 284 and 286 that are supported by the lower rigid platen 294.

Figure 15:
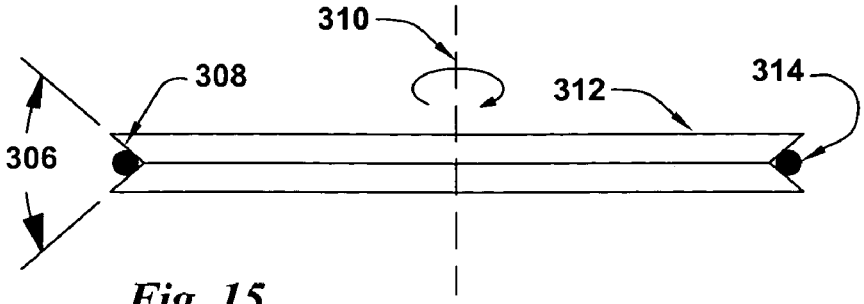
FIG. 15 is a cross section view of a wire-driven workholder with a wide-angle edge.

FIG. 15 is a cross section view of a wire-driven workholder with a wide-angle edge. A flat-surfaced circular workholder disk 312 has an angled groove 308 that has an included angle 306 around the circumference of the workholder 312 where a flexible drive-wire 314 is shown in the workholder 312 groove 308. The workholder 312 can rotate about a rotation axis 310 that is located at the center of the workholder disk 312.

Figure 16:
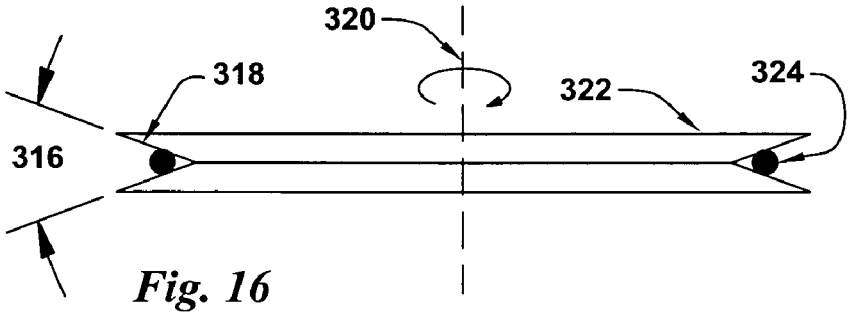
FIG. 16 is a cross section view of a wire-driven workholder with a shallow-angle edge.

FIG. 16 is a cross section view of a wire-driven workholder with a shallow-angle edge. A flat-surfaced circular workholder disk 322 has an angled groove 318 that has an included shallow-angle 316 around the circumference of the workholder 322 where a flexible drive-wire 324 is shown in the workholder 322 groove 318. The workholder 322 can rotate about a rotation axis 320 that is located at the center of the workholder disk 322. The circular workholder disk 322 angled groove 318 has a shallow included angle 316 that acts to wedge the drive-wire 324 that is routed around the workholder 322 to increase the friction between the drive-wire 324 and the workholder 322.

Figure 17:
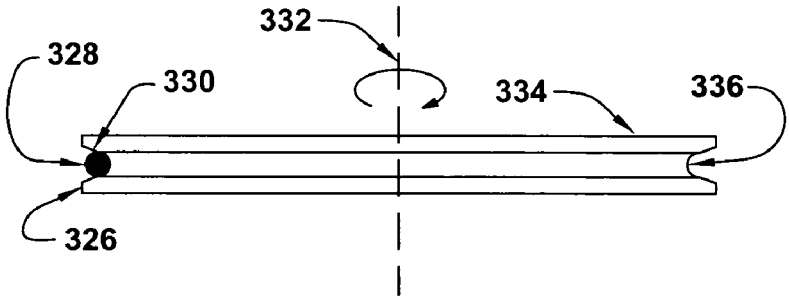
FIG. 17 is a cross section view of a wire-driven workholder with a round wire-track and blunt circumference edge.

FIG. 17 is a cross section view of a wire-driven workholder with a round wire-track and blunt circumference edge. A flat-surfaced circular workholder disk 334 has a curve-shaped groove 336 that has an angled edge 330 and a blunt workholder face 326 around the circumference of the workholder 334 where a flexible drive-wire 328 is shown in the workholder 334 groove 336. The workholder 312 can rotate about a rotation axis 310 that is located at the center of the workholder disk 312. The blunt workholder face 326 around the circumference of the workholder 334 allows the workholder 334 to be operated in rolling contact with workholder positioning-idlers (not shown).

Figure 18:
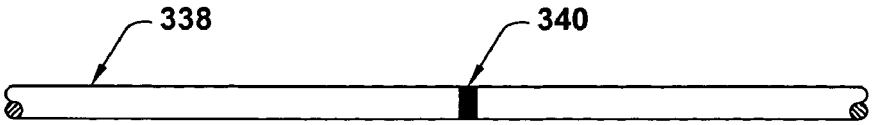
FIG. 18 is a side view of a butt-welded drive wire loop for a planetary workholder.

FIG. 18 is a side view of a butt-welded drive wire loop for a planetary workholder. A cylindrical shaped flexible metal drive-wire 338 is shown with a butt-weld 340 where two free ends of the wire 338 are urged together when an electrical current is passed from one free end to the other to effect a butt-weld 340 of the wire 338. and form a continuous-loop drive-wire 338. The drive-wire 338 material is selected where the weld can be made, after which the butt-weld 340 is then cooled properly to create a high strength butt-weld 340 joint, after which the butt-weld 340 is abraded and polished to achieve a uniform cylindrical shape of the butt-weld 340 drive-wire 338.

Figure 19:
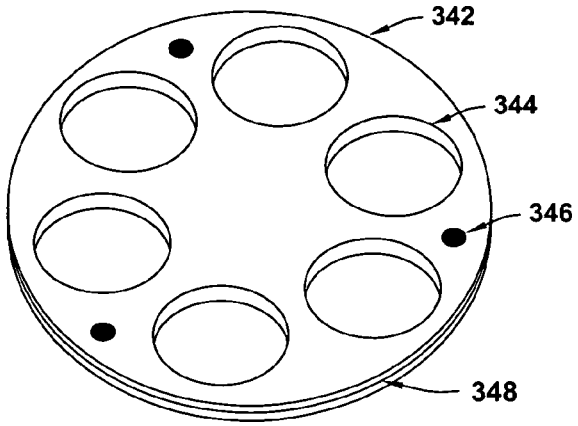
FIG. 19 is an isometric view of a workholder with color-coded wear indicators.

FIG. 19 is an isometric view of a workholder with color-coded wear indicators. A workholder 342 has open workpiece receptacle holes 344 and a flexible drive-wire groove 348 that extends around the circumference of the circular workholder 342. The circular flat-surfaced disk 342 also has color-coded wear-buttons 346 that extend through the thickness of the workholder 342 where the changes in the color of the wear-buttons 346 indicate the wear-condition of the workholder disk 342 where the wear-button 346 color changes as the workholder disk 342 wears down. Other types of wear-down indicator materials can be used to construct the wear-buttons 346 where the wear-condition of the workholder disk 342 is indicated by visual examination or electronic-sensor devices (not shown) examination of the wear-buttons 346.

Figure 20:
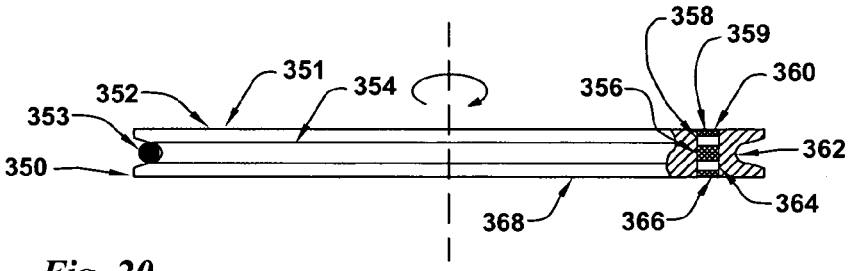
FIG. 20 is a cross section view of a workholder with color-coded wear indicators.

FIG. 20 is a cross section view of a workholder with color-coded wear indicators. A workholder 352 has a flexible drive-wire 353 curve-shaped groove 362 containing a flexible drive-wire 353 and having a groove 362 edge 354 that extends around the circumference of the circular workholder 352. The circular flat-surfaced disk 352 also has color-coded wear-buttons 360 that extend through the thickness of the workholder 352 where the changes in the color of the wear-buttons 360 indicate the wear-condition of the workholder disk 352 where the wear-button 360 color changes as the workholder disk 352 wears down. Other types of wear-down indicator materials can be used to construct the wear-buttons 360 where the wear-condition of the workholder disk 352 is indicated by visual examination or electronic-sensor devices (not shown) examination of the wear-buttons 360. The wear-button 360 has a surface color 359 that coincides with the flat surface 351 of the workholder 352, a color 366 that coincides with the surface 368, and an internal-color 358 and a third far-internal-color 356 where each color indicates greater wear-down of the top surface 351 and/or the bottom surface 368 of the workholder 352. The workholder 352 has a flat-surface 350 outer periphery.

Figure 21:
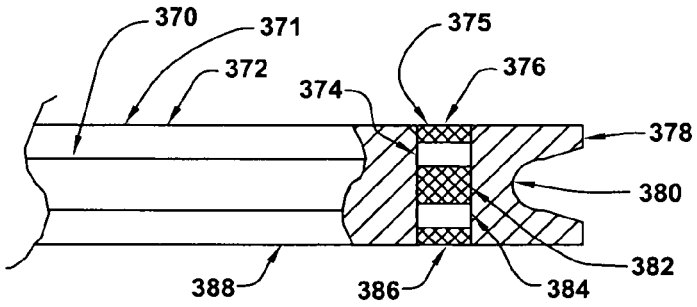
FIG. 21 is a cross section view of a workholder with a multiple-color coded wear indicator.

FIG. 21 is a cross section view of a workholder with a multiple-color coded wear indicator. A workholder 372 has a flexible drive-wire curve-shaped groove 380 containing a flexible drive-wire 353 and having a groove 380 edge 370 that extends around the circumference of the circular workholder 372. The circular flat-surfaced disk 372 also has color-coded wear-buttons 376 that extend through the thickness of the workholder 372 where the changes in the color of the wear-buttons 376 indicate the wear-condition of the workholder disk 372 where the wear-button 376 color changes as the workholder disk 372 wears down. Other types of wear-down indicator materials can be used to construct the wear-buttons 376 where the wear-condition of the workholder disk 372 is indicated by visual examination or electronic-sensor devices (not shown) examination of the wear-buttons 376. The wear-button 376 has a surface color 375 that coincides with the flat surface 371 of the workholder 372, a surface color 386 that coincides with the flat surface 388 of the workholder 372, and internal-colors 374 and 384 and a third far-internal-color 382 where each color indicates greater wear-down of the top surface 371 and/or the bottom surface 388 of the workholder 372.

Figure 22:
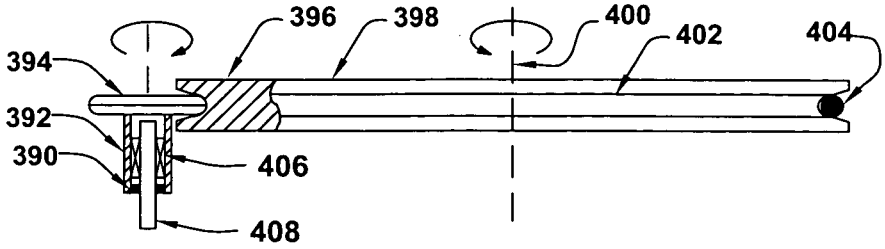
FIG. 22 is a cross section view of a planetary workholder with workholder position idlers.

FIG. 22 is a cross section view of a planetary workholder with workholder position idlers. A workholder disk 398 has a flat top surface 396 and a drive-wire groove 402 that contains a flexible drive-wire 404 that is used to rotate the workholder 398 about a workholder rotation axis 400. A workholder 398 position-idler 394 contacts the workholder groove 402 as shown where the position-idler 394 has a idler-housing 392 that contains a rotatable idler shaft bearing 406 that supports a workholder 398 position-idler shaft 408 that is attached to a frame (not shown). A shaft seal 390 prevents abrasive debris (not shown) from contacting the rotatable shaft bearing 406.

Figure 23:
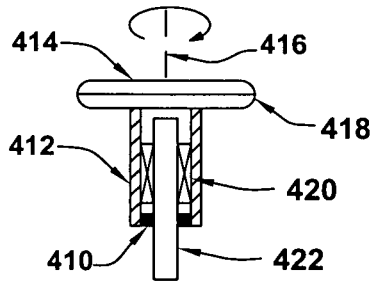
FIG. 23 is a cross section view of a planetary workholder position idler.

FIG. 23 is a cross section view of a planetary workholder position idler. A workholder disk (not shown) circular position-idler 414 has a curved-edge outer periphery 418 where the position-idler 414 has a idler-housing 412 that contains a rotatable idler shaft bearing 420 that supports a workholder position-idler shaft 422 that is attached to a frame (not shown). A shaft seal 410 prevents abrasive debris (not shown) from contacting the rotatable shaft bearing 420. The workholder disk position-idler 414 rotates about a position-idler 414 rotation-axis 416.

Figure 24:
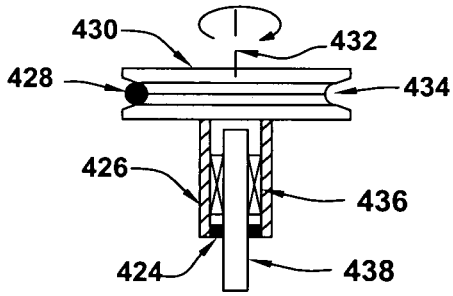
FIG. 24 is a cross section view of a planetary workholder wire-drive idler.

FIG. 24 is a cross section view of a planetary workholder wire-drive idler. A workholder disk (not shown) circular wire-guide idler 430 has a curved-groove 434 on its periphery that contains and guides a flexible drive-wire 428. The wire-guide idler 430 has a idler-housing 426 that contains a rotatable idler shaft bearing 436 that supports a workholder position-idler shaft 438 that is attached to a frame (not shown). A shaft seal 424 prevents abrasive debris (not shown) from contacting the rotatable shaft bearing 436. The workholder disk wire-guide idler 430 rotates about a wire-guide idler 430 rotation-axis 432.

Figure 25:
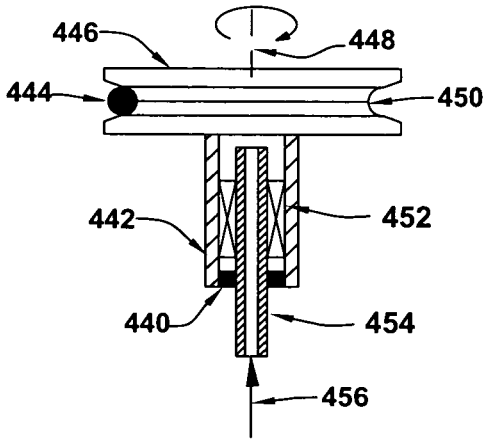
FIG. 25 is a cross section view of an air-purged planetary workholder wire-drive idler.

FIG. 25 is a cross section view of an air-purged planetary workholder wire-drive idler. A workholder disk (not shown) circular wire-guide idler 446 has a curved-groove 450 on its circular periphery that contains and guides a flexible drive-wire 444. The wire-guide idler 446 has a idler-housing 442 that contains a rotatable idler shaft bearing 452 that supports a hollow workholder position-idler shaft 454 that is attached to a frame (not shown). A shaft seal 440 prevents abrasive debris (not shown) from contacting the rotatable shaft bearing 452. The workholder disk wire-guide idler 446 rotates about a wire-guide idler 446 rotation-axis 448. Pressurized air or other fluids (not shown) can be injected in the hollow shaft 454 port entrance 456 to prevent abrasive debris (not shown) from contacting the rotatable shaft bearing 452.

Figure 26:
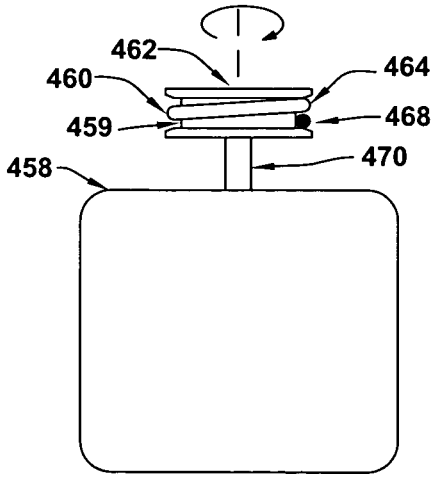
FIG. 26 is a cross section view of a wire-wrapped drive motor pulley.

FIG. 26 is a cross section view of a wire-wrapped drive motor and pulley. A rotary wire drive motor 458 has a rotatable drive shaft 470 that has an attached rotatable drive-wire pulley 462 that has a pulley groove 459 where the flexible drive-wire 460 is wrapped around the motor pulley 462 groove 459 where the flexible drive-wire is also shown as two separated drive-wire segments 464 and 468.

Figure 27:
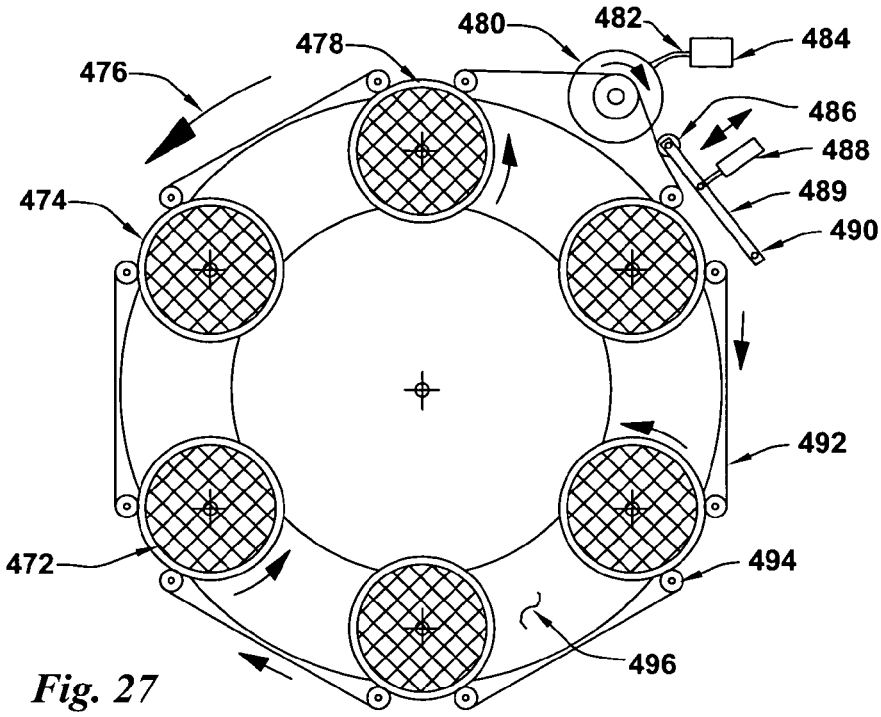
FIG. 27 is a top view of multiple planetary workholders with workholder position idlers.

FIG. 27 is a top view of multiple planetary workholders with workholder position idlers. A single-sided or double-sided abrading machine 478 that has multiple workholder disks 474 that contain workpieces 472 is shown where the flat-surfaced workpieces 472 are in abrading contact with an abrasive covered rotatable bottom platen 496 where an upper rotatable abrading platen is not shown. The bottom platen is rotated in the direction 476 and the circular flat-surfaced workholder disks 474 are rotated as shown by a flexible drive-wire 492 that is driven by a drive-wire motor 480 that is attached to an electrical wire 482 that is connected to a motor controller 484. The motor controller 484 controls and senses the performance of the motor 480 to determine the torque of the motor that is required to maintain a set motor rotational speed and thereby sense the state of abrasive-completion of the workpieces 472 where the motor 480 torque increases as the workpieces 472 become flatter and smoother during the abrading process. The motor controller 484 also torque-limits the force tension that is applied to the flexible drive-wire 492 to prevent damage to the flexible drive wire 492. An adjustable-pressure air cylinder 488 acts upon a pivot arm 489 that has a wire-idler 486 that applies controlled force on the flexible drive-wire 492 to generate the desired wire tension in the drive-wire 492. Other devices such as linear electrical solenoids (not shown) or rotary air-cylinder devices (not shown) can also be used to provide controlled drive-wire 492 wire tension forces. A sensor device (not shown) can also be attached to the pivot-arm 489 that pivots at pivot-point 490 to sense breakage and/or stretching of the drive wire 492. The workholder disks 474 are held in position relative to the bottom platen 496 by workholder disk position-idlers 494 that also act as wire-guide idlers. The flexible drive-wire 492 is a continuous-loop drive wire 492.

Figure 28:
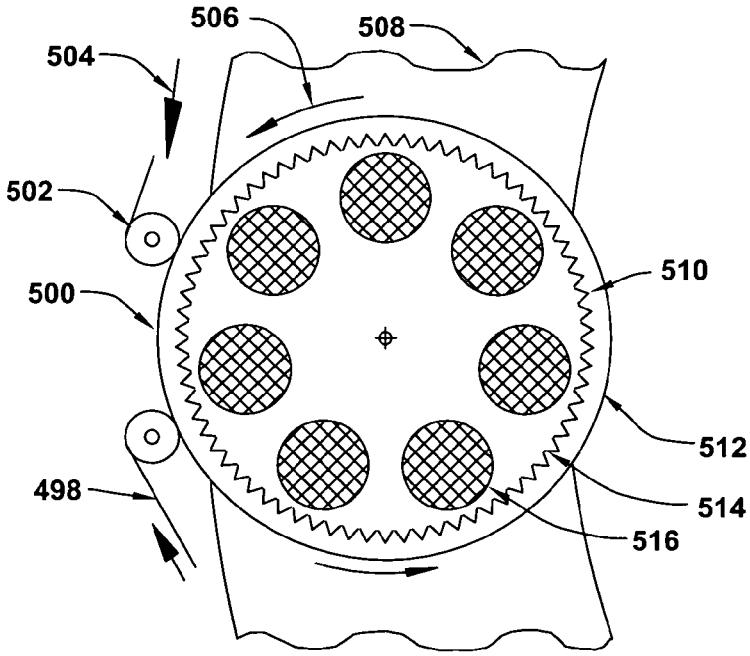
FIG. 28 is a top view of a planetary workholder with workholder position idlers.

FIG. 28 is a top view of a planetary workholder with workholder position idlers. An annular workholder disk 500 is rotated by a flexible drive-wire 498 that is routed around workholder disk-position idlers 502 that are in rolling contact with the workholder disk 500 and where the disk-position idlers 502 also act as wire-guide idlers 502. The drive-wire 498 is routed around the disk-position idlers 502 and around the workholder disk 500 to rotate the annular workholder 500 in a rotation direction 506 while the workholder 500 remains stationary relative to the rotatable abrading platen 508 that rotates in a platen 508 direction 504. The flat-surfaced annular workholder disk 500 has an outer periphery 512 and has an workholder 500 annular shape where the annular inner portion of the annular workholder disk 500 has a tooth-like periphery 510 that engages a workholder 500 inner workholder disk 514 that contains flat-surfaced workpieces 516. The inner workholder disk 514 that contains flat-surfaced workpieces 516 can be separated from the annular workholder 500 that is driven by the drive-wire 498.

Figure 29:
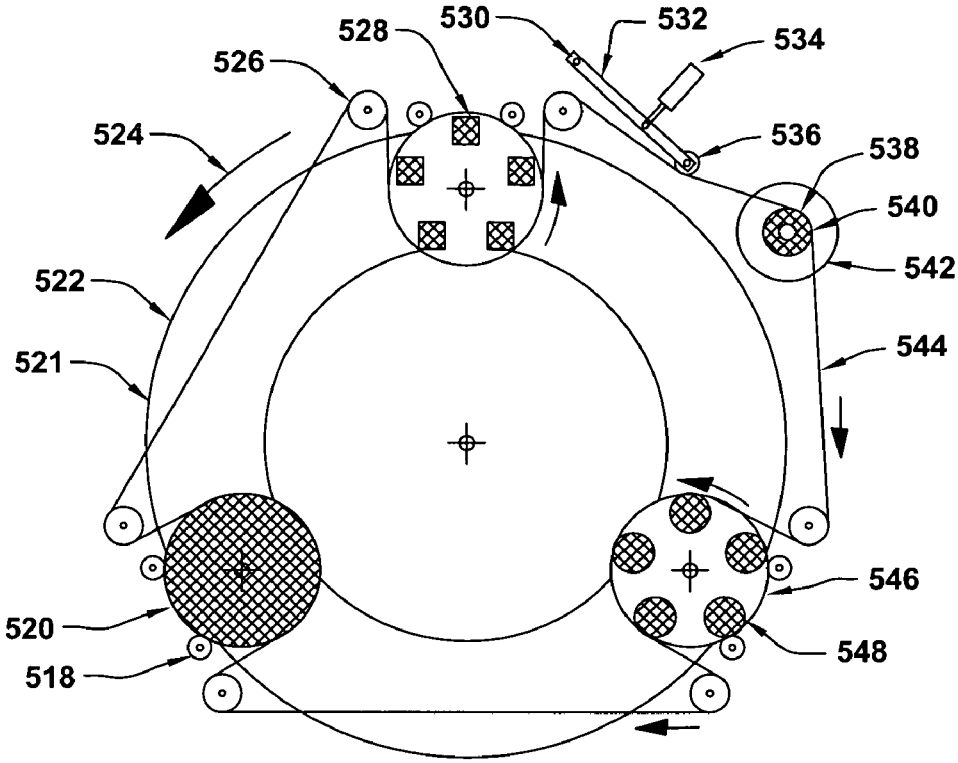
FIG. 29 is a top view of three wire-drive workholder stations for double-side abrading.

FIG. 29 is a top view of three wire-drive workholder stations for double-side abrading where three-point support is provided for an upper floating abrading platen. A single-sided or double-sided abrading machine 521 that has three workholder disks 546 that contain workpieces 520, 528 and 548 is shown where the flat-surfaced workpieces 520, 528 and 548 are in abrading contact with an abrasive covered rotatable bottom platen 522 where an upper rotatable abrading platen is not shown. The bottom platen 522 is rotated in the direction 524 and the circular flat-surfaced workholder disks 546 are rotated as shown by a flexible drive-wire 544 that is driven by a drive-wire motor 542 that has a motor pulley 540 and also a wire-motor-shaft type torque controller device 538. An adjustable-pressure air cylinder 534 acts upon a pivot arm 532 that has a wire-idler 536 that applies controlled force on the flexible drive-wire 544 to generate the desired wire tension in the drive-wire 544. The workholder disks 546 are held in position relative to the bottom platen 522 by workholder disk position-idlers 518 where the force-tensioned drive-wire 544 urges the workholder disks 546 against the disk-position idlers 518. The pivot-arm 532 pivots at pivot-point 530. Wire-guide idlers 526 are used to route the drive-wire 544 to and from the workholder disks 546 and the flexible drive-wire 544 is a continuous-loop drive wire 544.

Figure 30:
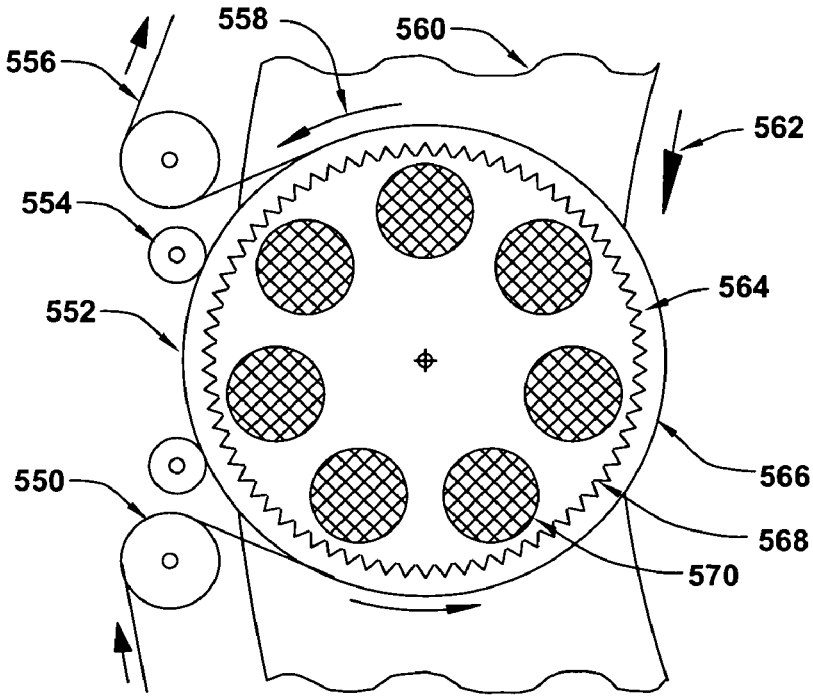
FIG. 30 is a top view of a single wire-drive workholder station for double-side abrading.

FIG. 30 is a top view of a single wire-drive workholder station for single-sided or double-side abrading using independent wire-idlers and disk-position idlers. An annular workholder disk 552 is rotated by a flexible drive-wire 556 that is routed around workholder wire-guide idlers 550 and where the workholder disk 552 is held at a stationary position by rolling contact with disk-position idlers 554. The drive-wire 556 is routed around the wire-guide idlers 550 and around the workholder disk 552 to rotate the annular workholder 552 in a rotation direction 558 while the workholder 552 remains stationary relative to the rotatable abrading platen 560 that rotates in a platen 560 direction 562. The flat-surfaced annular workholder disk 552 has an outer periphery 566 and has a workholder 552 annular shape where the annular inner portion of the annular workholder disk 552 has a tooth-like periphery 564 that engages a workholder 552 inner workholder disk 568 that contains flat-surfaced workpieces 570. The inner workholder disk 568 that contains flat-surfaced workpieces 570 can be separated from the annular workholder 552 that is driven by the drive-wire 556.

Figure 31:
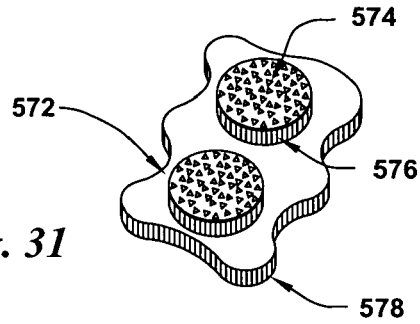
FIG. 31 is an isometric view of fixed-abrasive coated raised islands on an abrasive disk.

FIG. 31 is an isometric view of fixed-abrasive coated raised islands on an abrasive disk. Abrasive particle 574 coated raised islands 576 are attached to an abrasive disk 572 backing 578.

Figure 32:
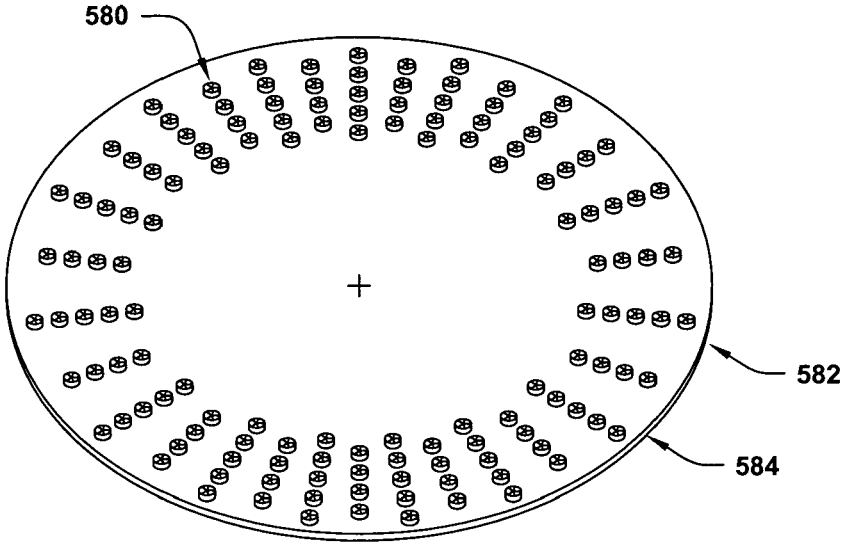
FIG. 32 is an isometric view of a fixed-abrasive coated raised island abrasive disk.

FIG. 32 is an isometric view of a flexible fixed-abrasive coated raised island abrasive disk. Abrasive particle coated raised islands 580 are attached to an abrasive disk 582 backing 584.

Figure 33:
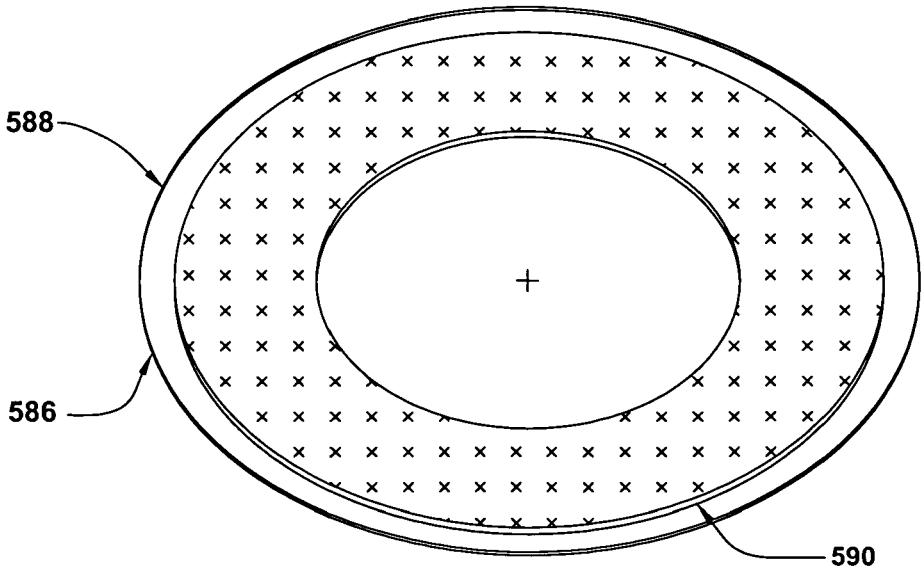
FIG. 33 is an isometric view of a solid-layer fixed-abrasive disk.

FIG. 33 is an isometric view of a flexible fixed-abrasive coated abrasive disk having a thick layer of solid abrasive material attached to the abrasive disk backing. A continuous flat-surfaced annular band of a thick layer of solid abrasive material 590 is attached to the flexible backing 586 of an abrasive disk 588 that can be attached with vacuum or by other mechanical attachment devices (not shown) to a flat-surfaced rotary platen (not shown).

Figure 34:
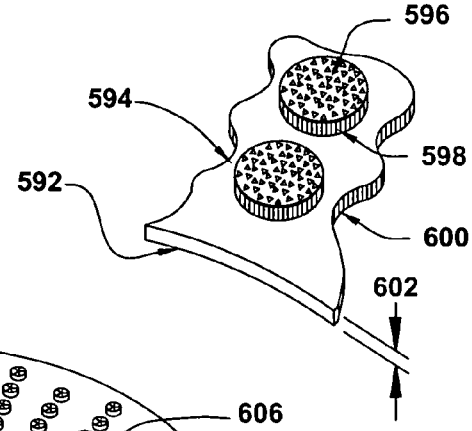
FIG. 34 is an isometric view of fixed-abrasive coated raised islands on an annular disk.

FIG. 34 is an isometric view of fixed-abrasive coated raised islands on a flexible annular abrasive disk that has an open disk center. Abrasive particle 596 coated raised islands 598 are attached to an abrasive disk 594 backing 600 where the annular backing 600 has an abrasive disk 594 inner periphery 592. The backing 600 has a backing thickness 602 that is thick enough to provide sufficient structural strength and support of the annular abrasive disk 594 whereby the disk 594 can be handled without damage to the disk 594 and where the disk 594 can be mounted to the flat annular surface of an abrading platen (not shown) where the disk 594 can be successfully attached to the platen abrasive disk 594 mounting surface with a vacuum attachment system (not shown). The backing 600 has a thickness 602 where the backing 600 is manufactured from a suitable backing material and has a suitable thickness 602 that together provide sufficient abrasive disk 594 strength and durability to resist dynamic abrading forces such that the backing 600 does not rip or tear or crumple when the abrasive disk 594 is subjected to abrading forces and abrading environments including water or water mist or chemicals that are present during the intended use of the abrasive disk 594.

Figure 35:
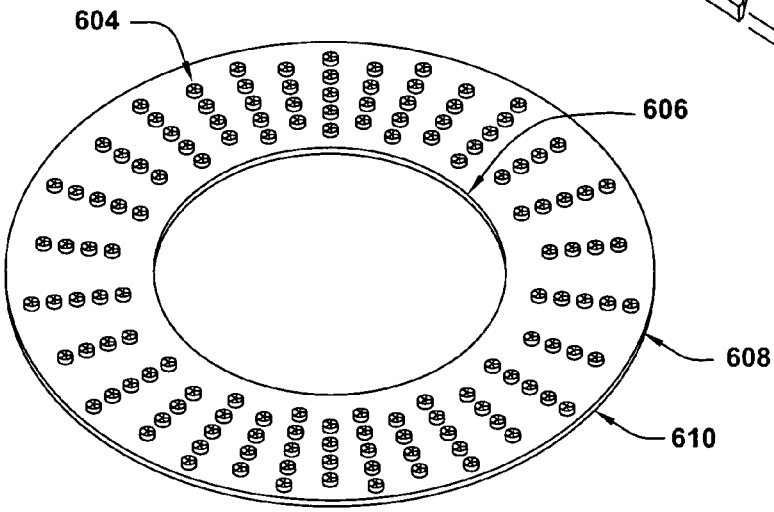
FIG. 35 is an isometric view of a fixed-abrasive coated raised island annular abrasive disk.

FIG. 35 is an isometric view of a fixed-abrasive coated raised island annular abrasive disk. Abrasive particle coated raised islands 604 are attached to an annular abrasive disk 608 backing 610 and where the annular abrasive disk 608 has an open center and also has an open center annular inner radius 606.

Figure 36:
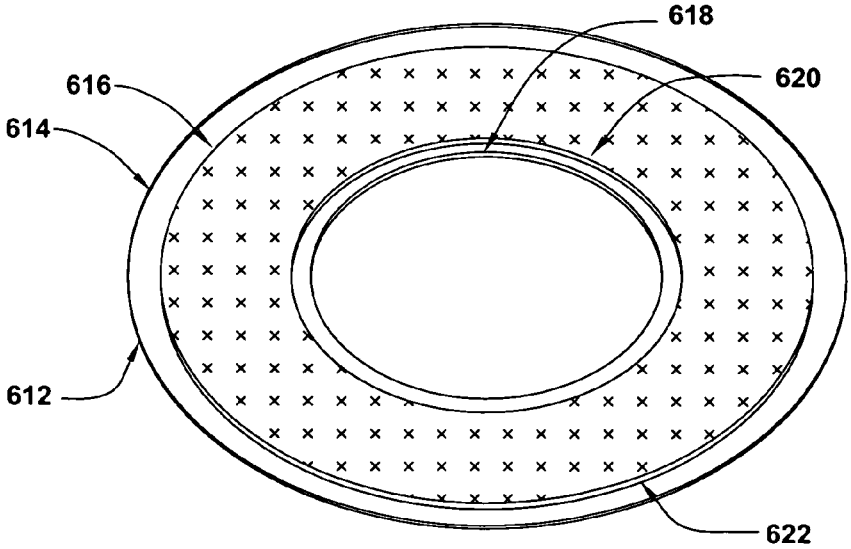
FIG. 36 is an isometric view of a solid-layer fixed-abrasive annular disk with a center hole.

FIG. 36 is an isometric view of a flexible annular fixed-abrasive coated abrasive disk having a thick layer of solid abrasive material attached to the annular abrasive disk backing. A continuous flat-surfaced annular band of a thick layer of solid abrasive material 622 is attached to the annular flexible backing 612 of an abrasive disk 614 that can be attached with vacuum or by other mechanical attachment devices (not shown) to a flat-surfaced rotary platen (not shown). The annular abrasive material 622 has an inner radius abrasive periphery 620 and has an outer radius abrasive periphery 616 and the abrasive disk 614 annular backing 612 has an abrasive disk 614 annular backing 612 inner radius periphery 618.

Figure 37:
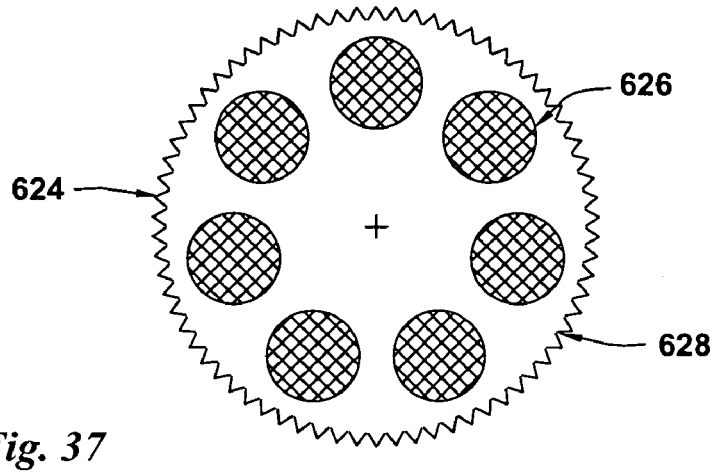
FIG. 37 is a top view of a planetary workholder toothed workpiece insert.

FIG. 37 is a top view of a planetary-type workholder saw-toothed workpiece insert. A circular flat-surfaced planetary-type workholder saw-toothed workpiece insert 624 has a saw-tooth periphery 628 where the workholder toothed workpiece insert 624 contains flat-surfaced workpieces 626. The workholder toothed workpiece insert 624 can be inserted into an annular workholder disk (not shown) that has a matching saw-tooth 628 annular inner periphery.

Figure 38:
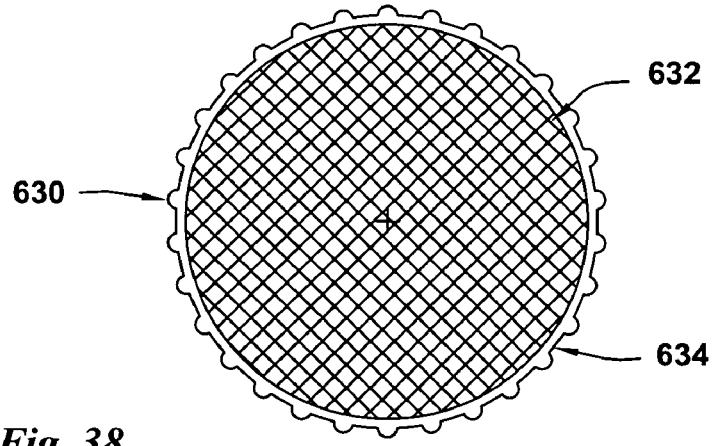
FIG. 38 is a top view of a planetary workholder knob-type workpiece insert.

FIG. 38 is a top view of a planetary workholder knob-type-tooth workpiece insert. A circular flat-surfaced planetary-type workholder knob-type-tooth workpiece insert 630 has a knob-type-tooth periphery 634 where the workholder knob-type-tooth workpiece insert 630 contains a flat-surfaced workpiece 632. The workholder knob-type-tooth workpiece insert 630 can be inserted into an annular workholder disk (not shown) that has a matching knob-type-tooth 634 annular inner periphery.

Figure 39:
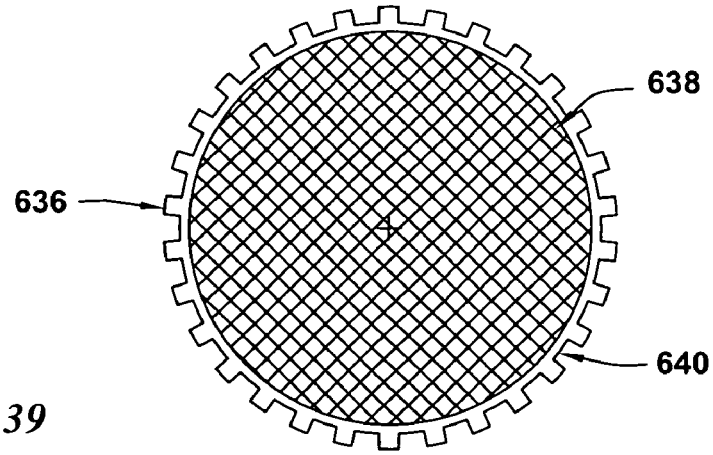
FIG. 39 is a top view of a planetary workholder ledge-type workpiece insert.

FIG. 39 is a top view of a planetary workholder ledge-type-tooth workpiece insert. A circular flat-surfaced planetary-type workholder ledge-type-tooth workpiece insert 636 has a ledge-type-tooth periphery 640 where the workholder ledge-type-tooth workpiece insert 636 contains a flat-surfaced workpiece 638. The workholder ledge-type-tooth workpiece insert 636 can be inserted into an annular workholder disk (not shown) that has a matching ledge-type-tooth 640 annular inner periphery.

Figure 40:
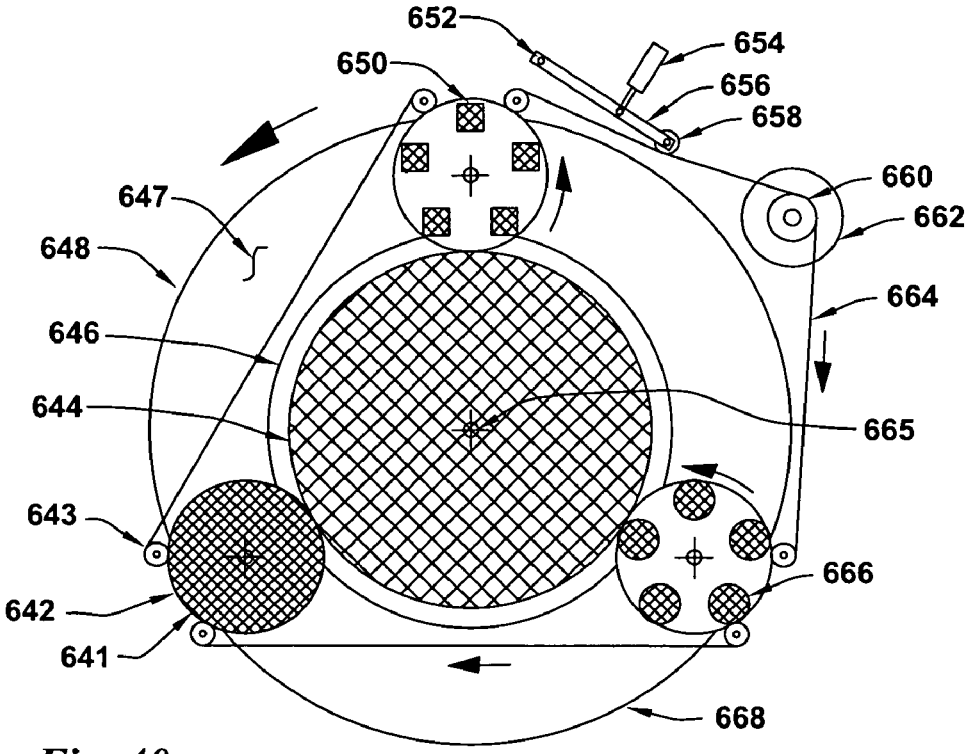
FIG. 40 is a top view of three wire-drive workholders with a center workholder support disk.

FIG. 40 is a top view of three wire-drive workholders with a center workholder support disk that can be used for single-sided or double-side abrading where three-point support can be provided for an upper floating abrading platen. A single-sided or double-sided abrading machine 668 that has three flat-surfaced circular workholder disks 641 that contain workpieces 642, 650 and 666 is shown where the flat-surfaced workpieces 642, 650 and 666 are in abrading contact with an abrasive 647 covered rotatable annular bottom platen 648 having an inner platen radius 646 where an upper rotatable abrading platen is not shown. The bottom platen 648 is rotated and the circular flat-surfaced workholder disks 641 are rotated as shown by a flexible continuous-loop drive-wire 664 that is driven by a drive-wire motor 662 that has a motor drive-wire pulley 660. An adjustable-pressure air cylinder 654 acts upon a pivot arm 656 that has a wire-idler 658 that applies controlled force on the flexible drive-wire 664 to generate the desired wire tension in the drive-wire 664. The workholder disks 641 are held in position relative to the bottom platen 648 by workholder combination wire-guide and disk position-idlers 643 where the force-tensioned drive-wire 664 urges the workholder disks 641 against the combination wire-guide and disk-position idlers 643. The pivot-arm 656 pivots at pivot-point 652. The drive-wire 664 is routed to and from the workholder disks 641 and the flexible drive-wire 664 is a continuous-loop drive wire 664.

Workholder disks 641 are also supported by a rotatable center workholder support disk 644 that has rolling contact with the workholder disks 641 as shown where the workholder disks 641 can be restrained in a radial direction relative to the circular diameter of the workholder disks 641 as shown. The rotatable center workholder support disk 644 that has rolling contact with the workholder disks 641 can also engage and restrain the workholder disks 641 in a direction that is perpendicular to the flat surfaces of the workholder disks 641 or the rotatable center workholder support disk 644 can also allow the workholder disks 641 to move freely in a direction that is perpendicular to the flat surfaces of the workholder disks 641. Controlled sized gaps (not shown) can be established and maintained between the flat surfaces of the workholder disks 641 and the abrading surfaces of both the upper rotatable platen and the bottom rotatable platen 648 where the flat surfaces of the workpieces 642, 650 and 666 are in abrading contact with the abrading surfaces of one or both the upper rotatable platen and the bottom rotatable platen 648 when the workholder disks 641 are stationary or when the workholder disks 641 are rotated or when the upper rotatable platen and/or the bottom rotatable platens 648 are stationary or are rotated. The rotatable center workholder support disk 644 can rotate about a rotatable center workholder support disk 644 rotation axis 665.

Figure 41:
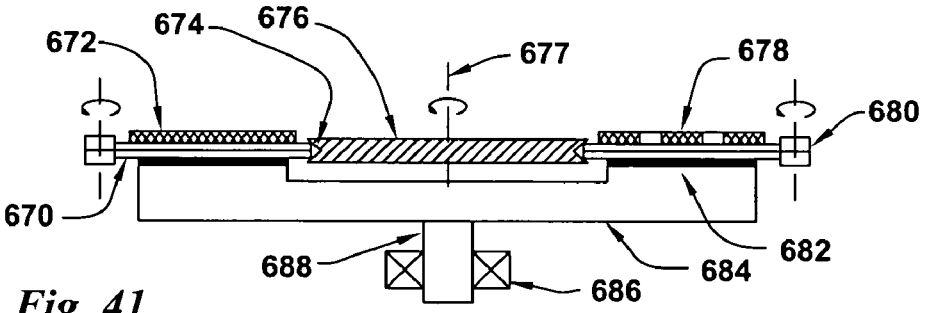
FIG. 41 is a cross section view of workholders with a center workholder support disk.

FIG. 41 is a cross section view of multiple wire-driven workholders with a rotatable center workholder support disk that can be used for single-sided or double-side abrading. Flat-surfaced circular workholder disks 670 that contain workpieces 672 and 678 is shown where the flat-surfaced workpieces 672 and 678 are in abrading contact with an abrasive 682 covered rotatable bottom platen 684 where an upper rotatable abrading platen is not shown. The bottom platen 684 is rotated by a platen drive motor (not shown) and the circular flat-surfaced workholder disks 670 are rotated by a flexible drive-wire (not shown). The workholder disks 670 are held in position relative to the bottom platen 684 by rotatable workholder disk position-idlers 680 where the force-tensioned drive-wire urges the workholder disks 670 against the rotatable disk-position idlers 680.

The rotatable workholder disks 670 are also supported by a rotatable center workholder support disk 676 having a support disk peripheral double-angled groove 674 that engages and restrains the workholder disks 670 and where rotatable center workholder support disk 676 has rolling contact with the workholder disks 670 as shown where the workholder disks 670 can be restrained in a radial direction relative to the circular diameter of the workholder disks 670 as shown. The rotatable center workholder support disk 676 that has rolling contact with the workholder disks 670 can also engage and restrain the workholder disks 670 in a direction that is perpendicular to the flat surfaces of the workholder disks 670. Controlled sized gaps (not shown) can be established and maintained between the flat surfaces of the workholder disks 670 and the abrading surfaces of both the upper rotatable platen and the bottom rotatable platen 684 where the flat surfaces of the workpieces 672 and 678 can be in abrading contact with the abrading surfaces of one or both the upper rotatable platen and the bottom rotatable platen 684 when the workholder disks 670 are stationary or when the workholder disks 670 are rotated or when the upper rotatable platen and/or the bottom rotatable platen 684 are stationary or are rotated. The rotatable center workholder support disk 676 can rotate about a rotatable center workholder support disk 676 rotation axis 677 where the rotatable center workholder support disk 676 can be supported by the rotatable workholder disks 670. The bottom rotatable platen 684 is shown as supported by a rotatable platen 684 shaft 688 that is supported by a shaft bearing 686 that is attached to a frame (not shown).

Figure 42:
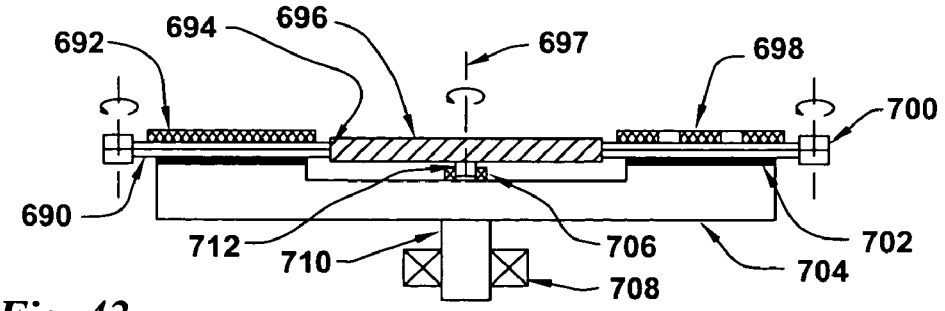
FIG. 42 is a cross section view of workholders with a bearing-type workholder support disk.

FIG. 42 is a cross section view of multiple wire-driven workholders with a bearing-supported-type center workholder support disk that can be used for single-sided or double-side abrading. Flat-surfaced circular workholder disks 690 that contain workpieces 692 and 698 are shown where the flat-surfaced workpieces 692 and 698 are in abrading contact with an abrasive 702 covered rotatable bottom platen 704 where an upper rotatable abrading platen is not shown. The bottom platen 704 is rotated by a platen drive motor (not shown) and the circular flat-surfaced workholder disks 690 are rotated by a flexible drive-wire (not shown). The workholder disks 690 are held in position relative to the bottom platen 704 by rotatable workholder disk position-idlers 700 where the force-tensioned drive-wire urges the workholder disks 690 against the rotatable disk-position idlers 700.

The rotatable workholder disks 690 are also supported by a rotatable center workholder support disk 696 having a workholder support disk 690 peripheral flat-face 694 or a double-angled groove (not shown) that has rolling contact with the workholder disks 690 as shown where the workholder disks 690 can be restrained in a radial direction relative to the circular diameter of the workholder disks 690 as shown. The rotatable center workholder support disk 696 that has rolling contact with the workholder disks 690 can also engage and restrain the workholder disks 690 in a direction that is perpendicular to the flat surfaces of the workholder disks 690. Controlled sized gaps (not shown) can be established and maintained between the flat surfaces of the workholder disks 690 and the abrading surfaces of both the upper rotatable platen and the bottom rotatable platen 704 where the flat surfaces of the workpieces 692 and 698 can be in abrading contact with the abrading surfaces of one or both the upper rotatable platen and the bottom rotatable platen 704 when the workholder disks 690 are stationary or when the workholder disks 690 are rotated or when the upper rotatable platen and/or the bottom rotatable platen 704 are stationary or are rotated.

The rotatable center workholder support disk 696 rotates about a support disk rotation axis 697 where the rotatable center workholder support disk 696 can be supported by the rotatable workholder disks 690. Also, the rotatable center workholder support disk 696 can be supported by a rotatable workholder support disk bearing shaft 712 that is supported by a rotatable workholder support disk shaft bearing 706 that is attached to the rotatable bottom platen 704. The bottom rotatable platen 704 is shown as supported by a rotatable platen 704 shaft 710 that is supported by a shaft bearing 708 that is attached to a frame (not shown).

Figure 43:
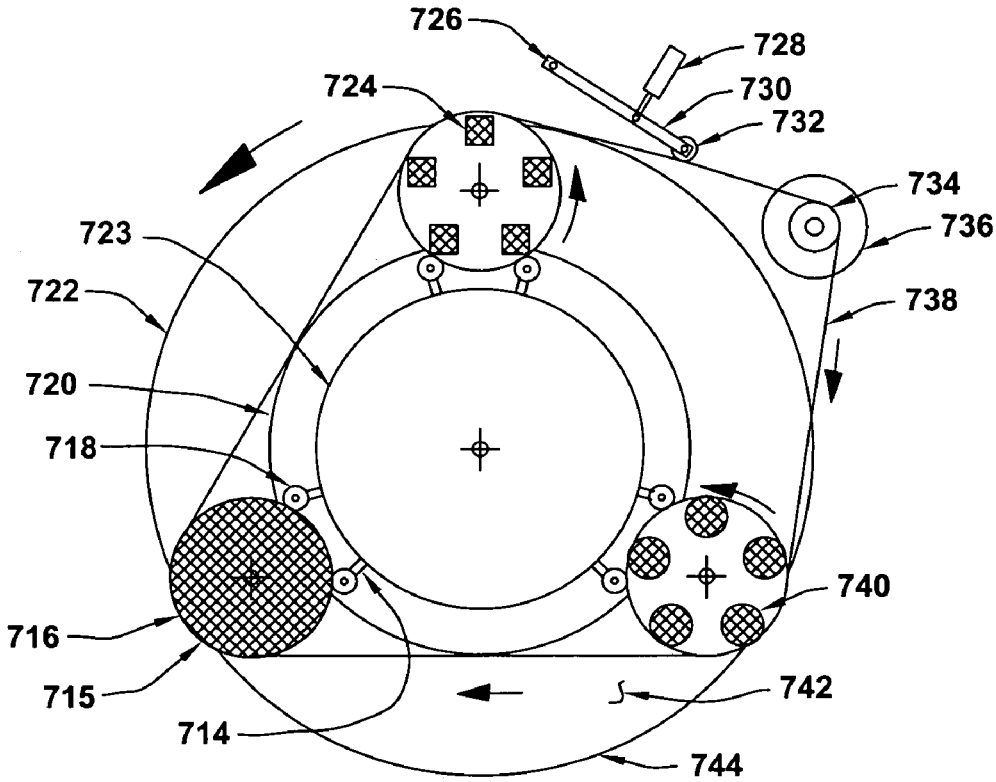
FIG. 43 is a top view of three wire-drive workholders with a center workholder support disk.

FIG. 43 is a top view of three wire-drive workholders with a center workholder support disk that can be used for single-sided or double-side abrading where three-point support can be provided for an upper floating abrading platen. A single-sided or double-sided abrading machine 744 that has three flat-surfaced circular workholder disks 715 that contain workpieces 716, 724 and 740 is shown where the flat-surfaced workpieces 716, 724 and 740 are in abrading contact with an annular abrasive 742 covered rotatable bottom flat-surfaced platen 722 having an inner radius 720 where an upper rotatable abrading platen is not shown. The bottom platen 722 is rotated by a platen drive motor (not shown) and the circular flat-surfaced workholder disks 715 are rotated as shown by a continuous-loop flexible drive-wire 738 that is driven by a drive-wire motor 736 that has a motor drive-wire pulley 734. An adjustable-pressure, variable-force air cylinder 728 acts upon a pivot arm 730 that has a wire-idler 732 that applies controlled force on the flexible drive-wire 738 to generate the desired wire tension in the drive-wire 738. The workholder disks 715 are held in position relative to the bottom platen 722 by workholder disk position-idlers 718 that are supported by idler-posts 714 that are attached to a stationary workholder support disk 723 where the force-tensioned drive-wire 738 urges the workholder disks 715 against the disk-position rotatable idlers 718. The pivot-arm 730 pivots at pivot-point 726. The drive-wire 738 is routed to and from the workholder disks 715.

Workholder disks 715 that are supported by the stationary center workholder support disk 723 disk-position rotatable idlers 718 that have rolling contact with the workholder disks 715 are shown where the workholder disks 715 can be restrained in a radial direction relative to the circular diameter of the workholder disks 715 as shown. The stationary rotatable center workholder support disk 723 disk-position rotatable idlers 718 that have rolling contact with the workholder disks 715 can also engage and restrain the workholder disks 715 in a direction that is perpendicular to the flat surfaces of the workholder disks 715 or the rotatable center workholder support disk 723 can also allow the workholder disks 715 to move freely in a direction that is perpendicular to the flat surfaces of the workholder disks 715. Controlled sized gaps (not shown) can be established and maintained by these components where the controlled gaps exist between the flat surfaces of the workholder disks 715 and the abrading surfaces of both the upper rotatable platen and the bottom rotatable platen 722 where the flat surfaces of the workpieces 716, 724 and 740 are in abrading contact with the abrading surfaces of one or both the upper rotatable platen and the bottom rotatable platen 722 when the workholder disks 715 are stationary or when the workholder disks 715 are rotated or when the upper rotatable platen and/or the bottom rotatable platen 722 are stationary or are rotated.

Figure 44:
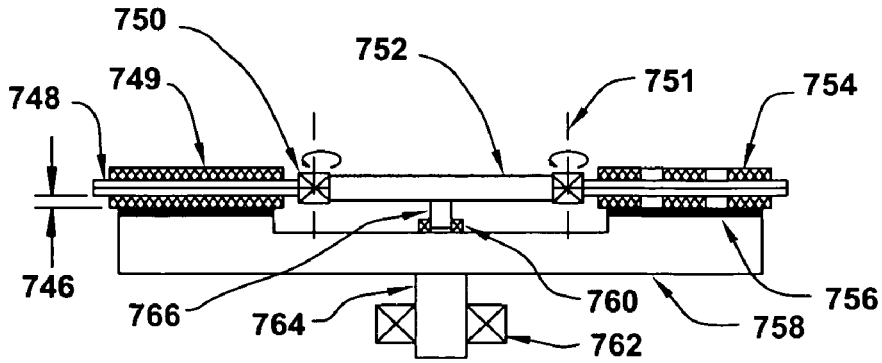
FIG. 44 is a cross section view of workholders with a bearing-type workholder support disk.

FIG. 44 is a cross section view of multiple wire-driven workholders with a stationary bearing-type center workholder support disk that can be used for single-sided or double-side abrading. Flat-surfaced circular workholder disks 748 that contain workpieces 749 and 754 is shown where the flat-surfaced workpieces 749 and 754 are in abrading contact with an abrasive 756 covered rotatable bottom platen 758 where an upper rotatable abrading platen is not shown. The bottom platen 758 is rotated by a platen drive motor (not shown) and the circular flat-surfaced workholder disks 748 are rotated by a flexible drive-wire (not shown). The workholder disks 748 are held in position relative to the bottom platen 758 by workholder disk position-idlers (not shown) where the force-tensioned drive-wire urges the workholder disks 748 against the disk-position idlers.

The rotatable workholder disks 748 are also supported by a stationary rotatable center workholder support disk 752 having rotatable idlers 750 that have rolling contact with the workholder disks 748 as shown where the workholder disks 748 can be restrained in a radial direction relative to the circular diameter of the workholder disks 748 as shown. The stationary center workholder support disk 752 having the rotatable idlers 750 that have rolling contact with the workholder disks 748 can also engage and restrain the workholder disks 748 in a direction that is perpendicular to the flat surfaces of the workholder disks 748. Also, the rotatable center workholder support disk 723 can allow the workholder disks 748 to move freely in a direction that is perpendicular to the flat surfaces of the workholder disks 748.

Controlled sized gaps 746 (gap not shown for the upper platen) can be established and maintained between the flat surfaces of the workholder disks 748 and the abrading surfaces of both the upper rotatable platen and the bottom rotatable platen 758 where the flat surfaces of the workpieces 749 and 754 can be in abrading contact with the abrading surfaces of one or both the upper rotatable platen and the bottom rotatable platen 758 when the workholder disks 748 are stationary or when the workholder disks 748 are rotated or when the upper rotatable platen and/or the bottom rotatable platen 758 are stationary or are rotated.

The center workholder support disk 752 is stationary where the rotatable center workholder support disk 752 can be supported by the rotatable workholder disks 748. Also, the rotatable center workholder support disk 752 can be supported by a rotatable workholder support disk bearing shaft 766 that is supported by a rotatable workholder support disk shaft bearing 760 that is attached to the rotatable bottom platen 758. The bottom rotatable platen 758 is shown as supported by a rotatable platen 758 shaft 764 that is supported by a shaft bearing 762 that is attached to a frame (not shown).

Figure 45:
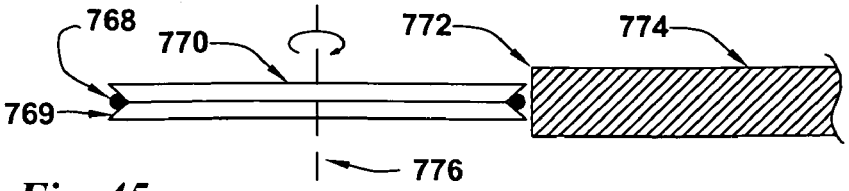
FIG. 45 is a cross section view of a wire-driven workholder with a flat-surfaced center disk.

FIG. 45 is a cross section view of a wire-driven workholder with a flat-surfaced center disk. A wire-driven circular workholder 770 having a drive-wire groove 769 around the workholder 770 outer diameter periphery has a flexible drive-wire 768 that is routed around the outer diameter periphery of the workholder 770 where the workholder 770 is rotated about a workholder 770 rotation axis 776. A rotatable circular workholder support disk 774 has a rotatable circular workholder support disk 774 outer diameter periphery flat-surface 772 that is in rolling contact with the workholder 770 outer diameter periphery.

Figure 46:
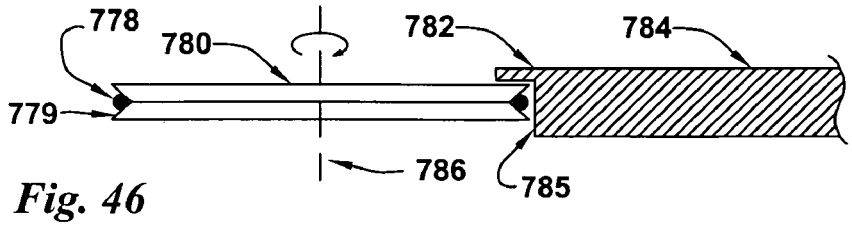
FIG. 46 is a cross section view of a wire-driven workholder with a ledge-type center disk.

FIG. 46 is a cross section view of a wire-driven workholder with a ledge-type center disk. A wire-driven circular workholder 780 having a drive-wire groove 779 around the workholder 780 outer diameter periphery has a flexible drive-wire 778 that is routed around the outer diameter periphery of the workholder 780 where the workholder 780 is rotated about a workholder 780 rotation axis 786. A rotatable circular workholder support disk 784 has a rotatable circular workholder support disk 784 outer diameter periphery single-ledge 782 and has a flat-surface 785 that is in rolling contact with the workholder 780 outer diameter periphery.

Figure 47:
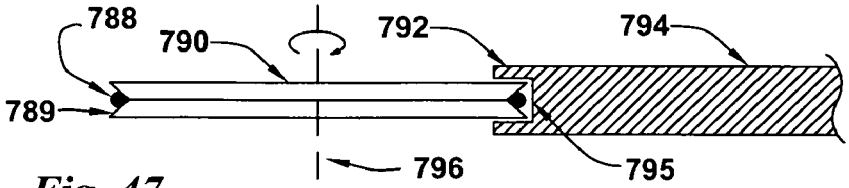
FIG. 47 is a cross section view of a wire-driven workholder with a double-ledge center disk.

FIG. 47 is a cross section view of a wire-driven workholder with a double-ledge center disk. A wire-driven circular workholder 790 having a drive-wire groove 789 around the workholder 790 outer diameter periphery has a flexible drive-wire 788 that is routed around the outer diameter periphery of the workholder 790 where the workholder 790 is rotated about a workholder 790 rotation axis 796. A rotatable circular workholder support disk 794 has a rotatable circular workholder support disk 794 outer diameter periphery double-ledge 792 and has a flat-surface 795 that is in rolling contact with the workholder 790 outer diameter periphery.

Figure 48:
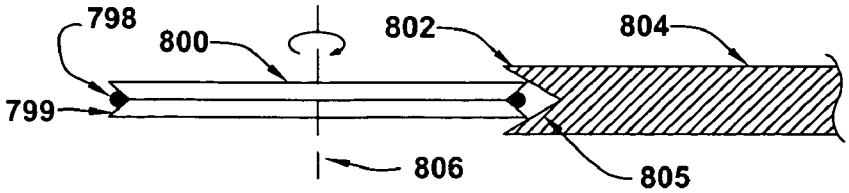
FIG. 48 is a cross section view of a wire-driven workholder with a double-taper center disk.

FIG. 48 is a cross section view of a wire-driven workholder with a double-taper center disk. A wire-driven circular workholder 800 having a drive-wire groove 799 around the workholder 800 outer diameter periphery has a flexible drive-wire 798 that is routed around the outer diameter periphery of the workholder 800 where the workholder 800 is rotated about a workholder 800 rotation axis 806. A rotatable circular workholder support disk 804 has a rotatable circular workholder support disk 804 outer diameter periphery double-angle-groove 805 that is in rolling contact with the workholder 800 outer diameter periphery.

Figure 49:
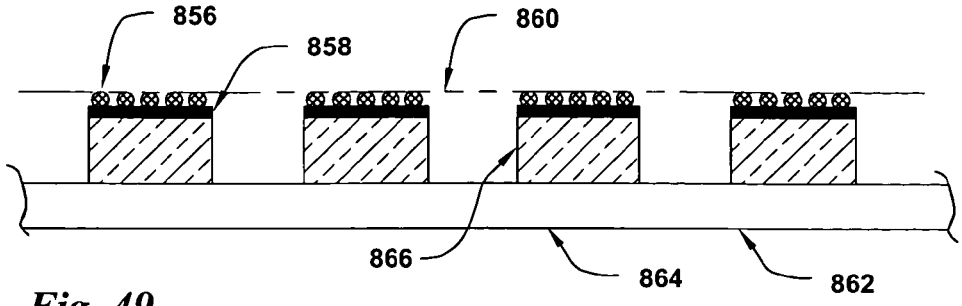
FIG. 49 is a cross section view of abrasive beads coated on raised island islands.

FIG. 49 is a cross section view of abrasive beads coated on raised island islands. Abrasive beads 856 are attached with a layer of adhesive 858 to raised islands 866 that are attached to an abrasive disk 864 flexible backing 862. The top surfaces of the beads 856 that are attached to all the islands 866 are precisely located in a common plane 860 to provide uniform workpiece (not shown) abrading when the disk 864 is attached to a rotating platen (not shown). The raised islands 866 prevent hydroplaning of the workpieces when the abrasive disk 864 is operated at very high abrading speeds in the presence of workpiece coolant water.

Figure 50:
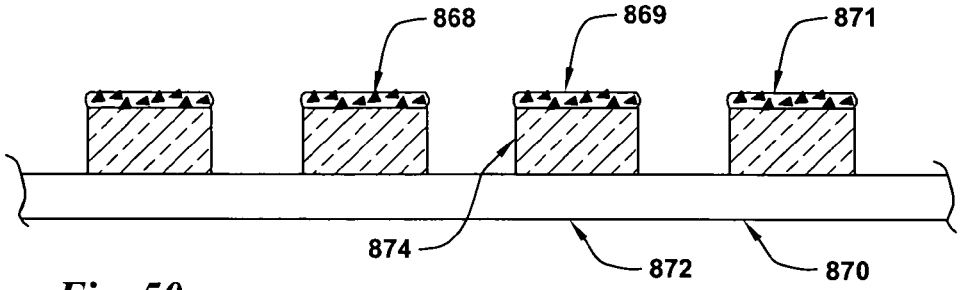
FIG. 50 is a cross section view of abrasive slurry coated on raised island islands.

FIG. 50 is a cross section view of abrasive slurry coated on raised island islands. Abrasive slurry coating 869 containing abrasive particles 868 in an adhesive binder 871 is coated as a layer on to the top surfaces of raised islands 874 that are attached to an abrasive disk 872 flexible backing 870.

Figure 51:
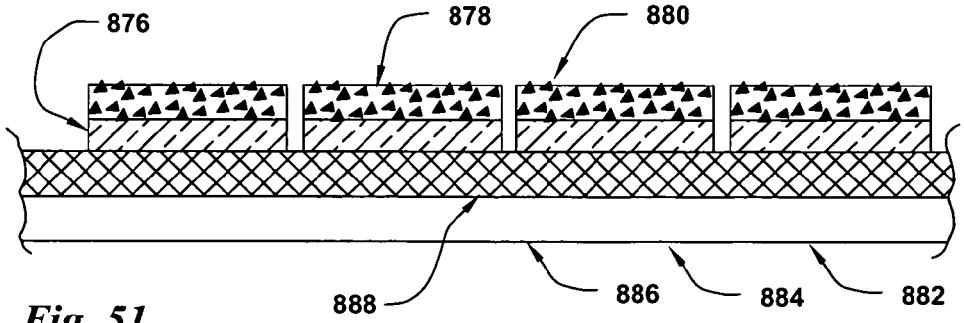
FIG. 51 is a cross section view of thick layers of abrasive coated on raised island islands.

FIG. 51 is a cross section view of thick layers of abrasive coated on raised island islands. An abrasive disk 882 having a thick layer of solid abrasive material 878 containing abrasive particles 880 is attached to rigid raised island structures 876 that are attached to a thick, strong and durable flexible backing 888 that is attached to a flexible backing 886 that has a smooth surface 884 that allows the thick abrasive disk 882 to be conformably attached to a flat-surfaced platen (not shown) with vacuum.

Figure 52:
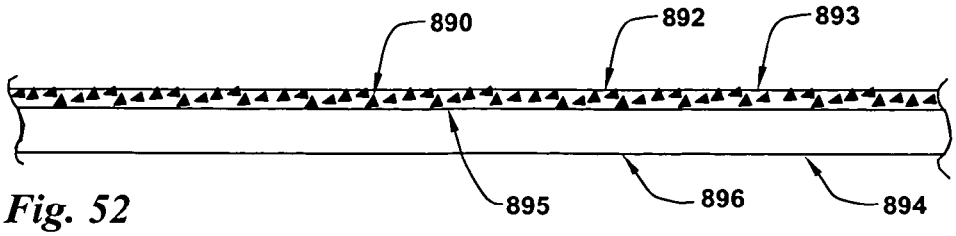
FIG. 52 is a cross section view of a continuous layer of abrasive coated on a disk backing.

FIG. 52 is a cross section view of a continuous layer of abrasive coated on a disk backing. An abrasive slurry coating 892 containing abrasive particles 890 in an adhesive binder 893 is continuous-coated as a layer on to the top surface 895 of a backing 896 of an abrasive disk 894.

Figure 53:
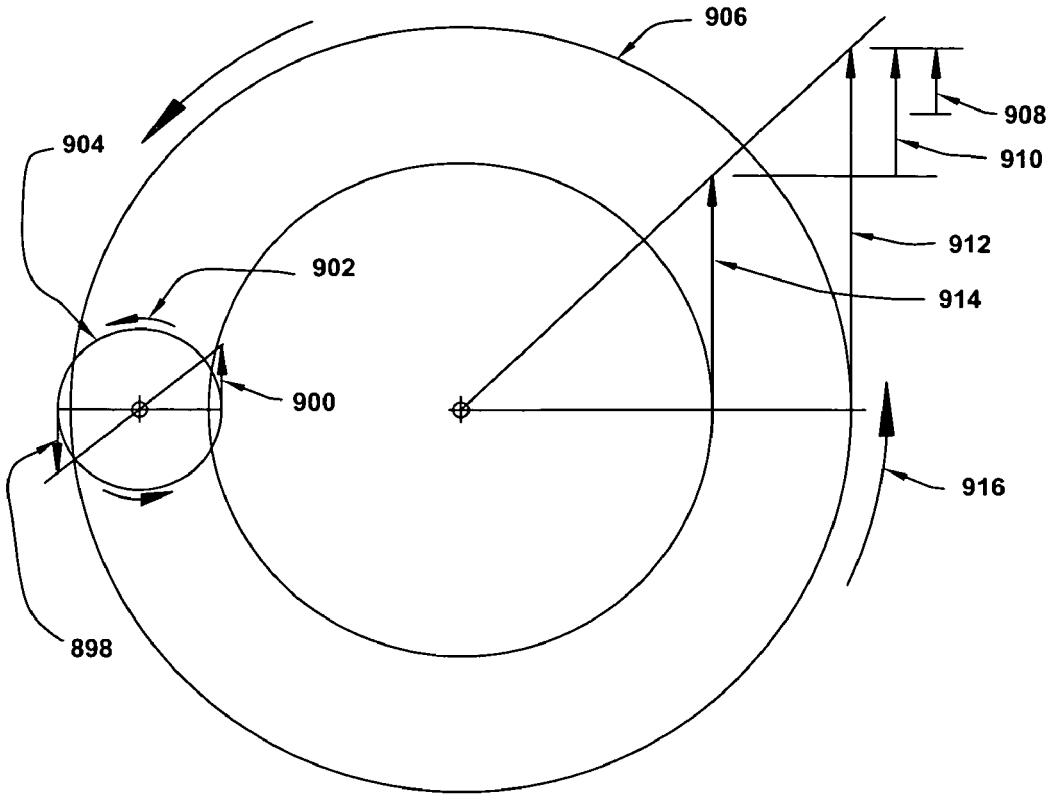
FIG. 53 is a top view of abrading speeds of a rotating workpiece on an annular platen.

FIG. 53 is a top view of abrading speeds of a rotating workpiece on an annular platen. An abrasive covered annular platen 906 rotates in a direction 916 and a flat contacting workpiece 904 rotates in a direction 902. The workpiece 904 has a peripheral speed 900 at the inner periphery of the platen 906 annular area and a opposed-direction localized speed 898 at the outer periphery of the annular platen 906. The platen 906 has a peripheral speed 914 at the inner periphery of the platen 906 annular area and a larger same-direction localized speed 912 at the outer periphery of the annular platen 906. The difference between the platen 906 abrading speed 914 at the inner periphery of the platen 906 annular area and the larger same-direction localized speed 912 at the outer periphery of the annular platen 906 is 910 and one half of the platen 906 differential speed 910 is 908 which is equal to the peripheral speeds 898 and 900 of the workpiece 904.

Figure 54:
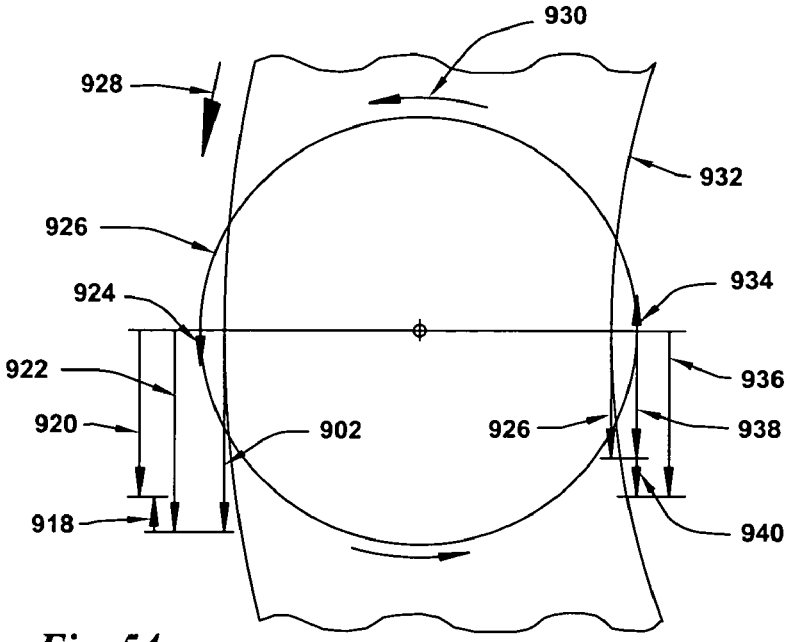
FIG. 54 is a top view of abrading speeds of a rotating workpiece on annular abrasive.

FIG. 54 is a top view of abrading speeds of a rotating workpiece on annular abrasive. An abrasive covered annular platen 932 rotates in a direction 928 and a flat contacting workpiece 926 rotates in a same-direction 930. The workpiece 926 has a peripheral speed 934 at the inner periphery of the platen 932 annular area and a opposed-direction localized speed 924 at the outer periphery of the annular platen 932. The platen 932 has a peripheral speed 926 at the inner periphery of the platen 932 annular area and a larger same-direction localized speed 920 at the outer periphery of the annular platen 932. The abrading speed vector 926 at the inner periphery of the platen 932 annular area is also shown for convenience as the vector 938 at the inner periphery of the platen 932 annular area. The small opposed-direction localized speed 940 of the workpiece 926 at the inner periphery of the annular platen 932 is added to the platen 932 vector 938 to produce a net abrading speed 936 at the inner periphery of the platen 932 annular area. Likewise, the abrading speed vector 902 at the outer periphery of the platen 932 annular area is also shown for convenience as the vector 922 at the outer periphery of the platen 932 annular area and the small same-direction localized speed 918 of the workpiece 926 at the outer periphery of the annular platen 932 is subtracted from the platen 932 vector 922 to produce a net abrading speed 920 at the outer periphery of the platen 932 annular area. The net abrading speed 920 at the outer periphery of the annular platen 932 is equal in magnitude to the net abrading speed 936 at the inner periphery of the annular platen 932 with the result that the abrading speed is the same at both the inner and outer peripheries of the platen 932. The technique of rotating the workpiece 926 in the same direction as the platen 932 equalizes the abrading speed, and workpiece material removal rate, across the radial-direction surface of the workpiece 926.

High Speed Planetary Workholder System Description

The rotatable wire-driven circular workholder disk device apparatus system is described where flat-surfaced workpieces are rotated in flat-surfaced single-sided abrading contact with a rotatable abrading platen comprising:

a) an abrading machine frame, a rotatable wire-driven circular workholder disk device apparatus frame that is attached to the abrading machine frame, a rotatable wire-driven circular workholder disk having rotatable wire-driven circular workholder disk opposed flat disk surfaces where the rotatable wire-driven circular workholder disk has a rotatable wire-driven circular workholder disk center located at a rotational center of the rotatable wire-driven circular workholder disk and the rotatable wire-driven circular workholder disk has a rotatable wire-driven circular workholder disk thickness and the rotatable wire-driven circular disk has a rotatable wire-driven circular workholder disk outer diameter and the rotatable wire-driven circular workholder disk has a rotatable wire-driven circular workholder disk outer diameter circumference;

b) a rotatable wire-driven circular workholder disk flexible drive-wire having a flexible drive-wire length and the flexible drive-wire has a flexible drive-wire cross-section shape that has a flexible drive-wire centroid wherein the flexible drive-wire has a flexible drive-wire axis that intersects the flexible drive-wire cross-section shape centroid and where the flexible drive-wire axis extends along length-segments of the flexible drive-wire length and where the flexible drive-wire is selected from the group consisting of metal wires, polymer monofilaments, braided, twisted or woven polymer strands, braided, twisted or woven organic material strands and braided, twisted or woven metal strands;

c) wherein the rotatable wire-driven circular workholder disk outer diameter circumference has a drive-wire groove that is formed in the rotatable wire-driven circular workholder disk thickness where the drive-wire groove extends around the rotatable wire-driven circular workholder disk outer diameter circumference where the rotatable wire-driven circular workholder disk outer diameter circumference drive-wire groove has a drive-wire groove shape that is configured to restrain and guide a rotatable wire-driven circular workholder disk flexible drive-wire that contacts at least thirty degrees of circular arc-length of the rotatable wire-driven circular workholder disk outer diameter circumference and where the rotatable wire-driven circular workholder disk has a rotatable wire-driven circular workholder disk outer diameter drive-wire inlet side and the rotatable wire-driven circular workholder disk has a rotatable wire-driven circular workholder disk outer diameter drive-wire outlet side;

d) wherein the rotatable wire-driven circular workholder disk is positioned at a fixed location relative to the rotatable wire-driven circular disk workholder device apparatus frame by use of at least two rotatable wire-driven circular workholder disk rotatable disk-positioning idlers having rotatable disk-position idlers' outer diameters where the rotatable disk-position idlers have rotatable disk-position idler outer diameter circumferences that have a rotatable disk-position idler outer diameter circumference-shape that is selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each selected rotatable disk-position idler outer diameter circumference-shape can have rolling contact with the rotatable wire-driven circular workholder disk outer diameter circumference to position-restrain and engage the rotatable wire-driven circular workholder disk at a desired location relative to the rotatable wire-driven circular disk workholder device apparatus frame;

e) wherein a first and a second rotatable wire-driven circular workholder disk rotatable disk-position idlers are position-spaced at locations that are at least 10 degrees of rotatable disk-position idlers' separation arc-length apart from each other where the rotatable disk-position idlers' separation arc-length is measured along the rotatable wire-driven circular workholder disk outer diameter circumference and where the rotatable wire-driven circular workholder disk rotatable disk-position idlers are attached to the rotatable wire-driven circular disk workholder device apparatus frame at the respective rotatable wire-driven circular workholder disk rotatable disk-position idlers' position-spaced separation arc-length locations and wherein the first rotatable wire-driven circular workholder disk rotatable disk-positioning idler is positioned at the rotatable wire-driven circular workholder disk outer diameter drive-wire inlet side and the second rotatable wire-driven circular workholder disk rotatable disk-positioning idler is positioned at the rotatable wire-driven circular workholder disk outer diameter drive-wire outlet side;

f) a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the rotatable wire-driven circular workholder disk flexible drive-wire rotatable motor can be either attached to the rotatable wire-driven circular disk workholder device apparatus frame or attached to the rotatable wire-driven circular disk workholder device abrading machine frame; and g) at least two rotatable wire-driven circular workholder disk flexible drive-wire circular rotatable wire-guide idlers that each have a flexible drive-wire circular rotatable wire-guide idler thickness and each flexible drive-wire circular rotatable wire-guide idler has a flexible drive-wire circular rotatable wire-guide idler outer diameter and each flexible drive-wire circular rotatable wire-guide idler has a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the rotatable wire-guide idler arc-length is measured along the flexible drive-wire circular rotatable wire-guide idler outer diameter circumferences; and h) wherein the at least two rotatable wire-driven circular workholder disk flexible drive-wire circular rotatable wire-guide idlers are attached to the rotatable wire-driven circular disk workholder device apparatus frame wherein a first rotatable wire-driven circular workholder disk flexible drive-wire circular rotatable wire-guide idler is positioned at the rotatable wire-driven circular workholder disk outer diameter drive-wire inlet side and a second rotatable wire-driven circular workholder disk flexible drive-wire circular rotatable wire-guide idler is positioned at the rotatable wire-driven circular workholder disk outer diameter drive-wire outlet side and wherein the first and second rotatable wire-driven rotatable wire-driven circular workholder disk flexible drive-wire circular rotatable wire-guide idlers are position-spaced at locations that are at least 30 degrees of wire-guide idler separation arc-length apart from each other where the flexible drive-wire circular rotatable wire-guide idler separation arc-length is measured along the rotatable wire-driven circular workholder disk outer diameter circumference and where the rotatable wire-driven circular workholder disk flexible drive-wire circular rotatable wire-guide idlers are position-spaced at flexible drive-wire circular rotatable wire-guide idler separation arc-lengths that are greater than the rotatable wire-driven circular workholder disk rotatable disk-position idlers' separation arc-lengths;

i) wherein the respective rotatable wire-driven circular workholder disk flexible drive-wire can be routed around and in contact with the rotatable wire-driven circular workholder disk flexible drive-wire rotatable motor drive-wire pulley circumference and routed to be in contact with at least a first rotatable wire-driven circular workholder disk flexible drive-wire circular rotatable wire-guide idler circumference and routed to be in contact with the rotatable wire-driven circular workholder disk circumference and routed to be in contact with at least a second rotatable wire-driven circular workholder disk flexible drive-wire circular rotatable wire-guide idler circumference and routed back to and in contact with the rotatable wire-driven circular workholder disk flexible drive-wire rotatable motor drive-wire pulley circumference;

j) a wire-tensioning device that applies a wire tension force to the rotatable wire-driven circular workholder disk's flexible drive-wire wherein the respective rotatable wire-driven circular workholder disk flexible drive-wire urges the rotatable wire-driven circular workholder disk against the at least two rotatable wire-driven circular workholder disk rotatable disk-positioning idlers;

k) a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and l) wherein the lower rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

m) wherein the rotatable wire-driven circular workholder disk can be positioned where the rotatable wire-driven circular workholder disk center is located on the lower rotatable abrading platen annular abrading-surface centerline, workpieces having parallel opposed flat workpiece-top surfaces and flat workpiece-bottom surfaces and the workpieces have workpiece cross-sectional shapes and the workpieces have approximately-equal thicknesses;

n) wherein the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

o) wherein the workpieces having flat workpiece-bottom surfaces can be inserted into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

p) wherein controlled workpiece abrading forces can be applied to the respective workpieces' flat workpiece-top surfaces by placing weights on the workpieces' flat workpiece-top surfaces or by applying abrading forces to the workpieces' flat workpiece-top surfaces wherein the controlled workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface; and q) wherein the flexible drive-wire rotatable motor can be rotated wherein the rotatable wire-driven circular workholder disk flexible drive-wire is moved along the rotatable wire-driven circular workholder disk flexible drive-wire axis to rotate the rotatable wire-driven circular workholder disk about the rotatable wire-driven circular workholder disk's center of rotation wherein the workpieces inserted into the rotatable wire-driven circular workholder disk's open workpiece receptacle-holes are rotated about the rotatable wire-driven circular workholder disk's center of rotation and wherein the lower rotatable abrading platen can be rotated to single-sided abrade the workpiece-bottom surfaces.

In addition, the rotatable wire-driven circular workholder disk device apparatus system rotatable wire-driven circular workholder disk flexible drive-wire can be a continuous-loop rotatable wire-driven circular workholder disk flexible drive-wire.

Further, the rotatable wire-driven circular workholder disk device apparatus system can have multiple rotatable wire-driven circular workholder disks where components consisting of more than one rotatable wire-driven workholder disk device apparatus frame, more than one rotatable wire-driven circular workholder disk, a rotatable wire-driven circular workholder disk flexible drive-wire or more than one rotatable wire-driven circular workholder disk flexible drive-wire, respective more than one set of first and second rotatable wire-driven circular workholder disk rotatable disk-positioning idlers, respective more than one set of first and second rotatable wire-driven circular workholder disk flexible drive-wire circular rotatable wire-guide idlers, a rotatable wire-driven circular workholder disk flexible drive-wire rotatable motor or more than one rotatable wire-driven circular workholder disk flexible drive-wire rotatable motor, a wire-tensioning device or more than one wire-tensioning device that applies a wire tension force or wire tension forces to the respective rotatable wire-driven circular workholder disk's flexible drive-wire or rotatable wire-driven circular workholder disk's flexible drive-wires where these components are attached to the abrading machine frame to provide multiple rotatable wire-driven circular workholder disks that can be positioned where the respective rotatable wire-driven circular workholder disk centers are located on the rotatable abrading platen annular abrading-surface centerline and wherein the multiple rotatable wire-driven circular workholder disks' flexible drive-wires have a flexible drive-wire length or a flexible drive-wire continuous-loop.

The rotatable wire-driven circular workholder disk device apparatus system having multiple rotatable wire-driven circular workholder disks can be configured where the rotatable wire-driven circular workholder disks are supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the rotatable wire-driven circular workholder disks with the lower abrading platen abrasive coating compromising:

a) a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) where the workholder disk rotatable support-idler device outer diameter circumference-shape can have rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) where the workholder disk rotatable support-idler device is supported by a workholder disk rotatable support-idler device rotation bearing that is attached to the lower rotatable abrading platen at the location of the lower rotatable abrading platen rotation axis, where the rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces; and d) wherein both the workholder disk rotatable support-idler device and the respective rotatable wire-driven circular workholder disks' at least two rotatable wire-driven circular workholder disk rotatable disk-positioning idlers position-restrain and engage portions of the respective rotatable wire-driven circular workholder disks where the respective rotatable wire-driven circular workholder disks do not contact the lower rotatable abrading platen abrasive coating.

Also, the rotatable wire-driven circular workholder disk device apparatus system can have a configuration where the wire-driven circular workholder disk device apparatus frame can be translated in a radial direction or rotated away from the lower abrading platen annular abrading surface comprising:

a) where the rotatable wire-driven circular workholder disk device apparatus frame can be translated by a driven workholder disk device apparatus frame mechanical slide apparatus where the rotatable wire-driven circular workholder disk device apparatus frame is attached to the workholder disk device apparatus frame mechanical slide apparatus and wherein the rotatable wire-driven circular workholder disk device apparatus frame can be translated in a radial direction relative to and from the to the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional gap between the rotatable wire-driven circular workholder disk outer diameter circumference and the lower rotatable abrading platen annular abrading-surface outer radius; or b) where the rotatable wire-driven circular workholder disk device apparatus frame can be rotated by a driven workholder disk mechanical pivot apparatus where the rotatable wire-driven circular workholder disk device apparatus frame is attached to the workholder disk device apparatus frame mechanical pivot apparatus and wherein the rotatable wire-driven circular workholder disk device apparatus frame can be rotated in a circular direction relative to and from the to the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional gap between the rotatable wire-driven circular workholder disk outer diameter circumference and the lower rotatable abrading platen annular abrading-surface outer radius.

In another configuration, the at least three rotatable wire-driven circular workholder disk device apparatus that can rotate workpieces in flat-surfaced double-sided abrading contact with an upper floating platen and an opposed fixed-position lower platen comprising:

a) an abrading machine frame, at least three rotatable wire-driven circular workholder disk device apparatus frames that are attached to the abrading machine frame and at least three rotatable wire-driven circular workholder disks having respective rotatable wire-driven circular workholder disk opposed flat disk surfaces where each respective rotatable wire-driven circular workholder disk has a rotatable wire-driven circular workholder disk center located at a rotational center of the respective rotatable wire-driven circular workholder disk and each respective rotatable wire-driven circular workholder disk has a rotatable wire-driven circular workholder disk thickness and each respective rotatable wire-driven circular disk has a rotatable wire-driven circular workholder disk outer diameter and each respective rotatable wire-driven circular workholder disk has a rotatable wire-driven circular workholder disk outer diameter circumference;

b) a rotatable wire-driven circular workholder disk flexible drive-wire where the flexible drive-wire has a flexible drive-wire length and the flexible drive-wire has a flexible drive-wire cross-section shape that has a flexible drive-wire centroid wherein the flexible drive-wire has a flexible drive-wire axis that intersects the respective flexible drive-wire cross-section shape centroid and where the flexible drive-wire axis extends along length-segments of the respective flexible drive-wire length and where the flexible drive-wire is selected from the group consisting of metal wires, polymer monofilaments, braided, twisted or woven polymer strands, braided, twisted or woven organic material strands and braided, twisted or woven metal strands;

c) wherein each respective rotatable wire-driven circular workholder disk outer diameter circumference has a drive-wire groove that is formed in the respective rotatable wire-driven circular workholder disk thickness where the respective drive-wire groove extends around the respective rotatable wire-driven circular workholder disk's outer diameter circumference where the respective rotatable wire-driven circular workholder disk outer diameter circumference drive-wire groove has a respective drive-wire groove shape that is configured to restrain and guide a rotatable wire-driven circular workholder disk flexible drive-wire that contacts at least thirty degrees of circular arc-length of each respective rotatable wire-driven circular workholder disk outer diameter circumference and where each respective rotatable wire-driven circular workholder disk has a respective rotatable wire-driven circular workholder disk outer diameter drive-wire inlet side and each respective rotatable wire-driven circular workholder disk has a respective rotatable wire-driven circular workholder disk outer diameter drive-wire outlet side;

d) wherein the at least three rotatable wire-driven circular workholder disks are each positioned at fixed locations relative to the respective rotatable wire-driven circular disk workholder device apparatus frame by use of respective at least two respective rotatable wire-driven circular workholder disk rotatable disk-positioning idlers having respective rotatable disk-position idlers' outer diameters where the respective rotatable disk-position idlers have respective rotatable disk-position idler outer diameter circumferences that have respective rotatable disk-position idler outer diameter circumference-shapes that are selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each respective selected rotatable disk-position idler outer diameter circumference-shape can have rolling contact with the respective rotatable wire-driven circular workholder disk outer diameter circumference to position-restrain and engage the respective rotatable wire-driven circular workholder disk at a desired location relative to the respective rotatable wire-driven circular disk workholder device apparatus frame;

e) wherein the at least three rotatable wire-driven circular workholder disks respective first and second rotatable wire-driven circular workholder disk rotatable disk-position idlers are position-spaced at locations that are at least 10 degrees of respective rotatable disk-position idlers' separation arc-length apart from each other where the respective rotatable disk-position idlers' separation arc-lengths are measured along the respective rotatable wire-driven circular workholder disk outer diameter circumferences and where the respective rotatable wire-driven circular workholder disk rotatable disk-position idlers are attached to the respective rotatable wire-driven circular disk workholder device apparatus frames at the respective rotatable wire-driven circular workholder disk rotatable disk-position idlers' position-spaced separation arc-length locations and wherein the respective first rotatable wire-driven circular workholder disk rotatable disk-positioning idler is positioned at the respective rotatable wire-driven circular workholder disk outer diameter drive-wire inlet side and the respective second rotatable wire-driven circular workholder disk rotatable disk-positioning idler is positioned at the respective rotatable wire-driven circular workholder disk outer diameter drive-wire outlet side;

f) wherein the at least three each rotatable wire-driven circular workholder disks have a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the flexible drive-wire rotatable motor can be either attached to a rotatable wire-driven circular disk workholder device apparatus frame or attached to the rotatable wire-driven circular disk workholder device abrading machine frame; and g) wherein each of the at least three rotatable wire-driven circular workholder disks has at least two rotatable wire-driven circular workholder disk flexible drive-wire circular rotatable wire-guide idlers that each have a flexible drive-wire circular rotatable wire-guide idler thickness and each have a flexible drive-wire circular rotatable wire-guide idler outer diameter and each have a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a flexible drive-wire circular rotatable wire-guide idler wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the flexible drive-wire circular rotatable wire-guide idler arc-length is measured along the flexible drive-wire circular rotatable wire-guide idler outer diameter circumferences; and h) wherein each of the at least three each rotatable wire-driven circular workholder disk's at least two rotatable wire-driven circular workholder disk flexible drive-wire circular wire-guide idlers are attached to the respective rotatable wire-driven circular disk workholder device apparatus frames wherein a respective rotatable wire-driven circular workholder disk first rotatable wire-driven circular workholder disk flexible drive-wire circular rotatable wire-guide idler is positioned at the respective rotatable wire-driven circular workholder disk outer diameter drive-wire inlet side and a respective rotatable wire-driven circular workholder disk second rotatable wire-driven circular workholder disk flexible drive-wire circular wire-guide idler is positioned at the respective rotatable wire-driven circular workholder disk outer diameter drive-wire outlet side and wherein the respective rotatable wire-driven circular workholder disk first and second rotatable wire-driven rotatable wire-driven circular workholder disk flexible drive-wire circular wire-guide idlers are position-spaced at respective locations that are at least 30 degrees of flexible drive-wire circular rotatable wire-guide idler separation arc-length apart from each other where the flexible drive-wire circular rotatable wire-guide idler separation arc-lengths are measured along the respective rotatable wire-driven circular workholder disk outer diameter circumferences and where the respective rotatable wire-driven circular workholder disk flexible drive-wire circular wire-guide idlers are position-spaced at respective flexible drive-wire circular wire-guide idler separation arc-lengths that are greater than the respective rotatable wire-driven circular workholder disk rotatable disk-position idlers' separation arc-lengths;

i) wherein the rotatable wire-driven circular workholder disk flexible drive-wire can be routed around and in contact with the rotatable wire-driven circular workholder disk flexible drive-wire rotatable motor drive-wire pulley circumference and routed to be in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

j) a wire-tensioning device that applies a wire tension force to the rotatable wire-driven circular workholder disk's flexible drive-wire wherein the rotatable wire-driven circular workholder disk flexible drive-wire urges the at least three rotatable wire-driven circular workholder disks against the respective at least three rotatable wire-driven circular workholder disks' at least two rotatable wire-driven circular workholder disk rotatable disk-positioning idlers;

k) a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and l) wherein the lower rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

m) a floating upper rotatable abrading platen having a flat annular abrading-surface that has an floating upper rotatable abrading platen annular abrading-surface radial width and an floating upper rotatable abrading platen annular abrading-surface inner radius and an floating upper rotatable abrading platen annular abrading-surface outer radius and an floating upper rotatable abrading platen annular abrading-surface outer circumference and where the floating upper rotatable abrading platen is supported by and is rotationally driven about an floating upper rotatable abrading platen rotation axis located at a rotational center of the floating upper rotatable abrading platen by a floating upper rotatable abrading platen spherical-action rotation device located at the rotational center of the floating upper rotatable abrading platen and wherein the upper abrading floating platen spherical-action rotation device allows spherical motion of the floating upper rotatable abrading platen about the floating upper rotatable abrading platen rotational center where the flat annular abrading-surface of the upper rotatable floating abrading platen that is supported by the floating upper rotatable abrading platen spherical-action rotation device is approximately horizontal;

n) wherein the floating upper rotatable abrading platen annular abrading-surface radial width is approximately equal to the lower rotatable abrading platen annular abrading-surface radial width and the floating upper rotatable abrading platen annular abrading-surface outer radius is approximately equal to the lower rotatable abrading platen annular abrading-surface outer radius and the platen annular abrading-surface inner radius is approximately equal to the lower rotatable abrading platen annular abrading-surface inner radius;

o) wherein the upper rotatable platen annular abrading surface is concentric with the lower rotatable platen annular abrading surface and wherein the floating upper rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

p) wherein the at least three rotatable wire-driven circular workholder disks can be positioned where the rotatable wire-driven circular workholder disk center is located on the lower rotatable abrading platen annular abrading-surface centerline and wherein the at least three rotatable wire-driven circular workholder disks can be positioned where at least three rotatable wire-driven circular workholder disks are located with equal spaces between each of them, and workpieces having parallel opposed flat workpiece-top surfaces and flat workpiece-bottom surfaces and the workpieces have workpiece cross-sectional shapes and the workpieces have approximately-equal thicknesses;

q) wherein the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

r) wherein the workpieces having flat workpiece-bottom surfaces can be inserted into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

s) wherein the abrasive surface of the floating upper rotatable abrading platen abrading surface contacts the top flat surfaces of the workpieces with a controlled abrading force that is distributed to the respective flat workpiece-top surfaces of the workpieces contained in the at least three rotatable wire-driven workholder disk devices and wherein the distributed workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface; and t) wherein the flexible drive-wire rotatable motor can be rotated wherein the rotatable wire-driven circular workholder disk flexible drive-wire is moved along the rotatable wire-driven circular workholder disk flexible drive-wire axis to rotate the at least three rotatable wire-driven circular workholder disks about the respective rotatable wire-driven circular workholder disks' centers of rotation wherein the workpieces inserted into the rotatable wire-driven circular workholder disks' open workpiece receptacle-holes are rotated about the respective rotatable wire-driven circular workholder disks' centers of rotation and wherein both the floating upper rotatable abrading platen and the lower rotatable abrading platen are rotated independently to abrade both the flat top and flat bottom surfaces of the flat-surfaced workpieces.

Further, the at least three rotatable wire-driven circular workholder disk device apparatus that can rotate workpieces in flat-surfaced double-sided abrading contact with an upper floating platen and an opposed fixed-position lower platen can each have a rotatable wire-driven circular workholder disk continuous-loop rotatable wire-driven circular workholder disk flexible drive-wire.

Also, the at least three rotatable wire-driven circular workholder disk device apparatus that can rotate workpieces in flat-surfaced double-sided abrading contact with an upper floating platen and an opposed fixed-position lower platen can be configured where the at least three rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the rotatable wire-driven circular workholder disks with the lower abrading platen abrasive coating compromising:

a) a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) where the workholder disk rotatable support-idler device outer diameter circumference-shape can have rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) where the workholder disk rotatable support-idler device is supported by a workholder disk rotatable support-idler device rotation bearing that is attached to the lower rotatable abrading platen at the location of the lower rotatable abrading platen rotation axis wherein the rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces; and d) wherein both the workholder disk rotatable support-idler device and the respective rotatable wire-driven circular workholder disks' at least two rotatable wire-driven circular workholder disk rotatable disk-positioning idlers position-restrain and engage portions of the respective rotatable wire-driven circular workholder disks where the respective rotatable wire-driven circular workholder disks do not contact the lower rotatable abrading platen abrasive coating.

In addition, the at least three rotatable wire-driven circular workholder disk device apparatus that can rotate workpieces in flat-surfaced double-sided abrading contact with an upper floating platen and an opposed fixed-position lower platen can be configured the at least three rotatable wire-driven circular workholder disk device apparatus wire driven workholders can each be translated in a radial direction, or rotated, to and from the lower abrading platen annular abrading surface comprising:

a) where each of the at least three rotatable wire-driven circular workholder disk flexible drive-wire apparatus frames can be translated by a driven workholder disk device apparatus frame mechanical slide apparatus where the respective rotatable wire-driven circular workholder disk device apparatus frames are attached to the respective workholder disk device apparatus frame mechanical slide apparatus and wherein the respective rotatable wire-driven circular workholder disk device apparatus frames can be translated in a radial direction relative to and from the lower rotatable abrading platen annular abrading-surface outer radius wherein the respective rotatable wire-driven circular workholder disk outer diameter circumferences can be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius; or b) where each of the at least three rotatable wire-driven circular workholder disk device apparatus frames can be rotated by a respective driven workholder disk mechanical pivot apparatus where the respective rotatable wire-driven circular workholder disk device apparatus frames are attached to the respective workholder disk device apparatus frame mechanical pivot apparatus and wherein the respective rotatable wire-driven circular workholder disk device apparatus frames can be rotated in a circular direction relative to and from the lower rotatable abrading platen annular abrading-surface outer radius wherein the respective rotatable wire-driven circular workholder disk outer diameter circumferences can be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius.

In addition, the at least three rotatable wire-driven circular workholder disk device apparatus that can rotate workpieces in flat-surfaced double-sided abrading contact with an upper floating platen and an opposed fixed-position lower platen can be configured where the floating upper rotatable abrading platen annular abrading-surface can be aligned to be parallel to the lower rotatable abrading platen annular abrading-surface and wherein the upper abrading floating platen spherical-action rotation device can be rigidly-locked to prevent spherical motion of the floating upper rotatable abrading platen about the floating upper rotatable abrading platen rotational center wherein the flat annular abrading-surface of the upper rotatable floating abrading platen is parallel to the lower rotatable abrading platen annular abrading-surface.

A process is described where the process is of using a rotatable wire-driven circular workholder disk device apparatus for single-sided abrading the bottom flat surfaces of workpieces that are in abrading contact with a rotatable abrading platen comprising:

a) providing an abrading machine frame, providing a rotatable wire-driven circular workholder disk device apparatus frame that is attached to the abrading machine frame and providing a rotatable wire-driven circular workholder disk having rotatable wire-driven circular workholder disk opposed flat disk surfaces where the rotatable wire-driven circular workholder disk has a rotatable wire-driven circular workholder disk center located at a rotational center of the rotatable wire-driven circular workholder disk and the rotatable wire-driven circular workholder disk has a rotatable wire-driven circular workholder disk thickness and the rotatable wire-driven circular disk has a rotatable wire-driven circular workholder disk outer diameter and the rotatable wire-driven circular workholder disk has a rotatable wire-driven circular workholder disk outer diameter circumference;

b) providing a rotatable wire-driven circular workholder disk flexible drive-wire having a flexible drive-wire length and the flexible drive-wire has a flexible drive-wire cross-section shape that has a flexible drive-wire centroid wherein the flexible drive-wire has a flexible drive-wire axis that intersects the flexible drive-wire cross-section shape centroid and where the flexible drive-wire axis extends along length-segments of the flexible drive-wire length and where the flexible drive-wire is selected from the group consisting of metal wires, polymer monofilaments, braided, twisted or woven polymer strands, braided, twisted or woven organic material strands and braided, twisted or woven metal strands;

c) providing that the rotatable wire-driven circular workholder disk outer diameter circumference has a drive-wire groove that is formed in the rotatable wire-driven circular workholder disk thickness where the drive-wire groove extends around the rotatable wire-driven circular workholder disk outer diameter circumference where the rotatable wire-driven circular workholder disk outer diameter circumference drive-wire groove has a drive-wire groove shape that is configured to restrain and guide a rotatable wire-driven circular workholder disk flexible drive-wire that contacts at least thirty degrees of circular arc-length of the rotatable wire-driven circular workholder disk outer diameter circumference and where the rotatable wire-driven circular workholder disk has a rotatable wire-driven circular workholder disk outer diameter drive-wire inlet side and the rotatable wire-driven circular workholder disk has a rotatable wire-driven circular workholder disk outer diameter drive-wire outlet side;

d) positioning the rotatable wire-driven circular workholder disk at a fixed location relative to the rotatable wire-driven circular disk workholder device apparatus frame by use of at least two rotatable wire-driven circular workholder disk rotatable disk-positioning idlers having rotatable disk-position idlers' outer diameters where the rotatable disk-position idlers have rotatable disk-position idler outer diameter circumferences that have a rotatable disk-position idler outer diameter circumference-shape that is selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each selected rotatable disk-position idler outer diameter circumference-shape can have rolling contact with the rotatable wire-driven circular workholder disk outer diameter circumference to position-restrain and engage the rotatable wire-driven circular workholder disk at a desired location relative to the rotatable wire-driven circular disk workholder device apparatus frame;

e) providing that a first and a second rotatable wire-driven circular workholder disk rotatable disk-position idlers are position-spaced at locations that are at least 10 degrees of rotatable disk-position idlers' separation arc-length apart from each other where the rotatable disk-position idlers' separation arc-length is measured along the rotatable wire-driven circular workholder disk outer diameter circumference and where the rotatable wire-driven circular workholder disk rotatable disk-position idlers are attached to the rotatable wire-driven circular disk workholder device apparatus frame at the respective rotatable wire-driven circular workholder disk rotatable disk-position idlers' position-spaced separation arc-length locations and wherein the first rotatable wire-driven circular workholder disk rotatable disk-positioning idler is positioned at the rotatable wire-driven circular workholder disk outer diameter drive-wire inlet side and the second rotatable wire-driven circular workholder disk rotatable disk-positioning idler is positioned at the rotatable wire-driven circular workholder disk outer diameter drive-wire outlet side;

f) providing a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the rotatable wire-driven circular workholder disk flexible drive-wire rotatable motor can be either attached to the rotatable wire-driven circular disk workholder device apparatus frame or attached to the rotatable wire-driven circular disk workholder device abrading machine frame; and g) providing at least two rotatable wire-driven circular workholder disk flexible drive-wire circular rotatable wire-guide idlers that each have a flexible drive-wire circular rotatable wire-guide idler thickness and each flexible drive-wire circular rotatable wire-guide idler has a flexible drive-wire circular rotatable wire-guide idler outer diameter and each flexible drive-wire circular rotatable wire-guide idler has a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the rotatable wire-guide idler arc-length is measured along the flexible drive-wire circular rotatable wire-guide idler outer diameter circumferences; and h) providing that the at least two rotatable wire-driven circular workholder disk flexible drive-wire circular rotatable wire-guide idlers are attached to the rotatable wire-driven circular disk workholder device apparatus frame wherein a first rotatable wire-driven circular workholder disk flexible drive-wire circular rotatable wire-guide idler is positioned at the rotatable wire-driven circular workholder disk outer diameter drive-wire inlet side and a second rotatable wire-driven circular workholder disk flexible drive-wire circular rotatable wire-guide idler is positioned at the rotatable wire-driven circular workholder disk outer diameter drive-wire outlet side and wherein the first and second rotatable wire-driven rotatable wire-driven circular workholder disk flexible drive-wire circular rotatable wire-guide idlers are position-spaced at locations that are at least 30 degrees of wire-guide idler separation arc-length apart from each other where the flexible drive-wire circular rotatable wire-guide idler separation arc-length is measured along the rotatable wire-driven circular workholder disk outer diameter circumference and where the rotatable wire-driven circular workholder disk flexible drive-wire circular rotatable wire-guide idlers are position-spaced at flexible drive-wire circular rotatable wire-guide idler separation arc-lengths that are greater than the rotatable wire-driven circular workholder disk rotatable disk-position idlers' separation arc-lengths;

i) routing the respective rotatable wire-driven circular workholder disk flexible drive-wire around and in contact with the rotatable wire-driven circular workholder disk flexible drive-wire rotatable motor drive-wire pulley circumference and routing it to be in contact with at least a first rotatable wire-driven circular workholder disk flexible drive-wire circular rotatable wire-guide idler circumference and routing it to be in contact with the rotatable wire-driven circular workholder disk circumference and routing it to be in contact with at least a second rotatable wire-driven circular workholder disk flexible drive-wire circular rotatable wire-guide idler circumference and routing it back to and in contact with the rotatable wire-driven circular workholder disk flexible drive-wire rotatable motor drive-wire pulley circumference;

j) providing that the rotatable wire-driven circular workholder disk flexible drive-wire are routed around and in contact with the rotatable wire-driven circular workholder disk flexible drive-wire rotatable motor drive-wire pulley circumference and routed to be in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

k) providing a wire-tensioning device that applies a wire tension force to the rotatable wire-driven circular workholder disk's flexible drive-wire wherein the respective rotatable wire-driven circular workholder disk flexible drive-wire urges the rotatable wire-driven circular workholder disk against the at least two rotatable wire-driven circular workholder disk rotatable disk-positioning idlers;

l) providing a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and m) providing that the lower rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

n) positioning the rotatable wire-driven circular workholder disk where the rotatable wire-driven circular workholder disk center is located on the lower rotatable abrading platen annular abrading-surface centerline, providing workpieces having parallel opposed flat workpiece-top surfaces and flat workpiece-bottom surfaces and the workpieces have workpiece cross-sectional shapes and the workpieces have approximately-equal thicknesses;

o) providing that the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

p) inserting the workpieces having flat workpiece-bottom surfaces into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

q) applying controlled workpiece abrading forces to the respective workpieces' flat workpiece-top surfaces by placing weights on the workpieces' flat workpiece-top surfaces or by applying abrading forces to the workpieces' flat workpiece-top surfaces wherein the controlled workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface; and r) rotating the flexible drive-wire rotatable motor wherein the rotatable wire-driven circular workholder disk flexible drive-wire is moved along the rotatable wire-driven circular workholder disk flexible drive-wire axis to rotate the rotatable wire-driven circular workholder disk about the rotatable wire-driven circular workholder disk's center of rotation wherein the workpieces inserted into the rotatable wire-driven circular workholder disk's open workpiece receptacle-holes are rotated about the rotatable wire-driven circular workholder disk's center of rotation and wherein the lower rotatable abrading platen is rotated to single-sided abrade the workpiece-bottom surfaces.

Also, the process is described where the process is of using a rotatable wire-driven circular workholder disk device apparatus for single-sided abrading the bottom flat surfaces of workpieces that are in abrading contact with a rotatable abrading platen where the rotatable wire-driven circular workholder disk flexible drive-wire wire is a continuous-loop rotatable wire-driven circular workholder disk flexible drive-wire.

Further, the process is described where the process is of using a rotatable wire-driven circular workholder disk device apparatus for single-sided abrading the bottom flat surfaces of workpieces that are in abrading contact with a rotatable abrading platen where multiple rotatable wire-driven circular workholder disks are provided where components consisting of more than one rotatable wire-driven workholder disk device apparatus frame, more than one rotatable wire-driven circular workholder disk, a rotatable wire-driven circular workholder disk flexible drive-wire or more than one rotatable wire-driven circular workholder disk flexible drive-wire, respective more than one set of first and second rotatable wire-driven circular workholder disk rotatable disk-positioning idlers, respective more than one set of first and second rotatable wire-driven circular workholder disk flexible drive-wire circular rotatable wire-guide idlers, a rotatable wire-driven circular workholder disk flexible drive-wire rotatable motor or more than one rotatable wire-driven circular workholder disk flexible drive-wire rotatable motor, a wire-tensioning device or multiple wire-tensioning devices that applies a wire tension force or wire tension forces to the respective rotatable wire-driven circular workholder disk's flexible drive-wire or rotatable wire-driven circular workholder disk's flexible drive-wires where these components are attached to the abrading machine frame to provide multiple rotatable wire-driven circular workholder disks that can be positioned where the respective rotatable wire-driven circular workholder disk centers are located on the rotatable abrading platen annular abrading-surface centerline and wherein the multiple rotatable wire-driven circular workholder disks' flexible drive-wires have a flexible drive-wire length or a flexible drive-wire continuous-loop.

In addition, the process where the multiple rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the multiple rotatable wire-driven circular workholder disks with the lower abrading platen abrasive coating compromising:

a) providing a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) providing that the workholder disk rotatable support-idler device outer diameter circumference-shape can have rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) providing that the workholder disk rotatable support-idler device is supported by a workholder disk rotatable support-idler device rotation bearing that is attached to the lower rotatable abrading platen at the location of the lower rotatable abrading platen rotation axis;

d) providing that the multiple rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces;

e) providing that both the workholder disk rotatable support-idler device and the multiple respective rotatable wire-driven circular workholder disks' at least two rotatable wire-driven circular workholder disk rotatable disk-positioning idlers position-restrain and engage portions of the respective rotatable wire-driven circular workholder disks where the multiple respective rotatable wire-driven circular workholder disks do not contact the lower rotatable abrading platen abrasive coating.

In another embodiment, a process is described where the process is of using a rotatable wire-driven circular workholder disk device apparatus for single-sided abrading the bottom flat surfaces of workpieces that are in abrading contact with a rotatable abrading where the rotatable wire-driven circular workholder disk device apparatus can be translated in a radial direction, or rotated, to and from the lower abrading platen annular abrading surface comprising:

a) providing that the rotatable wire-driven circular workholder disk flexible drive-wire apparatus frame is translated by a driven workholder disk device apparatus frame mechanical slide apparatus where the respective rotatable wire-driven circular workholder disk device apparatus frame is attached to the workholder disk device apparatus frame mechanical slide apparatus and wherein the respective rotatable wire-driven circular workholder disk device apparatus frames can be translated in a radial direction relative to and from the lower rotatable abrading platen annular abrading-surface outer radius wherein the rotatable wire-driven circular workholder disk outer diameter circumferences can be outwardly positioned relative to the lower rotatable abrading platen annular abrading-surface outer radius wherein the rotatable wire-driven circular workholder disk outer diameter circumference has a positional-gap between the rotatable wire-driven circular workholder disk outer diameter circumference and the lower rotatable abrading platen annular abrading-surface outer radius; or b) where the rotatable wire-driven circular workholder disk device apparatus frame can be rotated by a driven workholder disk mechanical pivot apparatus where the rotatable wire-driven circular workholder disk device apparatus frame is attached to the workholder disk device apparatus frame mechanical pivot apparatus and wherein the rotatable wire-driven circular workholder disk device apparatus frame can be rotated in a circular direction relative to and from the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional-gap between the rotatable wire-driven circular workholder disk outer diameter circumference and the lower rotatable abrading platen annular abrading-surface outer radius.

In a further embodiment, a process is described of using an at least three rotatable wire-driven circular workholder disk device apparatus that can rotate workpieces in flat-surfaced double-sided abrading contact with an upper floating platen and an opposed fixed-position lower platen comprising:

a) providing an abrading machine frame;

b) providing at least three rotatable wire-driven circular workholder disk device apparatus frames that are attached to the abrading machine frame;

c) providing at least three rotatable wire-driven circular workholder disks having respective rotatable wire-driven circular workholder disk opposed flat disk surfaces where each respective rotatable wire-driven circular workholder disk has a rotatable wire-driven circular workholder disk center located at a rotational center of the respective rotatable wire-driven circular workholder disk and each respective rotatable wire-driven circular workholder disk has a rotatable wire-driven circular workholder disk thickness and each respective rotatable wire-driven circular disk has a rotatable wire-driven circular workholder disk outer diameter and each respective rotatable wire-driven circular workholder disk has a rotatable wire-driven circular workholder disk outer diameter circumference;

d) providing a rotatable wire-driven circular workholder disk flexible drive-wire where the flexible drive-wire has a flexible drive-wire length and the flexible drive-wire has a flexible drive-wire cross-section shape that has a flexible drive-wire centroid wherein the flexible drive-wire has a flexible drive-wire axis that intersects the respective flexible drive-wire cross-section shape centroid and where the flexible drive-wire axis extends along length-segments of the respective flexible drive-wire length and where the flexible drive-wire is selected from the group consisting of metal wires, polymer monofilaments, braided, twisted or woven polymer strands, braided, twisted or woven organic material strands and braided, twisted or woven metal strands;

e) providing that each respective rotatable wire-driven circular workholder disk outer diameter circumference has a drive-wire groove that is formed in the respective rotatable wire-driven circular workholder disk thickness where the respective drive-wire groove extends around the respective rotatable wire-driven circular workholder disk's outer diameter circumference where the respective rotatable wire-driven circular workholder disk outer diameter circumference drive-wire groove has a respective drive-wire groove shape that is configured to restrain and guide a rotatable wire-driven circular workholder disk flexible drive-wire that contacts at least thirty degrees of circular arc-length of each respective rotatable wire-driven circular workholder disk outer diameter circumference and where each respective rotatable wire-driven circular workholder disk has a respective rotatable wire-driven circular workholder disk outer diameter drive-wire inlet side and each respective rotatable wire-driven circular workholder disk has a respective rotatable wire-driven circular workholder disk outer diameter drive-wire outlet side;

f) providing that the at least three rotatable wire-driven circular workholder disks are each positioned at fixed locations relative to the respective rotatable wire-driven circular disk workholder device apparatus frame by use of respective at least two respective rotatable wire-driven circular workholder disk rotatable disk-positioning idlers having respective rotatable disk-position idlers' outer diameters where the respective rotatable disk-position idlers have respective rotatable disk-position idler outer diameter circumferences that have respective rotatable disk-position idler outer diameter circumference-shapes that are selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each respective selected rotatable disk-position idler outer diameter circumference-shape have rolling contact with the respective rotatable wire-driven circular workholder disk outer diameter circumference to position-restrain and engage the respective rotatable wire-driven circular workholder disk at a desired location relative to the respective rotatable wire-driven circular disk workholder device apparatus frame;

g) providing that the at least three rotatable wire-driven circular workholder disks respective first and second rotatable wire-driven circular workholder disk rotatable disk-position idlers are position-spaced at locations that are at least 10 degrees of respective rotatable disk-position idlers' separation arc-length apart from each other where the respective rotatable disk-position idlers' separation arc-lengths are measured along the respective rotatable wire-driven circular workholder disk outer diameter circumferences and where the respective rotatable wire-driven circular workholder disk rotatable disk-position idlers are attached to the respective rotatable wire-driven circular disk workholder device apparatus frames at the respective rotatable wire-driven circular workholder disk rotatable disk-position idlers' position-spaced separation arc-length locations and wherein the respective first rotatable wire-driven circular workholder disk rotatable disk-positioning idler is positioned at the respective rotatable wire-driven circular workholder disk outer diameter drive-wire inlet side and the respective second rotatable wire-driven circular workholder disk rotatable disk-positioning idler is positioned at the respective rotatable wire-driven circular workholder disk outer diameter drive-wire outlet side;

h) providing that the at least three each rotatable wire-driven circular workholder disks have a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the flexible drive-wire rotatable motor can be either attached to a rotatable wire-driven circular disk workholder device apparatus frame or attached to the rotatable wire-driven circular disk workholder device abrading machine frame; and i) providing that each of the at least three rotatable wire-driven circular workholder disks has at least two rotatable wire-driven circular workholder disk flexible drive-wire circular rotatable wire-guide idlers that each have a flexible drive-wire circular rotatable wire-guide idler thickness and each have a flexible drive-wire circular rotatable wire-guide idler outer diameter and each have a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a flexible drive-wire circular rotatable wire-guide idler wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the flexible drive-wire circular rotatable wire-guide idler arc-length is measured along the flexible drive-wire circular rotatable wire-guide idler outer diameter circumferences; and j) providing that each of the at least three each rotatable wire-driven circular workholder disk's at least two rotatable wire-driven circular workholder disk flexible drive-wire circular wire-guide idlers are attached to the respective rotatable wire-driven circular disk workholder device apparatus frames wherein a respective rotatable wire-driven circular workholder disk first rotatable wire-driven circular workholder disk flexible drive-wire circular rotatable wire-guide idler is positioned at the respective rotatable wire-driven circular workholder disk outer diameter drive-wire inlet side and a respective rotatable wire-driven circular workholder disk second rotatable wire-driven circular workholder disk flexible drive-wire circular wire-guide idler is positioned at the respective rotatable wire-driven circular workholder disk outer diameter drive-wire outlet side and wherein the respective rotatable wire-driven circular workholder disk first and second rotatable wire-driven rotatable wire-driven circular workholder disk flexible drive-wire circular wire-guide idlers are position-spaced at respective locations that are at least 30 degrees of flexible drive-wire circular rotatable wire-guide idler separation arc-length apart from each other where the flexible drive-wire circular rotatable wire-guide idler separation arc-lengths are measured along the respective rotatable wire-driven circular workholder disk outer diameter circumferences and where the respective rotatable wire-driven circular workholder disk flexible drive-wire circular wire-guide idlers are position-spaced at respective flexible drive-wire circular wire-guide idler separation arc-lengths that are greater than the respective rotatable wire-driven circular workholder disk rotatable disk-position idlers' separation arc-lengths;

k) providing that the rotatable wire-driven circular workholder disk flexible drive-wire can be routed around and in contact with the rotatable wire-driven circular workholder disk flexible drive-wire rotatable motor drive-wire pulley circumference and routed to be in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

l) providing a wire-tensioning device that applies a wire tension force to the rotatable wire-driven circular workholder disk's flexible drive-wire wherein the rotatable wire-driven circular workholder disk flexible drive-wire urges the at least three rotatable wire-driven circular workholder disks against the respective at least three rotatable wire-driven circular workholder disks' at least two rotatable wire-driven circular workholder disk rotatable disk-positioning idlers;

m) providing a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and n) providing that the lower rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

o) providing a floating upper rotatable abrading platen having a flat annular abrading-surface that has an floating upper rotatable abrading platen annular abrading-surface radial width and an floating upper rotatable abrading platen annular abrading-surface inner radius and an floating upper rotatable abrading platen annular abrading-surface outer radius and an floating upper rotatable abrading platen annular abrading-surface outer circumference and where the floating upper rotatable abrading platen is supported by and is rotationally driven about an floating upper rotatable abrading platen rotation axis located at a rotational center of the floating upper rotatable abrading platen by a floating upper rotatable abrading platen spherical-action rotation device located at the rotational center of the floating upper rotatable abrading platen and wherein the upper abrading floating platen spherical-action rotation device allows spherical motion of the floating upper rotatable abrading platen about the floating upper rotatable abrading platen rotational center where the flat annular abrading-surface of the upper rotatable floating abrading platen that is supported by the floating upper rotatable abrading platen spherical-action rotation device is approximately horizontal;

p) providing that the floating upper rotatable abrading platen annular abrading-surface radial width is approximately equal to the lower rotatable abrading platen annular abrading-surface radial width and the floating upper rotatable abrading platen annular abrading-surface outer radius is approximately equal to the lower rotatable abrading platen annular abrading-surface outer radius and the platen annular abrading-surface inner radius is approximately equal to the lower rotatable abrading platen annular abrading-surface inner radius;

q) aligning the upper rotatable platen annular abrading surface to be concentric with the lower rotatable platen annular abrading surface;

r) providing that the floating upper rotatable abrading platen approximately horizontal flat annular abrading-surface has an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

s) providing that the at least three rotatable wire-driven circular workholder disks is positioned where the rotatable wire-driven circular workholder disk center is located on the lower rotatable abrading platen annular abrading-surface centerline and wherein the at least three rotatable wire-driven circular workholder disks is positioned where at least three rotatable wire-driven circular workholder disks are located with equal spaces between each of them;

t) providing workpieces having parallel opposed flat workpiece-top surfaces and flat workpiece-bottom surfaces and the workpieces have workpiece cross-sectional shapes and the workpieces have approximately-equal thicknesses;

u) providing that the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

v) inserting the workpieces having flat workpiece-bottom surfaces into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

x) providing that the abrasive surface of the floating upper rotatable abrading platen abrading surface contacts the top flat surfaces of the workpieces with a controlled abrading force that is distributed to the respective flat workpiece-top surfaces of the workpieces contained in the at least three rotatable wire-driven workholder disk devices and wherein the distributed workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface;

y) providing that the flexible drive-wire rotatable motor can be rotated wherein the rotatable wire-driven circular workholder disk flexible drive-wire is moved along the rotatable wire-driven circular workholder disk flexible drive-wire axis to rotate the at least three rotatable wire-driven circular workholder disks about the respective rotatable wire-driven circular workholder disks' centers of rotation wherein the workpieces inserted into the rotatable wire-driven circular workholder disks' open workpiece receptacle-holes are rotated about the respective rotatable wire-driven circular workholder disks' centers of rotation and wherein both the floating upper rotatable abrading platen and the lower rotatable abrading platen are rotated independently to abrade both the flat top and flat bottom surfaces of the flat-surfaced workpieces.

In an additional embodiment, a process is described of using at least three rotatable wire-driven circular workholder disk device apparatus that can rotate workpieces in flat-surfaced double-sided abrading contact with an upper floating platen and an opposed fixed-position lower platen where the respective at least three rotatable wire-driven circular workholder disk device apparatus that can rotate workpieces each have a rotatable wire-driven circular workholder disk flexible continuous-loop rotatable wire-driven circular workholder disk flexible drive-wire.

In a further embodiment, a process is described of using an at least three rotatable wire-driven circular workholder disk device apparatus that can rotate workpieces in flat-surfaced double-sided abrading contact with an upper floating platen and an opposed fixed-position lower platen where the at least three rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the rotatable wire-driven circular workholder disks with the lower abrading platen abrasive coating compromising:

a) providing a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) providing that the workholder disk rotatable support-idler device outer diameter circumference-shape can have rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) providing that the workholder disk rotatable support-idler device is supported by a workholder disk rotatable support-idler device rotation bearing that is attached to the lower rotatable abrading platen at the location of the lower rotatable abrading platen rotation axis;

d) providing that the rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces;

e) providing that both the workholder disk rotatable support-idler device and the respective rotatable wire-driven circular workholder disks' at least two rotatable wire-driven circular workholder disk rotatable disk-positioning idlers position-restrain and engage portions of the respective rotatable wire-driven circular workholder disks where the respective rotatable wire-driven circular workholder disks do not contact the lower rotatable abrading platen abrasive coating.

An additional embodiment is a process is described of using an at least three rotatable wire-driven circular workholder disk device apparatus that can rotate workpieces in flat-surfaced double-sided abrading contact with an upper floating platen and an opposed fixed-position lower platen where the at least three rotatable wire-driven circular workholder disk device apparatus wire driven workholders can each be translated in a radial direction, or rotated, to and from the lower abrading platen annular abrading surface comprising:

a) providing that each of the at least three rotatable wire-driven circular workholder disk flexible drive-wire apparatus frames can be translated by a driven workholder disk device apparatus frame mechanical slide apparatus where the respective rotatable wire-driven circular workholder disk device apparatus frames are attached to the respective workholder disk device apparatus frame mechanical slide apparatus and wherein the respective rotatable wire-driven circular workholder disk device apparatus frames can be translated in a radial direction relative to and from the lower rotatable abrading platen annular abrading-surface outer radius wherein the respective rotatable wire-driven circular workholder disk outer diameter circumferences can be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius; or b) providing that each of the at least three rotatable wire-driven circular workholder disk device apparatus frames can be rotated by a respective driven workholder disk mechanical pivot apparatus where the respective rotatable wire-driven circular workholder disk device apparatus frames are attached to the respective workholder disk device apparatus frame mechanical pivot apparatus and wherein the respective rotatable wire-driven circular workholder disk device apparatus frames can be rotated in a circular direction relative to and from the lower rotatable abrading platen annular abrading-surface outer radius wherein the respective rotatable wire-driven circular workholder disk outer diameter circumferences can be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius.

In another embodiment, a process is described of using an at least three rotatable wire-driven circular workholder disk device apparatus that can rotate workpieces in flat-surfaced double-sided abrading contact with an upper floating platen and an opposed fixed-position lower platen where the floating upper rotatable abrading platen annular abrading-surface can be aligned to be parallel to the lower rotatable abrading platen annular abrading-surface and wherein the upper abrading floating platen spherical-action rotation device can be rigidly-locked to prevent spherical motion of the floating upper rotatable abrading platen about the floating upper rotatable abrading platen rotational center wherein the flat annular abrading-surface of the upper rotatable floating abrading platen is parallel to the lower rotatable abrading platen annular abrading-surface.

What is claimed:

1. A rotatable wire-driven circular workholder disk device apparatus that rotates workpieces in flat-surfaced single-sided abrading contact with a rotating abrading platen, the apparatus comprising:

a) an abrading machine frame;

b) a rotatable, wire-driven circular workholder disk device apparatus frame attached to the abrading machine frame;

c) a rotatable wire-driven circular workholder disk having rotatable wire-driven circular workholder disk opposed flat disk surfaces where the rotatable wire-driven circular workholder disk has a rotatable wire-driven circular workholder disk center located at a rotational center of the rotatable wire-driven circular workholder disk and the rotatable wire-driven circular workholder disk has a rotatable wire-driven circular workholder disk thickness and the rotatable wire-driven circular disk has a rotatable wire-driven circular workholder disk outer diameter and a rotatable wire-driven circular workholder disk outer diameter circumference;

d) a rotatable wire-driven circular workholder disk flexible drive-wire having a flexible drive-wire length and the flexible drive-wire has a flexible drive-wire cross-section shape that has a flexible drive-wire centroid wherein the flexible drive-wire has a flexible drive-wire axis that intersects the flexible drive-wire cross-section shape centroid and where the flexible drive-wire axis extends along length-segments of the flexible drive-wire length and where the flexible drive-wire is selected from the group consisting of metal wires, polymer monofilaments, braided, twisted or woven polymer strands, braided, twisted or woven organic material strands and braided, twisted or woven metal strands;

e) wherein the rotatable wire-driven circular workholder disk outer diameter circumference has a drive-wire groove in the rotatable wire-driven circular workholder disk thickness where the drive-wire groove extends around the rotatable wire-driven circular workholder disk outer diameter circumference where the rotatable wire-driven circular workholder disk outer diameter circumference drive-wire groove has a drive-wire groove shape that is configured to restrain and guide a rotatable wire-driven circular workholder disk flexible drive-wire that contacts at least thirty degrees of circular arc-length of the rotatable wire-driven circular workholder disk outer diameter circumference and where the rotatable wire-driven circular workholder disk has a rotatable wire-driven circular workholder disk outer diameter drive-wire inlet side and the rotatable wire-driven circular workholder disk has a rotatable wire-driven circular workholder disk outer diameter drive-wire outlet side;

f) wherein the rotatable wire-driven circular workholder disk is positioned at a fixed location relative to the rotatable wire-driven circular disk workholder device apparatus frame by at least two rotatable wire-driven circular workholder disk rotatable disk-positioning idlers having rotatable disk-position idlers' outer diameters where the rotatable disk-position idlers have rotatable disk-position idler outer diameter circumferences that have a rotatable disk-position idler outer diameter circumference-shape that is selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each selected rotatable disk-position idler outer diameter circumference-shape has rolling contact with the rotatable wire-driven circular workholder disk outer diameter circumference to position-restrain and engage the rotatable wire-driven circular workholder disk at a desired location relative to the rotatable wire-driven circular disk workholder device apparatus frame;

g) wherein a first and a second rotatable wire-driven circular workholder disk rotatable disk-position idlers are position-spaced at locations that are at least 10 degrees of rotatable disk-position idlers' separation arc-length apart from each other where the rotatable disk-position idlers' separation arc-length is measured along the rotatable wire-driven circular workholder disk outer diameter circumference and where the rotatable wire-driven circular workholder disk rotatable disk-position idlers are attached to the rotatable wire-driven circular disk workholder device apparatus frame at the respective rotatable wire-driven circular workholder disk rotatable disk-position idlers' position-spaced separation arc-length locations and wherein the first rotatable wire-driven circular workholder disk rotatable disk-positioning idler is positioned at the rotatable wire-driven circular workholder disk outer diameter drive-wire inlet side and the second rotatable wire-driven circular workholder disk rotatable disk-positioning idler is positioned at the rotatable wire-driven circular workholder disk outer diameter drive-wire outlet side;

h) a flexible drive-wire motor having a flexible drive-wire motor with a rotatable motor drive-shaft where a flexible drive-wire motor rotatable flexible drive-wire motor pulley is attached to the flexible drive-wire motor rotatable drive-shaft where the flexible drive-wire motor pulley has a flexible drive-wire motor pulley outer diameter where the flexible drive-wire motor pulley has a rotatable flexible drive-wire motor pulley outer diameter circumference and where the flexible drive-wire motor pulley has a flexible drive-wire-contact surface that is configured to restrain and guide a rotatable wire-driven circular workholder disk flexible drive-wire that contacts at least thirty degrees of arc-length of the drive-wire motor pulley outer diameter circumference where the drive-wire motor pulley arc-length is measured along the drive-wire motor pulley outer diameter circumference and wherein the rotatable wire-driven circular workholder disk flexible drive-wire motor can be either attached to the rotatable wire-driven circular disk workholder device apparatus frame or attached to the rotatable wire-driven circular disk workholder device abrading machine frame; and i) at least two rotatable wire-driven circular workholder disk flexible drive-wire circular rotatable wire-guide idlers that each have a flexible drive-wire circular rotatable wire-guide idler thickness and each flexible drive-wire circular rotatable wire-guide idler has a flexible drive-wire circular rotatable wire-guide idler outer diameter and each flexible drive-wire circular rotatable wire-guide idler has a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the rotatable wire-guide idler arc-length is measured along the flexible drive-wire circular rotatable wire-guide idler outer diameter circumferences; and j) wherein the at least two rotatable wire-driven circular workholder disk flexible drive-wire circular rotatable wire-guide idlers are attached to the rotatable wire-driven circular disk workholder device apparatus frame wherein a first rotatable wire-driven circular workholder disk flexible drive-wire circular rotatable wire-guide idler is positioned at the rotatable wire-driven circular workholder disk outer diameter drive-wire inlet side and a second rotatable wire-driven circular workholder disk flexible drive-wire circular rotatable wire-guide idler is positioned at the rotatable wire-driven circular workholder disk outer diameter drive-wire outlet side and wherein the first and second rotatable wire-driven rotatable wire-driven circular workholder disk flexible drive-wire circular rotatable wire-guide idlers are position-spaced at locations that are at least 30 degrees of wire-guide idler separation arc-length apart from each other where the flexible drive-wire circular rotatable wire-guide idler separation arc-length is measured along the rotatable wire-driven circular workholder disk outer diameter circumference and where the rotatable wire-driven circular workholder disk flexible drive-wire circular rotatable wire-guide idlers are position-spaced at flexible drive-wire circular rotatable wire-guide idler separation arc-lengths that are greater than the rotatable wire-driven circular workholder disk rotatable disk-position idlers' separation arc-lengths;

k) wherein the respective rotatable wire-driven circular workholder disk flexible drive-wire are routed around and in contact with the rotatable wire-driven circular workholder disk flexible drive-wire rotatable motor drive-wire pulley circumference and routed to be in contact with at least a first rotatable wire-driven circular workholder disk flexible drive-wire circular rotatable wire-guide idler circumference and routed to be in contact with the rotatable wire-driven circular workholder disk circumference and routed to be in contact with at least a second rotatable wire-driven circular workholder disk flexible drive-wire circular rotatable wire-guide idler circumference and routed back to and in contact with the rotatable wire-driven circular workholder disk flexible drive-wire motor drive-wire pulley circumference;

l) a wire-tensioning device that applies a wire tension force to the rotatable wire-driven circular workholder disk's flexible drive-wire wherein the respective rotatable wire-driven circular workholder disk flexible drive-wire urges the rotatable wire-driven circular workholder disk against the at least two rotatable wire-driven circular workholder disk rotatable disk-positioning idlers;

m) a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and n) wherein the lower rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

o) wherein the rotatable wire-driven circular workholder disk is positioned where the rotatable wire-driven circular workholder disk center is located on the lower rotatable abrading platen annular abrading-surface centerline;

p) workpieces having parallel opposed flat workpiece-top surfaces and flat workpiece-bottom surfaces and the workpieces have workpiece cross-sectional shapes and the workpieces have approximately-equal thicknesses;

q) wherein the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

r) wherein the workpieces having flat workpiece-bottom surfaces can be inserted into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

s) wherein controlled workpiece abrading forces are applied to the respective workpieces' flat workpiece-top surfaces by weights on the workpieces' flat workpiece-top surfaces or application of abrading forces to the workpieces' flat workpiece-top surfaces wherein the controlled workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface;

t) wherein the flexible drive-wire motor rotatable drive shaft can be rotated wherein the rotatable wire-driven circular workholder disk flexible drive-wire is moved along the rotatable wire-driven circular workholder disk flexible drive-wire axis to rotate the rotatable wire-driven circular workholder disk about the rotatable wire-driven circular workholder disk's center of rotation wherein the workpieces inserted into the rotatable wire-driven circular workholder disk's open workpiece receptacle-holes are rotated about the rotatable wire-driven circular workholder disk's center of rotation and wherein the lower rotatable abrading platen can be rotated to single-sided abrade the workpiece-bottom surfaces.

2. The apparatus of claim 1 where the rotatable wire-driven circular workholder disk flexible drive-wire is a continuous-loop rotatable wire-driven circular workholder disk flexible drive-wire.

3. The apparatus of claim 1 having multiple rotatable wire-driven circular workholder disks where components consist essentially of a) more than one rotatable wire-driven workholder disk device apparatus frame, b) more than one rotatable wire-driven circular workholder disk, c) at least one rotatable wire-driven circular workholder disk flexible drive-wire, d) respective more than one set of first and second rotatable wire-driven circular workholder disk rotatable disk-positioning idlers, e) respective more than one set of first and second rotatable wire-driven circular workholder disk flexible drive-wire circular rotatable wire-guide idlers, f) at least one rotatable wire-driven circular workholder disk flexible drive-wire motor, g) at least one wire-tensioning device that applies wire tension force to the respective rotatable wire-driven circular workholder disk's flexible drive-wire or rotatable wire-driven circular workholder disk's flexible drive-wires, where these components are attached to the abrading machine frame to provide multiple rotatable wire-driven circular workholder disks positionable where the respective rotatable wire-driven circular workholder disk centers are located on the rotatable abrading platen annular abrading-surface centerline and wherein the multiple rotatable wire-driven circular workholder disks' flexible drive-wires have a flexible drive-wire length or a flexible drive-wire continuous-loop.

4. The apparatus of claim 3 where the rotatable wire-driven circular workholder disks are supported by a lower rotatable abrading platen annular abrading-surface inner radius workholder disk rotatable support-idler device and the rotatable wire-driven circular workholder disks are also supported by respective at least two rotatable wire-driven circular workholder disk rotatable disk-positioning idlers that together prevent contact of the rotatable wire-driven circular workholder disks with the lower abrading platen abrasive coating comprising:

a) a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) where the workholder disk rotatable support-idler device outer diameter circumference-shape has rolling contact with the respective rotatable wire-driven circular workholder disks' outer diameter circumferences to position, restrain and engage portions of the respective rotatable wire-driven circular workholder disks in a restraint direction that is perpendicular to respective rotatable wire-driven circular workholder disks' flat disk surfaces;

c) where the workholder disk rotatable support-idler device is supported by a workholder disk rotatable support-idler device rotation bearing attached to the lower rotatable abrading platen at the location of the lower rotatable abrading platen rotation axis;

d) wherein the rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces;

e) wherein both the workholder disk rotatable support-idler device and the respective rotatable wire-driven circular workholder disks' at least two rotatable wire-driven circular workholder disk rotatable disk-positioning idlers position, restrain and engage portions of the respective rotatable wire-driven circular workholder disks where the respective rotatable wire-driven circular workholder disks do not contact the lower rotatable abrading platen abrasive coating.

5. The apparatus of claim 1 where the wire-driven circular workholder disk device apparatus frame can be translated in a radial direction or rotated away from the lower abrading platen annular abrading surface comprising:

a) where the rotatable wire-driven circular workholder disk device apparatus frame can be translated by a driven workholder disk device apparatus frame mechanical slide apparatus where the rotatable wire-driven circular workholder disk device apparatus frame is attached to the workholder disk device apparatus frame mechanical slide apparatus and wherein the rotatable wire-driven circular workholder disk device apparatus frame can be translated in a radial direction relative to and from the to the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional gap between the rotatable wire-driven circular workholder disk outer diameter circumference and the lower rotatable abrading platen annular abrading-surface outer radius; or b) where the rotatable wire-driven circular workholder disk device apparatus frame is rotated by a driven workholder disk mechanical pivot apparatus where the rotatable wire-driven circular workholder disk device apparatus frame is attached to the workholder disk device apparatus frame mechanical pivot apparatus and wherein the rotatable wire-driven circular workholder disk device apparatus frame can be rotated in a circular direction relative to and from the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional gap between the rotatable wire-driven circular workholder disk outer diameter circumference and the lower rotatable abrading platen annular abrading-surface outer radius.

6. An at least three rotatable wire-driven circular workholder disk supporting apparatus that rotates workpieces in flat-surfaced double-sided abrading contact with an upper floating platen and an opposed fixed-position lower platen comprising:

a) an abrading machine frame;

b) at least three rotatable wire-driven circular workholder disk supporting apparatus frames that are attached to the abrading machine frame;

c) at least three rotatable wire-driven circular workholder disks having respective rotatable wire-driven circular workholder disk opposed flat disk surfaces where each respective rotatable wire-driven circular workholder disk has a rotatable wire-driven circular workholder disk center located at a rotational center of the respective rotatable wire-driven circular workholder disk and each respective rotatable wire-driven circular workholder disk has a rotatable wire-driven circular workholder disk thickness and each respective rotatable wire-driven circular disk has a rotatable wire-driven circular workholder disk outer diameter and each respective rotatable wire-driven circular workholder disk has a rotatable wire-driven circular workholder disk outer diameter circumference;

d) a rotatable wire-driven circular workholder disk flexible drive-wire where the flexible drive-wire has a flexible drive-wire length and the flexible drive-wire has a flexible drive-wire cross-section shape that has a flexible drive-wire centroid wherein the flexible drive-wire has a flexible drive-wire axis that intersects the respective flexible drive-wire cross-section shape centroid and where the flexible drive-wire axis extends along length-segments of the respective flexible drive-wire length and where the flexible drive-wire is selected from the group consisting of a) metal wires, b) polymer monofilaments, c) braided, twisted or woven polymer strands, d) braided, twisted or woven organic material strands and e) braided, twisted or woven metal strands;

e) wherein each respective rotatable wire-driven circular workholder disk outer diameter circumference has a drive-wire groove that is formed in the respective rotatable wire-driven circular workholder disk thickness where the respective drive-wire groove extends around the respective rotatable wire-driven circular workholder disk's outer diameter circumference where the respective rotatable wire-driven circular workholder disk outer diameter circumference drive-wire groove has a respective drive-wire groove shape that is configured to restrain and guide a rotatable wire-driven circular workholder disk flexible drive-wire that contacts at least thirty degrees of circular arc-length of each respective rotatable wire-driven circular workholder disk outer diameter circumference and where each respective rotatable wire-driven circular workholder disk has a respective rotatable wire-driven circular workholder disk outer diameter drive-wire inlet side and each respective rotatable wire-driven circular workholder disk has a respective rotatable wire-driven circular workholder disk outer diameter drive-wire outlet side;

f) wherein the at least three rotatable wire-driven circular workholder disks are each positioned at fixed locations relative to the respective rotatable wire-driven circular disk workholder supporting apparatus frame by use of respective at least two respective rotatable wire-driven circular workholder disk rotatable disk-positioning idlers having respective rotatable disk-position idlers' outer diameters where the respective rotatable disk-position idlers have respective rotatable disk-position idler outer diameter circumferences that have respective rotatable disk-position idler outer diameter circumference-shapes that are selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each respective selected rotatable disk-position idler outer diameter circumference-shape has rolling contact with the respective rotatable wire-driven circular workholder disk outer diameter circumference to position-restrain and engage the respective rotatable wire-driven circular workholder disk at a desired location relative to the respective rotatable wire-driven circular disk workholder supporting apparatus frame;

g) wherein the at least three rotatable wire-driven circular workholder disks respective first and second rotatable wire-driven circular workholder disk rotatable disk-position idlers are position-spaced at locations that are at least 10 degrees of respective rotatable disk-position idlers' separation arc-length apart from each other where the respective rotatable disk-position idlers' separation arc-lengths are measured along the respective rotatable wire-driven circular workholder disk outer diameter circumferences and where the respective rotatable wire-driven circular workholder disk rotatable disk-position idlers are attached to the respective rotatable wire-driven circular disk workholder device apparatus frames at the respective rotatable wire-driven circular workholder disk rotatable disk-position idlers' position-spaced separation arc-length locations and wherein the respective first rotatable wire-driven circular workholder disk rotatable disk-positioning idler is positioned at the respective rotatable wire-driven circular workholder disk outer diameter drive-wire inlet side and the respective second rotatable wire-driven circular workholder disk rotatable disk-positioning idler is positioned at the respective rotatable wire-driven circular workholder disk outer diameter drive-wire outlet side;

h) wherein the at least three each rotatable wire-driven circular workholder disks have a flexible drive-wire rotatable motor having a flexible drive-wire rotatable motor rotatable motor drive-shaft where a flexible drive-wire motor rotatable flexible drive-wire motor pulley is attached to the flexible drive-wire motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the flexible drive-wire motor can be either attached to a rotatable wire-driven circular disk workholder device apparatus frame or attached to the rotatable wire-driven circular disk workholder device abrading machine frame; and i) wherein each of the at least three rotatable wire-driven circular workholder disks has at least two rotatable wire-driven circular workholder disk flexible drive-wire circular rotatable wire-guide idlers that each have a flexible drive-wire circular rotatable wire-guide idler thickness and each have a flexible drive-wire circular rotatable wire-guide idler outer diameter and each have a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a flexible drive-wire circular rotatable wire-guide idler wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the flexible drive-wire circular rotatable wire-guide idler arc-length is measured along the flexible drive-wire circular rotatable wire-guide idler outer diameter circumferences; and j) wherein each of the at least three each rotatable wire-driven circular workholder disk's at least two rotatable wire-driven circular workholder disk flexible drive-wire circular wire-guide idlers are attached to the respective rotatable wire-driven circular disk workholder supporting apparatus frames wherein a respective rotatable wire-driven circular workholder disk first rotatable wire-driven circular workholder disk flexible drive-wire circular rotatable wire-guide idler is positioned at the respective rotatable wire-driven circular workholder disk outer diameter drive-wire inlet side and a respective rotatable wire-driven circular workholder disk second rotatable wire-driven circular workholder disk flexible drive-wire circular wire-guide idler is positioned at the respective rotatable wire-driven circular workholder disk outer diameter drive-wire outlet side and wherein the respective rotatable wire-driven circular workholder disk first and second rotatable wire-driven rotatable wire-driven circular workholder disk flexible drive-wire circular wire-guide idlers are position-spaced at respective locations that are at least 30 degrees of flexible drive-wire circular rotatable wire-guide idler separation arc-length apart from each other where the flexible drive-wire circular rotatable wire-guide idler separation arc-lengths are measured along the respective rotatable wire-driven circular workholder disk outer diameter circumferences and where the respective rotatable wire-driven circular workholder disk flexible drive-wire circular wire-guide idlers are positioned and spaced at respective flexible drive-wire circular wire-guide idler separation arc-lengths that are greater than the respective rotatable wire-driven circular workholder disk rotatable disk-position idlers' separation arc-lengths;

k) wherein the rotatable wire-driven circular workholder disk flexible drive-wire is routed around and is in contact with the rotatable wire-driven circular workholder disk flexible drive-wire rotatable motor drive-wire pulley circumference and routed to be in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

l) a wire-tensioning device that applies a wire tension force to the rotatable wire-driven circular workholder disk's flexible drive-wire wherein the rotatable wire-driven circular workholder disk flexible drive-wire urges the at least three rotatable wire-driven circular workholder disks against the respective at least three rotatable wire-driven circular workholder disks' at least two rotatable wire-driven circular workholder disk rotatable disk-positioning idlers;

m) a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen is rotationally driven about a lower rotatable abrading platen rotation axis located at a rotational center of the lower rotatable abrading platen and wherein the lower rotatable abrading platen is attached to the abrading machine frame; and n) wherein the lower rotatable abrading platen approximately horizontal, flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads configured with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

o) a floating upper rotatable abrading platen having a flat annular abrading-surface that has an floating upper rotatable abrading platen annular abrading-surface radial width and an floating upper rotatable abrading platen annular abrading-surface inner radius and an floating upper rotatable abrading platen annular abrading-surface outer radius and an floating upper rotatable abrading platen annular abrading-surface outer circumference and where the floating upper rotatable abrading platen is supported by and is rotationally driven about an floating upper rotatable abrading platen rotation axis located at a rotational center of the floating upper rotatable abrading platen by a floating upper rotatable abrading platen spherical-action rotation device located at the rotational center of the floating upper rotatable abrading platen and wherein the upper abrading floating platen spherical-action rotation device allows spherical motion of the floating upper rotatable abrading platen about the floating upper rotatable abrading platen rotational center where the flat annular abrading-surface of the upper rotatable floating abrading platen that is supported by the floating upper rotatable abrading platen spherical-action rotation device is approximately horizontal;

p) wherein the floating upper rotatable abrading platen annular abrading-surface radial width is approximately equal to the lower rotatable abrading platen annular abrading-surface radial width and the floating upper rotatable abrading platen annular abrading-surface outer radius is approximately equal to the lower rotatable abrading platen annular abrading-surface outer radius and the platen annular abrading-surface inner radius is approximately equal to the lower rotatable abrading platen annular abrading-surface inner radius;

q) wherein the upper rotatable platen annular abrading surface is concentric with the lower rotatable platen annular abrading surface;

r) wherein the floating upper rotatable abrading platen approximately horizontal flat annular abrading-surface has an abrasive coating provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

s) wherein the at least three rotatable wire-driven circular workholder disks can be positioned where the rotatable wire-driven circular workholder disk center is located on the lower rotatable abrading platen annular abrading-surface centerline and wherein the at least three rotatable wire-driven circular workholder disks can be positioned where at least three rotatable wire-driven circular workholder disks are located with equal spaces between each of them;

t) workpieces having parallel opposed flat workpiece-top surfaces and flat workpiece-bottom surfaces and the workpieces have workpiece cross-sectional shapes and the workpieces have approximately-equal thicknesses;

u) wherein the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles contain the workpieces wherein the flat workpiece-bottom surfaces are approximately parallel to the respective rotatable wire-driven circular workholder disks' circular flat-surfaced shapes;

v) wherein the workpieces having flat workpiece-bottom surfaces are inserted into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

w) wherein the abrasive surface of the floating upper rotatable abrading platen abrading surface contacts the top flat surfaces of the workpieces with a controlled abrading force that is distributed to the respective flat workpiece-top surfaces of the workpieces contained in the at least three rotatable wire-driven workholder disk devices and wherein the distributed workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface;

x) wherein the flexible drive-wire motor rotates the rotatable wire-driven circular workholder disk flexible drive-wire, which is moved along the rotatable wire-driven circular workholder disk flexible drive-wire axis to rotate the at least three rotatable wire-driven circular workholder disks about the respective rotatable wire-driven circular workholder disks' centers of rotation wherein the workpieces inserted into the rotatable wire-driven circular workholder disks' open workpiece receptacle-holes are rotated about the respective rotatable wire-driven circular workholder disks' centers of rotation and wherein both the floating upper rotatable abrading platen and the lower rotatable abrading platen are rotated independently to abrade both the flat top and flat bottom surfaces of the flat-surfaced workpieces.

7. The apparatus of claim 6 where the respective at least three rotatable wire-driven circular workholder disk supporting apparatus is configured to rotate workpieces, each rotatable wire-driven circular workholder disk supporting apparatus having a rotatable wire-driven circular workholder disk continuous-loop rotatable wire-driven circular workholder disk flexible drive-wire.

8. The apparatus of claim 6 where the at least three rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the rotatable wire-driven circular workholder disks with the lower abrading platen abrasive coating comprising:

a) a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) where the workholder disk rotatable support-idler device outer diameter circumference-shape has rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) where the workholder disk rotatable support-idler device is supported by a workholder disk rotatable support-idler device rotation bearing attached to the lower rotatable abrading platen at the location of the lower rotatable abrading platen rotation axis;

d) wherein the rotatable wire-driven circular workholder disks' at least two rotatable wire-driven circular workholder disk rotatable disk-positioning idlers position, restrain and engage portions of the respective rotatable wire-driven circular workholder disks in a restraint direction that is perpendicular to respective rotatable wire-driven circular workholder disks' flat disk surfaces;

e) wherein both the workholder disk rotatable support-idler device and the respective rotatable wire-driven circular workholder disks' at least two rotatable wire-driven circular workholder disk rotatable disk-positioning idlers position-restrain and engage portions of the respective rotatable wire-driven circular workholder disks where the respective rotatable wire-driven circular workholder disks do not contact the lower rotatable abrading platen abrasive coating.

9. The apparatus of claim 6 where the at least three rotatable wire-driven circular workholder disk device apparatus wire driven workholders can each be translated in a radial direction, or rotated, to and from the lower abrading platen annular abrading surface comprising:

a) where each of the at least three rotatable wire-driven circular workholder disk flexible drive-wire apparatus frames can be translated by a driven workholder disk supporting apparatus frame mechanical slide apparatus where the respective rotatable wire-driven circular workholder disk supporting apparatus frames are attached to the respective workholder disk supporting apparatus frame mechanical slide apparatus and wherein the respective rotatable wire-driven circular workholder disk supporting apparatus frames can be translated in a radial direction relative to and from the lower rotatable abrading platen annular abrading-surface outer radius wherein the respective rotatable wire-driven circular workholder disk outer diameter circumferences is configured to be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius; or b) where each of the at least three rotatable wire-driven circular workholder disk device apparatus frames are rotated by a respective driven workholder disk mechanical pivot apparatus where the respective rotatable wire-driven circular workholder disk supporting apparatus frames are attached to the respective workholder disk supporting apparatus frame mechanical pivot apparatus and wherein the respective rotatable wire-driven circular workholder disk supporting apparatus frames can be rotated in a circular direction relative to and from the lower rotatable abrading platen annular abrading-surface outer radius wherein the respective rotatable wire-driven circular workholder disk outer diameter circumferences can be outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius.

10. The apparatus of claim 6 where the floating upper rotatable abrading platen annular abrading-surface is configured to be aligned to be parallel to the lower rotatable abrading platen annular abrading-surface and wherein the upper abrading floating platen spherical-action rotation device can be rigidly-locked to prevent spherical motion of the floating upper rotatable abrading platen about the floating upper rotatable abrading platen rotational center wherein the flat annular abrading-surface of the upper rotatable floating abrading platen is parallel to the lower rotatable abrading platen annular abrading-surface.

11. A process of using a rotatable wire-driven circular workholder disk supporting apparatus for single-sided abrading the bottom flat surfaces of workpieces that are in abrading contact with a rotatable abrading platen comprising:

a) providing an abrading machine frame;

b) providing a rotatable wire-driven circular workholder disk device apparatus frame that is attached to the abrading machine frame;

c) providing a rotatable wire-driven circular workholder disk having rotatable wire-driven circular workholder disk opposed flat disk surfaces where the rotatable wire-driven circular workholder disk has a rotatable wire-driven circular workholder disk center located at a rotational center of the rotatable wire-driven circular workholder disk and the rotatable wire-driven circular workholder disk has a rotatable wire-driven circular workholder disk thickness and the rotatable wire-driven circular disk has a rotatable wire-driven circular workholder disk outer diameter and the rotatable wire-driven circular workholder disk has a rotatable wire-driven circular workholder disk outer diameter circumference;

d) providing a rotatable wire-driven circular workholder disk flexible drive-wire having a flexible drive-wire length and the flexible drive-wire has a flexible drive-wire cross-section shape that has a flexible drive-wire centroid wherein the flexible drive-wire has a flexible drive-wire axis that intersects the flexible drive-wire cross-section shape centroid and where the flexible drive-wire axis extends along length-segments of the flexible drive-wire length and where the flexible drive-wire is selected from the group consisting of metal wires, polymer monofilaments, braided, twisted or woven polymer strands, braided, twisted or woven organic material strands and braided, twisted or woven metal strands;

e) providing the rotatable wire-driven circular workholder disk outer diameter circumference with a drive-wire groove that is formed in the rotatable wire-driven circular workholder disk thickness where the drive-wire groove extends around the rotatable wire-driven circular workholder disk outer diameter circumference where the rotatable wire-driven circular workholder disk outer diameter circumference drive-wire groove has a drive-wire groove shape that is configured to restrain and guide a rotatable wire-driven circular workholder disk flexible drive-wire that contacts at least thirty degrees of circular arc-length of the rotatable wire-driven circular workholder disk outer diameter circumference and where the rotatable wire-driven circular workholder disk has a rotatable wire-driven circular workholder disk outer diameter drive-wire inlet side and the rotatable wire-driven circular workholder disk has a rotatable wire-driven circular workholder disk outer diameter drive-wire outlet side;

f) positioning the rotatable wire-driven circular workholder disk at a fixed location relative to the rotatable wire-driven circular disk workholder device apparatus frame by use of at least two rotatable wire-driven circular workholder disk rotatable disk-positioning idlers having rotatable disk-position idlers' outer diameters where the rotatable disk-position idlers have rotatable disk-position idler outer diameter circumferences that have a rotatable disk-position idler outer diameter circumference-shape that is selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each selected rotatable disk-position idler outer diameter circumference-shape can have rolling contact with the rotatable wire-driven circular workholder disk outer diameter circumference to position-restrain and engage the rotatable wire-driven circular workholder disk at a desired location relative to the rotatable wire-driven circular disk workholder device apparatus frame;

g) providing a first and a second rotatable wire-driven circular workholder disk rotatable disk-position idlers at position-spaced locations that are at least 10 degrees of rotatable disk-position idlers' separation arc-length apart from each other where the rotatable disk-position idlers' separation arc-length is measured along the rotatable wire-driven circular workholder disk outer diameter circumference and where the rotatable wire-driven circular workholder disk rotatable disk-position idlers are attached to the rotatable wire-driven circular disk workholder device apparatus frame at the respective rotatable wire-driven circular workholder disk rotatable disk-position idlers' position-spaced separation arc-length locations and wherein the first rotatable wire-driven circular workholder disk rotatable disk-positioning idler is positioned at the rotatable wire-driven circular workholder disk outer diameter drive-wire inlet side and the second rotatable wire-driven circular workholder disk rotatable disk-positioning idler is positioned at the rotatable wire-driven circular workholder disk outer diameter drive-wire outlet side;

h) providing a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the rotatable wire-driven circular workholder disk flexible drive-wire rotatable motor can be either attached to the rotatable wire-driven circular disk workholder device apparatus frame or attached to the rotatable wire-driven circular disk workholder device abrading machine frame; and i) providing at least two rotatable wire-driven circular workholder disk flexible drive-wire circular rotatable wire-guide idlers that each have a flexible drive-wire circular rotatable wire-guide idler thickness and each flexible drive-wire circular rotatable wire-guide idler has a flexible drive-wire circular rotatable wire-guide idler outer diameter and each flexible drive-wire circular rotatable wire-guide idler has a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the rotatable wire-guide idler arc-length is measured along the flexible drive-wire circular rotatable wire-guide idler outer diameter circumferences; and j) providing that the at least two rotatable wire-driven circular workholder disk flexible drive-wire circular rotatable wire-guide idlers are attached to the rotatable wire-driven circular disk workholder device apparatus frame wherein a first rotatable wire-driven circular workholder disk flexible drive-wire circular rotatable wire-guide idler is positioned at the rotatable wire-driven circular workholder disk outer diameter drive-wire inlet side and a second rotatable wire-driven circular workholder disk flexible drive-wire circular rotatable wire-guide idler is positioned at the rotatable wire-driven circular workholder disk outer diameter drive-wire outlet side and wherein the first and second rotatable wire-driven rotatable wire-driven circular workholder disk flexible drive-wire circular rotatable wire-guide idlers are position-spaced at locations that are at least 30 degrees of wire-guide idler separation arc-length apart from each other where the flexible drive-wire circular rotatable wire-guide idler separation arc-length is measured along the rotatable wire-driven circular workholder disk outer diameter circumference and where the rotatable wire-driven circular workholder disk flexible drive-wire circular rotatable wire-guide idlers are position-spaced at flexible drive-wire circular rotatable wire-guide idler separation arc-lengths that are greater than the rotatable wire-driven circular workholder disk rotatable disk-position idlers' separation arc-lengths;

k) routing the respective rotatable wire-driven circular workholder disk flexible drive-wire around and in contact with the rotatable wire-driven circular workholder disk flexible drive-wire rotatable motor drive-wire pulley circumference and routing it to be in contact with at least a first rotatable wire-driven circular workholder disk flexible drive-wire circular rotatable wire-guide idler circumference and routing it to be in contact with the rotatable wire-driven circular workholder disk circumference and routing it to be in contact with at least a second rotatable wire-driven circular workholder disk flexible drive-wire circular rotatable wire-guide idler circumference and routing it back to and in contact with the rotatable wire-driven circular workholder disk flexible drive-wire rotatable motor drive-wire pulley circumference;

l) providing the rotatable wire-driven circular workholder disk flexible drive-wire as routed around and in contact with the rotatable wire-driven circular workholder disk flexible drive-wire rotatable motor drive-wire pulley circumference and routed to be in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

m) providing a wire tension force with a wire-tensioning device to the rotatable wire-driven circular workholder disk's flexible drive-wire wherein the respective rotatable wire-driven circular workholder disk flexible drive-wire urges the rotatable wire-driven circular workholder disk against the at least two rotatable wire-driven circular workholder disk rotatable disk-positioning idlers;

n) providing a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and o) providing the lower rotatable abrading platen approximately horizontal flat annular abrading-surface with an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

p) positioning the rotatable wire-driven circular workholder disk where the rotatable wire-driven circular workholder disk center is located on the lower rotatable abrading platen annular abrading-surface centerline;

q) providing workpieces above and in contact with respective the lower rotatable abrading platen approximately horizontal flat annular abrading-surface, the workpieces having parallel opposed flat workpiece-top surfaces and flat workpiece-bottom surfaces and the workpieces have workpiece cross-sectional shapes and the workpieces have approximately-equal thicknesses;

r) providing the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes wherein the respective rotatable wire-driven circular workholder disks' open workpiece receptacles are suitable to contain the workpieces wherein the flat workpiece-bottom surfaces are approximately parallel to the respective rotatable wire-driven circular workholder disks' circular flat-surfaced shapes;

s) inserting the workpieces having flat workpiece-bottom surfaces into the rotatable wire-driven circular workholder disk's open workpiece receptacle-holes wherein the respective open receptacles contain the approximately-equal thicknesses flat-surfaced workpieces and wherein the flat workpiece-bottom surfaces are in flat-surface contact with the abrasive coating of the selected abrasive device on the lower rotatable abrading platen annular abrading-surface;

t) applying controlled workpiece abrading forces to the respective workpieces' flat workpiece-top surfaces by placing weights on the workpieces' flat workpiece-top surfaces or by applying abrading forces to the workpieces' flat workpiece-top surfaces wherein the controlled workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface;

u) rotating the flexible drive-wire rotatable motor wherein the rotatable wire-driven circular workholder disk flexible drive-wire is moved along the rotatable wire-driven circular workholder disk flexible drive-wire axis to rotate the rotatable wire-driven circular workholder disk about the rotatable wire-driven circular workholder disk's center of rotation wherein the workpieces inserted into the rotatable wire-driven circular workholder disk's open workpiece receptacle-holes are rotated about the rotatable wire-driven circular workholder disk's center of rotation and wherein the lower rotatable abrading platen is rotated to single-sided abrade the workpiece-bottom surfaces.

12. The process of claim 11 where the rotatable wire-driven circular workholder disk flexible drive-wire wire is a continuous-loop rotatable wire-driven circular workholder disk flexible drive-wire.

13. The process of claim 11 where multiple rotatable wire-driven circular workholder disks are provided where components are selected from the group consisting of more than one rotatable wire-driven workholder disk device apparatus frame, more than one rotatable wire-driven circular workholder disk, a rotatable wire-driven circular workholder disk flexible drive-wire or more than one rotatable wire-driven circular workholder disk flexible drive-wire, respective more than one set of first and second rotatable wire-driven circular workholder disk rotatable disk-positioning idlers, respective more than one set of first and second rotatable wire-driven circular workholder disk flexible drive-wire circular rotatable wire-guide idlers, a rotatable wire-driven circular workholder disk flexible drive-wire rotatable motor or more than one rotatable wire-driven circular workholder disk flexible drive-wire rotatable motor, a wire-tensioning device or multiple wire-tensioning devices that applies a wire tension force or wire tension forces to the respective rotatable wire-driven circular workholder disk's flexible drive-wire or rotatable wire-driven circular workholder disk's flexible drive-wires where these components are attached to the abrading machine frame to provide multiple rotatable wire-driven circular workholder disks that can be positioned where the respective rotatable wire-driven circular workholder disk centers are located on the rotatable abrading platen annular abrading-surface centerline and wherein the multiple rotatable wire-driven circular workholder disks' flexible drive-wires have a flexible drive-wire length or a flexible drive-wire continuous-loop.

14. The process of claim 13 where the multiple rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the multiple rotatable wire-driven circular workholder disks with the lower abrading platen abrasive coating comprising:

a) providing a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) providing the workholder disk rotatable support-idler device outer diameter circumference-shape in rolling contact with the respective rotatable wire-driven circular workholder disks' outer diameter circumferences to position-restrain and engage portions of the respective rotatable wire-driven circular workholder disks in a restraint direction that is perpendicular to respective rotatable wire-driven circular workholder disks' flat disk surfaces;

c) supporting the workholder disk rotatable support-idler device by a workholder disk rotatable support-idler device rotation bearing that is attached to the lower rotatable abrading platen at the location of the lower rotatable abrading platen rotation axis;

d) providing the multiple rotatable wire-driven circular workholder disks' at least two rotatable wire-driven circular workholder disk rotatable disk-positioning idlers position-restrain and engage portions of the respective rotatable wire-driven circular workholder disks in a restraint direction that is perpendicular to respective rotatable wire-driven circular workholder disks' flat disk surfaces;

e) providing both the workholder disk rotatable support-idler device and the multiple respective rotatable wire-driven circular workholder disks' at least two rotatable wire-driven circular workholder disk rotatable disk-positioning idlers position-restrain and engaging portions of the respective rotatable wire-driven circular workholder disks where the multiple respective rotatable wire-driven circular workholder disks do not contact the lower rotatable abrading platen abrasive coating.

15. The process of claim 11 where the rotatable wire-driven circular workholder disk device apparatus is translated in a radial direction, or rotated, to and from the lower abrading platen annular abrading surface comprising:

a) translating the rotatable wire-driven circular workholder disk flexible drive-wire apparatus frame by a driven workholder disk device apparatus frame mechanical slide apparatus where the respective rotatable wire-driven circular workholder disk supporting apparatus frame is attached to the workholder disk supporting apparatus frame mechanical slide apparatus and wherein the respective rotatable wire-driven circular workholder disk supporting apparatus frames can be translated in a radial direction relative to and from the lower rotatable abrading platen annular abrading-surface outer radius wherein the rotatable wire-driven circular workholder disk outer diameter circumferences can be outwardly positioned relative to the lower rotatable abrading platen annular abrading-surface outer radius wherein the rotatable wire-driven circular workholder disk outer diameter circumference has a positional-gap between the rotatable wire-driven circular workholder disk outer diameter circumference and the lower rotatable abrading platen annular abrading-surface outer radius; or b) where the rotatable wire-driven circular workholder disk device apparatus frame is rotated by a driven workholder disk mechanical pivot apparatus where the rotatable wire-driven circular workholder disk supporting apparatus frame is attached to the workholder disk supporting apparatus frame mechanical pivot apparatus and wherein the rotatable wire-driven circular workholder disk supporting apparatus frame can be rotated in a circular direction relative to and from the lower rotatable abrading platen annular abrading-surface outer radius wherein the rotatable wire-driven circular workholder disk outer diameter circumference can be outwardly positioned relative to the lower rotatable abrading platen annular abrading-surface outer radius wherein the rotatable wire-driven circular workholder disk outer diameter circumference has a positional-gap between the rotatable wire-driven circular workholder disk outer diameter circumference and the lower rotatable abrading platen annular abrading-surface outer radius.

16. A process of using an at least three rotatable wire-driven circular workholder disk device apparatus comprising rotating workpieces in flat-surfaced double-sided abrading contact with an upper floating platen and an opposed fixed-position lower platen, the process comprising:

a) providing an abrading machine frame;

b) providing at least three rotatable wire-driven circular workholder disk device apparatus frames that are attached to the abrading machine frame;

c) providing at least three rotatable wire-driven circular workholder disks having respective rotatable wire-driven circular workholder disk opposed flat disk surfaces where each respective rotatable wire-driven circular workholder disk has a rotatable wire-driven circular workholder disk center located at a rotational center of the respective rotatable wire-driven circular workholder disk and each respective rotatable wire-driven circular workholder disk has a rotatable wire-driven circular workholder disk thickness and each respective rotatable wire-driven circular disk has a rotatable wire-driven circular workholder disk outer diameter and each respective rotatable wire-driven circular workholder disk has a rotatable wire-driven circular workholder disk outer diameter circumference;

d) providing a rotatable wire-driven circular workholder disk flexible drive-wire where the flexible drive-wire has a flexible drive-wire length and the flexible drive-wire has a flexible drive-wire cross-section shape that has a flexible drive-wire centroid wherein the flexible drive-wire has a flexible drive-wire axis that intersects the respective flexible drive-wire cross-section shape centroid and where the flexible drive-wire axis extends along length-segments of the respective flexible drive-wire length and where the flexible drive-wire is selected from the group consisting of metal wires, polymer monofilaments, braided, twisted or woven polymer strands, braided, twisted or woven organic material strands and braided, twisted or woven metal strands;

e) providing each respective rotatable wire-driven circular workholder disk outer diameter circumference with a drive-wire groove formed in the respective rotatable wire-driven circular workholder disk thickness where the respective drive-wire groove extends around the respective rotatable wire-driven circular workholder disk's outer diameter circumference where the respective rotatable wire-driven circular workholder disk outer diameter circumference drive-wire groove has a respective drive-wire groove shape that is configured to restrain and guide a rotatable wire-driven circular workholder disk flexible drive-wire that contacts at least thirty degrees of circular arc-length of each respective rotatable wire-driven circular workholder disk outer diameter circumference and where each respective rotatable wire-driven circular workholder disk has a respective rotatable wire-driven circular workholder disk outer diameter drive-wire inlet side and each respective rotatable wire-driven circular workholder disk has a respective rotatable wire-driven circular workholder disk outer diameter drive-wire outlet side;

f) positioning each of the at least three rotatable wire-driven circular workholder disks at fixed locations relative to the respective rotatable wire-driven circular disk workholder supporting apparatus frame by use of respective at least two respective rotatable wire-driven circular workholder disk rotatable disk-positioning idlers having respective rotatable disk-position idlers' outer diameters where the respective rotatable disk-position idlers have respective rotatable disk-position idler outer diameter circumferences that have respective rotatable disk-position idler outer diameter circumference-shapes that are selected from the group consisting of a double-angled knife-edge rotatable disk-position idler outer diameter circumference-shape, a cylindrical-surface rotatable disk-position idler outer diameter circumference-shape, a curved-surface rotatable disk-position idler outer diameter circumference-shape, a double-flanged rotatable disk-position idler outer diameter circumference-shape and a double-flange cylindrical-flat-surfaced bottom rotatable disk-position idler outer diameter circumference-shape where each respective selected rotatable disk-position idler outer diameter circumference-shape have rolling contact with the respective rotatable wire-driven circular workholder disk outer diameter circumference to position-restrain and engage the respective rotatable wire-driven circular workholder disk at a desired location relative to the respective rotatable wire-driven circular disk workholder device apparatus frame;

g) providing the at least three rotatable wire-driven circular workholder disks respective first and second rotatable wire-driven circular workholder disk rotatable disk-position idlers at position-spaced locations that are at least 10 degrees of respective rotatable disk-position idlers' separation arc-length apart from each other where the respective rotatable disk-position idlers' separation arc-lengths are measured along the respective rotatable wire-driven circular workholder disk outer diameter circumferences and where the respective rotatable wire-driven circular workholder disk rotatable disk-position idlers are attached to the respective rotatable wire-driven circular disk workholder device apparatus frames at the respective rotatable wire-driven circular workholder disk rotatable disk-position idlers' position-spaced separation arc-length locations and wherein the respective first rotatable wire-driven circular workholder disk rotatable disk-positioning idler is positioned at the respective rotatable wire-driven circular workholder disk outer diameter drive-wire inlet side and the respective second rotatable wire-driven circular workholder disk rotatable disk-positioning idler is positioned at the respective rotatable wire-driven circular workholder disk outer diameter drive-wire outlet side;

h) providing the at least three each rotatable wire-driven circular workholder disks with a flexible drive-wire rotatable motor having a flexible drive-wire rotatable motor rotatable motor drive-shaft where a flexible drive-wire rotatable motor rotatable flexible drive-wire motor pulley is attached to the flexible drive-wire rotatable motor rotatable motor drive-shaft where the rotatable flexible drive-wire motor pulley has a flexible drive-wire rotatable motor pulley outer diameter where the rotatable flexible drive-wire motor pulley has a rotatable flexible drive-wire motor pulley outer diameter circumference and where the rotatable flexible drive-wire motor pulley has a flexible drive-wire-contact surface that is configured to restrain and guide a rotatable wire-driven circular workholder disk flexible drive-wire that contacts at least thirty degrees of arc-length of the rotatable drive-wire motor pulley outer diameter circumference where the rotatable drive-wire motor pulley arc-length is measured along the rotatable drive-wire motor pulley outer diameter circumference and wherein the flexible drive-wire rotatable motor can be either attached to a rotatable wire-driven circular disk workholder device apparatus frame or attached to the rotatable wire-driven circular disk workholder device abrading machine frame; and i) providing each of the at least three rotatable wire-driven circular workholder disks with at least two rotatable wire-driven circular workholder disk flexible drive-wire circular rotatable wire-guide idlers that each have a flexible drive-wire circular rotatable wire-guide idler thickness and each have a flexible drive-wire circular rotatable wire-guide idler outer diameter and each have a flexible drive-wire circular rotatable wire-guide idler outer diameter circumference wherein each flexible drive-wire circular rotatable wire-guide idler outer diameter circumference has a flexible drive-wire circular rotatable wire-guide idler wire-groove that is formed in the flexible drive-wire circular rotatable wire-guide idler thickness where the flexible drive-wire circular rotatable wire-guide idler wire-groove extends around the flexible drive-wire circular rotatable wire-guide idler outer diameter circumference where the flexible drive-wire circular rotatable wire-guide idler wire-groove has a flexible drive-wire circular rotatable wire-guide idler wire-groove shape that is configured to restrain and guide a rotatable wire-driven circular workholder disk flexible drive-wire that contacts at least five degrees of arc-length of the flexible drive-wire circular rotatable wire-guide idler outer diameter circumference where the flexible drive-wire circular rotatable wire-guide idler arc-length is measured along the flexible drive-wire circular rotatable wire-guide idler outer diameter circumferences; and j) attaching each of the at least three each rotatable wire-driven circular workholder disk's at least two rotatable wire-driven circular workholder disk flexible drive-wire circular wire-guide idlers to the respective rotatable wire-driven circular disk workholder device apparatus frames wherein a respective rotatable wire-driven circular workholder disk first rotatable wire-driven circular workholder disk flexible drive-wire circular rotatable wire-guide idler is positioned at the respective rotatable wire-driven circular workholder disk outer diameter drive-wire inlet side and a respective rotatable wire-driven circular workholder disk second rotatable wire-driven circular workholder disk flexible drive-wire circular wire-guide idler is positioned at the respective rotatable wire-driven circular workholder disk outer diameter drive-wire outlet side and wherein the respective rotatable wire-driven circular workholder disk first and second rotatable wire-driven rotatable wire-driven circular workholder disk flexible drive-wire circular wire-guide idlers are position-spaced at respective locations that are at least 30 degrees of flexible drive-wire circular rotatable wire-guide idler separation arc-length apart from each other where the flexible drive-wire circular rotatable wire-guide idler separation arc-lengths are measured along the respective rotatable wire-driven circular workholder disk outer diameter circumferences and where the respective rotatable wire-driven circular workholder disk flexible drive-wire circular wire-guide idlers are position-spaced at respective flexible drive-wire circular wire-guide idler separation arc-lengths that are greater than the respective rotatable wire-driven circular workholder disk rotatable disk-position idlers' separation arc-lengths;

k) routing the rotatable wire-driven circular workholder disk flexible drive-wire around and in contact with the rotatable wire-driven circular workholder disk flexible drive-wire rotatable motor drive-wire pulley circumference and the routing being in contact with each of the at least three first rotatable wire-driven circular workholder disk flexible drive-wire circular rotatable wire-guide idler circumferences and routed to be in contact with each of the at least three rotatable wire-driven circular workholder disk circumferences and routed to be in contact with at least three second rotatable wire-driven circular workholder disk flexible drive-wire circular rotatable wire-guide idler circumferences and routed back to and in contact with the rotatable wire-driven circular workholder disk flexible drive-wire rotatable motor drive-wire pulley circumference;

l) applying a wire tension force with a wire-tensioning device to the rotatable wire-driven circular workholder disk's flexible drive-wire wherein the rotatable wire-driven circular workholder disk flexible drive-wire urges the at least three rotatable wire-driven circular workholder disks against the respective at least three rotatable wire-driven circular workholder disks' at least two rotatable wire-driven circular workholder disk rotatable disk-positioning idlers;

m) providing a lower rotatable abrading platen having an approximately-horizontal flat annular abrading-surface that has a lower rotatable abrading platen annular abrading-surface radial width and a lower rotatable abrading platen annular abrading-surface inner radius and a lower rotatable abrading platen annular abrading-surface outer radius and a lower rotatable abrading platen annular abrading-surface outer circumference and a lower rotatable abrading platen annular abrading-surface centerline that is positioned midway between a lower rotatable abrading platen annular abrading-surface inner radius and a lower rotatable abrading platen annular abrading-surface outer radius and where the lower abrading platen can be rotationally driven about a lower rotatable abrading platen rotation axis located at a rotational center of the lower rotatable abrading platen and wherein the lower rotatable abrading platen is attached to the abrading machine frame; and n) providing the lower rotatable abrading platen approximately horizontal flat annular abrading-surface with an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

o) providing a floating upper rotatable abrading platen having a flat annular abrading-surface that has an floating upper rotatable abrading platen annular abrading-surface radial width and an floating upper rotatable abrading platen annular abrading-surface inner radius and an floating upper rotatable abrading platen annular abrading-surface outer radius and an floating upper rotatable abrading platen annular abrading-surface outer circumference and where the floating upper rotatable abrading platen is supported by and is rotationally driven about an floating upper rotatable abrading platen rotation axis located at a rotational center of the floating upper rotatable abrading platen by a floating upper rotatable abrading platen spherical-action rotation device located at the rotational center of the floating upper rotatable abrading platen and wherein the upper abrading floating platen spherical-action rotation device allows spherical motion of the floating upper rotatable abrading platen about the floating upper rotatable abrading platen rotational center where the flat annular abrading-surface of the upper rotatable floating abrading platen that is supported by the floating upper rotatable abrading platen spherical-action rotation device is approximately horizontal;

p) providing the floating upper rotatable abrading platen annular abrading-surface with a radial width that is approximately equal to the lower rotatable abrading platen annular abrading-surface radial width and providing the floating upper rotatable abrading platen annular abrading-surface outer radius with a radius that is approximately equal to the lower rotatable abrading platen annular abrading-surface outer radius and the platen annular abrading-surface inner radius is approximately equal to the lower rotatable abrading platen annular abrading-surface inner radius;

q) aligning the upper rotatable platen annular abrading surface to be concentric with the lower rotatable platen annular abrading surface;

r) providing the floating upper rotatable abrading platen approximately horizontal flat annular abrading-surface with an abrasive coating that is provided by an abrasive device selected from the group consisting of flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, flexible flat-surfaced metal or polymer disks, and liquid abrasive-slurry coatings;

s) positioning the at least three rotatable wire-driven circular workholder disks so that the rotatable wire-driven circular workholder disk center is located on the lower rotatable abrading platen annular abrading-surface centerline and wherein the at least three rotatable wire-driven circular workholder disks are positioned where at least three rotatable wire-driven circular workholder disks are located with equal spaces between each of them;

t) providing workpieces having parallel opposed flat workpiece-top surfaces and flat workpiece-bottom surfaces and the workpieces have workpiece cross-sectional shapes and the workpieces have approximately-equal thicknesses;

u) providing the rotatable wire-driven circular workholder disks have workpiece receptacle-holes that extend though the respective rotatable wire-driven circular workholder disks' thicknesses where the respective rotatable wire-driven circular workholder disk's workpiece receptacle-holes have cross-sectional shapes that have the same approximate shapes as the workpieces' cross-sectional shapes so that the respective rotatable wire-driven circular workholder disks' open workpiece receptacles contain the workpieces wherein the flat workpiece-bottom surfaces are approximately parallel to the respective rotatable wire-driven circular workholder disks' circular flat-surfaced shapes;

v) inserting the workpieces having flat workpiece-bottom surfaces into the rotatable wire-driven circular workholder disk's open workpiece receptacle-holes wherein the respective open receptacles contain the approximately-equal thicknesses flat-surfaced workpieces against respective floating upper rotatable abrading platen approximately horizontal flat annular abrading-surface with an abrasive coating and wherein the flat workpiece-bottom surfaces are in flat-surface contact with the abrasive coating of the selected abrasive device on the lower rotatable abrading platen annular abrading-surface;

w) contacting the abrasive surface of the floating upper rotatable abrading platen abrading surface with the top flat surfaces of the workpieces with a controlled abrading force that is distributed to the respective flat workpiece-top surfaces of the workpieces contained in the at least three rotatable wire-driven workholder disk devices and wherein the distributed workpiece abrading forces applied to the respective flat workpiece-top surfaces are transferred through the respective workpiece approximately-equal thicknesses to the respective flat workpiece-bottom surfaces which are in abrading contact with the abrasive surface of the lower rotatable platen annular abrading-surface;

x) rotating the flexible drive-wire motor so that the rotatable wire-driven circular workholder disk flexible drive-wire is moved along the rotatable wire-driven circular workholder disk flexible drive-wire axis to rotate the at least three rotatable wire-driven circular workholder disks about the respective rotatable wire-driven circular workholder disks' centers of rotation wherein the workpieces inserted into the rotatable wire-driven circular workholder disks' open workpiece receptacle-holes are rotated about the respective rotatable wire-driven circular workholder disks' centers of rotation and wherein both the floating upper rotatable abrading platen and the lower rotatable abrading platen are rotated independently to abrade both the flat top and flat bottom surfaces of the flat-surfaced workpieces.

17. The process of claim 16 where the respective at least three rotatable wire-driven circular workholder disk device apparatus that rotates rotatable abrading platens against workpieces each have a rotatable wire-driven circular workholder disk flexible continuous-loop rotatable wire-driven circular workholder disk flexible drive-wire.

18. The process of claim 16 where the at least three rotatable wire-driven circular workholder disks are each supported by a lower rotatable abrading platen annular abrading-surface inner radius workholder disk rotatable support-idler device and are also supported by respective at least two rotatable wire-driven circular workholder disk rotatable disk-positioning idlers that together prevent contact of the rotatable wire-driven circular workholder disks with the lower abrading platen abrasive coating comprising:

a) providing a lower rotatable abrading platen annular abrading-surface inner radius workholder disk rotatable support-idler device having a workholder disk rotatable support-idler device outer diameter where the workholder disk rotatable support-idler device outer diameter has a workholder disk rotatable support-idler device outer diameter circumference having a workholder disk rotatable support-idler device outer diameter circumference-shape that is selected from the group consisting of a curved-surface workholder disk rotatable support-idler device outer diameter circumference-shape, a double-flanged workholder disk rotatable support-idler device outer diameter circumference-shape and a double-flange cylindrical-flat-surfaced bottom workholder disk rotatable support-idler device outer diameter circumference-shape;

b) providing the workholder disk rotatable support-idler device outer diameter circumference-shape with rolling contact with the respective rotatable wire-driven circular workholder disks' outer diameter circumferences to position, restrain and engage portions of the respective rotatable wire-driven circular workholder disks in a restraint direction that is perpendicular to respective rotatable wire-driven circular workholder disks' flat disk surfaces;

c) supporting the workholder disk rotatable support-idler device with a workholder disk rotatable support-idler device rotation bearing that is attached to the lower rotatable abrading platen at the location of the lower rotatable abrading platen rotation axis;

d) providing the rotatable wire-driven circular workholder disks' at least two rotatable wire-driven circular workholder disk rotatable disk-positioning idlers to position, restrain and engage portions of the respective rotatable wire-driven circular workholder disks in a restraint direction that is perpendicular to respective rotatable wire-driven circular workholder disks' flat disk surfaces;

e) providing both the workholder disk rotatable support-idler device and the respective rotatable wire-driven circular workholder disks' at least two rotatable wire-driven circular workholder disk rotatable disk-positioning idlers position-restrain and engaging portions of the respective rotatable wire-driven circular workholder disks where the respective rotatable wire-driven circular workholder disks do not contact the lower rotatable abrading platen abrasive coating.

19. The process of claim 16 where the at least three rotatable wire-driven circular workholder disk device apparatus wire driven workholders are each translated in a radial direction, or rotated, to and from the lower abrading platen annular abrading surface comprising:

a) providing each of the at least three rotatable wire-driven circular workholder disk flexible drive-wire apparatus frames and translating them by a driven workholder disk device apparatus frame mechanical slide apparatus where the respective rotatable wire-driven circular workholder disk supporting apparatus frames are attached to the respective workholder disk supporting apparatus frame mechanical slide apparatus and wherein the respective rotatable wire-driven circular workholder disk supporting apparatus frames is translated in a radial direction relative to and from the lower rotatable abrading platen annular abrading-surface outer radius wherein the respective rotatable wire-driven circular workholder disk outer diameter circumferences are outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius; or b) rotating each of the at least three rotatable wire-driven circular workholder disk device apparatus frames by a respective driven workholder disk mechanical pivot apparatus where the respective rotatable wire-driven circular workholder disk device apparatus frames are attached to the respective workholder disk device apparatus frame mechanical pivot apparatus and wherein the respective rotatable wire-driven circular workholder disk device apparatus frames are rotated in a circular direction relative to and from the lower rotatable abrading platen annular abrading-surface outer radius wherein the respective rotatable wire-driven circular workholder disk outer diameter circumferences are outwardly positioned relative to the lower rotatable abrading platen annular abrading-surface outer radius wherein the respective rotatable wire-driven circular workholder disk outer diameter circumferences have a respective positional-gap between the respective rotatable wire-driven circular workholder disk outer diameter circumferences and the lower rotatable abrading platen annular abrading-surface outer radius.

20. The process of claim 16 where the floating upper rotatable abrading platen annular abrading-surface is aligned to be parallel to the lower rotatable abrading platen annular abrading-surface and wherein the upper abrading floating platen spherical-action rotation device is rigidly-locked to prevent spherical motion of the floating upper rotatable abrading platen about the floating upper rotatable abrading platen rotational center wherein the flat annular abrading-surface of the upper rotatable floating abrading platen is parallel to the lower rotatable abrading platen annular abrading-surface.

* * * * *